US010697703B2

(12) United States Patent
Horvat et al.

(10) Patent No.: US 10,697,703 B2
(45) Date of Patent: Jun. 30, 2020

(54) MARINE HEAT EXCHANGER

(71) Applicant: Duramax Marine, LLC, Hiram, OH (US)

(72) Inventors: Frank E. Horvat, Macedonia, OH (US); Joseph H. Andulics, North Ridgeville, OH (US)

(73) Assignee: Duramax Marine, LLC, Hiram, OH (US)

( * ) Notice: Subject to any disclaimer, the term of this patent is extended or adjusted under 35 U.S.C. 154(b) by 125 days.

(21) Appl. No.: 15/527,090

(22) PCT Filed: Dec. 1, 2015

(86) PCT No.: PCT/US2015/063070
§ 371 (c)(1),
(2) Date: May 16, 2017

(87) PCT Pub. No.: WO2016/089802
PCT Pub. Date: Jun. 9, 2016

(65) Prior Publication Data

US 2018/0283793 A1 Oct. 4, 2018

Related U.S. Application Data

(60) Provisional application No. 62/210,643, filed on Aug. 27, 2015, provisional application No. 62/086,276,
(Continued)

(51) Int. Cl.
*F28D 1/02* (2006.01)
*F28F 9/26* (2006.01)
(Continued)

(52) U.S. Cl.
CPC ..... *F28D 1/022* (2013.01); *F28F 9/262* (2013.01); *F28F 13/02* (2013.01); *F28F 13/06* (2013.01);
(Continued)

(58) Field of Classification Search
CPC ..... F28D 1/022; F28D 1/0426–1/0452; F28D 1/0206; F28F 9/001; F28F 9/002;
(Continued)

(56) References Cited

U.S. PATENT DOCUMENTS 2,382,218 A 8/1945 Fernstrum
2,488,615 A 11/1949 Arnold
(Continued)

FOREIGN PATENT DOCUMENTS

WO 2014152527 A1 9/2014

*Primary Examiner* — Jianying C Atkisson
*Assistant Examiner* — Jose O Class-Quinones
(74) *Attorney, Agent, or Firm* — Walter | Haverfield LLP; Sean F. Mellino; D. Peter Hochberg

(57) ABSTRACT

A multiple-stacked marine heat exchanger for cooling at least one heat source in a marine vessel having an upper marine heat exchanger with a forward beveled end and upper coolant flow tubes connected thereto, a lower marine exchanger having a forward beveled end which converges with the forward beveled end of the upper marine heat exchanger and lower coolant flow tubes connected thereto, and an ambient water passageway extending through each pair of stacked marine heat exchangers in the multi-stacked marine heat exchanger. In one situation, the beveled ends cooperate to form a stagnant pressure region near the entrance to the ambient water passageway to create an increase in pressure at the entrance to create jets of turbulent water flowing through the passageway to break up the laminar boundary layer and increase heat transfer from the coolant flow tubes.

55 Claims, 36 Drawing Sheets

Related U.S. Application Data filed on Dec. 2, 2014, provisional application No. 62/086,264, filed on Dec. 2, 2014, provisional application No. 62/086,254, filed on Dec. 2, 2014, provisional application No. 62/086,249, filed on Dec. 2, 2014.

(51) Int. Cl.

| | |
|---|---|
| ***F28F 13/06*** | (2006.01) |
| ***F28F 13/02*** | (2006.01) |
| ***F28F 13/12*** | (2006.01) |
| ***F28F 9/02*** | (2006.01) |

(52) U.S. Cl.
CPC ..... *F28F 13/12* (2013.01); *F28F 9/0246* (2013.01); *F28F 2275/08* (2013.01)

(58) Field of Classification Search
CPC ..... F28F 2009/004; F28F 13/06; F28F 13/12; F28F 25/12; F28F 13/02; F28F 2280/06
USPC ..... 165/44, 176
See application file for complete search history.

(56) References Cited

U.S. PATENT DOCUMENTS 2,612,858 A * 10/1952 Mairs ..... F01P 3/207 165/164
3,561,524 A * 2/1971 Satterthwaite ..... F01P 3/207 165/44
4,040,476 A * 8/1977 Telle ..... B63J 2/12 165/44
4,043,289 A * 8/1977 Walter ..... B63J 2/12 165/44
4,336,838 A 6/1982 Ely
4,338,993 A * 7/1982 Fernstrum ..... F01P 3/207 165/165
4,557,319 A * 12/1985 Arnold ..... F01P 3/207 114/67 R
4,823,865 A 4/1989 Hughes
6,099,373 A * 8/2000 Fernstrum ..... F01P 3/207 165/44
6,575,227 B1 6/2003 Leeson et al.
7,044,194 B2 5/2006 Leeson et al.
7,328,740 B2 2/2008 Leeson et al.
2001/0018970 A1 9/2001 Nakado et al.
2002/0162643 A1* 11/2002 Leeson ..... F01P 3/207 165/41
2004/0079516 A1 4/2004 Leeson et al.
2006/0201652 A1 9/2006 Leeson et al.
2009/0025916 A1 1/2009 Meshenky et al.
2009/0145591 A1* 6/2009 Rericha ..... B63H 21/10 165/174
2009/0250191 A1* 10/2009 Klein ..... F28F 13/003 165/44

* cited by examiner

MARINE HEAT EXCHANGER

CROSS-REFERENCE TO RELATED APPLICATION

This application claims the benefit of prior U.S. Provisional Patent Application Nos. 62/086,249 (filed Dec. 2, 2014), 62/086,254 (filed Dec. 2, 2014), 62/086,264 (filed Dec. 2, 2014), 62/086,276 (filed Dec. 2, 2014) and 62/210,643 (filed Aug. 27, 2015).

BACKGROUND OF THE INVENTION

Field of the Invention

This invention relates to heat exchangers, more particularly to marine heat exchangers, and more specifically to keel coolers. The invention even more specifically relates to improvements in heat transfer from coolant flowing from a heat source on a marine vessel through coolant flow tubes at a higher temperature than the ambient external water by increasing the turbulence of the ambient water against the external surface of the tubes carrying the coolant, by providing more surface area on the marine heat exchanger than has heretofore existed, allowing the increased ambient water flow from stagnant areas in the ambient water around the marine heat exchanger, and for improving the performance and construction of stacked keel coolers.

Description of the Prior Art

Heat-generating sources in marine vessels are often cooled by water or other liquids. The water can be fresh water, salt water, a mixture of fresh water and salt water and other liquids as well. The cooling fluid or coolant flows through liquid conducting lines such as tubes where the coolant picks up heat from the heat sources, and then flows through another part of the coolant or plumbing circuit where the heat is transferred to the ambient surroundings, which is generally the water through which the marine vessel travels. For small engines such as outboard motors for small boats, ambient water is pumped through the engine which provides sufficient coolant. However, since larger marine vessels have increased power demand, ambient water is pumped through the engine (and other heat sources) to cool the engine down, but it can contaminates the engine. Sometimes channel steel is used for larger marine vessels because of its cooling capacity, but this takes up payload space rendering the use of channel steel as a coolant very expensive.

Keel coolers were developed in the 1940s as described in U.S. Pat. No. 2,382,218 (Fernstrum, 1945). This Fernstrum patent described a heat exchanger for attachment to a marine hull structure. The Fernstrum keel cooler is composed of a pair of spaced headers that are secured to the hull, and the plurality of heat conduction tubes which extend between the headers. Cylindrical plumbing through the hull connects the headers to coolant flow lines extending from the engine or other heat source. Hot coolant leaves the engine or other heat source, and runs into a heat exchanger header located beneath the water level. The water level, as used herein, refers to the water level which is preferably the aerated water, that is, below the level where foam and bubbles occur. The header is located beneath the hull or at least on one of the lower sides of the hull. The coolant flows from the header through a number of rectangular heat-conduction tubes and then goes to the opposite header from which the coolant returns to the engine or other heat source. The headers and the heat-conduction tubes extending between the headers are disposed in the ambient water. Heat is transferred from the coolant, through the walls of the heat conduction tubes and the headers, and into the ambient water. The rectangular tubes connecting the headers are spaced fairly close to each other to create a large heat-flow surface area while maintaining a relatively compact size and shape. Frequently, these keel coolers are disposed in recesses on a bottom of the hull of the marine vessel and sometimes are mounted on the side of the marine vessel, but in all cases below the water level.

The foregoing keel cooler is referred to a one-piece keel cooler, a unitary keel cooler or an integral keel cooler, since it is an integral unit with its major components welded or braised in place. The one-piece keel cooler is generally installed and removed in its entirety.

Even though the foregoing keel coolers with rectangular heat conduction tubes have enjoyed widespread use since their introduction over seventy years ago, they have shortcomings which have been corrected by subsequent developments, and further by the present invention. In commonly assigned U.S. Pat. No. 6,575,227 (Leeson et al., 2003), a marine heat exchanger having a header is disclosed having a beveled end wall for reducing the internal turbulence of the coolant flow to and/or from the parallel tubes of the heat exchanger which increases the ambient fluid flow to the exterior surfaces of the parallel tubes compared to a non-beveled wall. Another commonly assigned patent is U.S. Pat. No. 7,044,194 (Leeson et al., 2006) discloses a marine heat exchanger with a beveled header. A one-piece multiple-pass marine heat exchanger having similar improvements is disclosed in commonly assigned U.S. Pat. No. 7,328,740 (Leeson et al., 2008). In order to reduce the portion of the hull taken up by keel cooler (i.e. to reduce the "footprint"), a pair of unitary beveled keel coolers that are stacked one over the other in a mirror relationship is known. However, it was heretofore unknown to define an ambient water flow path between the stacked keel coolers for enhancing the cooling of the keel coolers.

Stacked keel coolers are known in the art. A keel cooler referred to as a "double-stacked GRIDCOOLER® keel cooler" is sold by R.W. Fernstrum & Company of Menominee, Mich. It is stated that the double-stacked GRIDCOOLER® keel cooler reduces the footprint of the keel cooler while providing greater heat transfer. However, the construction of the GRIDCOOLER® is in a sense self-defeating, since there is no external or ambient water flow possible between the upper keel cooler and the lower keel cooler. Therefore, what Fernstrum provides does not make possible the desired heat transfer from the GRIDCOOLER® as is necessary wherefore an increased size of the GRIDCOOLER® is required which increases the footprint of the stacked GRIDCOOLER®. In addition, the GRIDCOOLER® has stacked blunt ends which are perpendicular to the longitudinal axis of the parallel cooling tubes running between the opposite headers of the GRIDCOOLER®. Thus, the GRIDCOOLER® cannot take advantage of the beveled keel cooler disclosed, for example, in the foregoing U.S. Pat. Nos. 6,575,227, 7,044,194 and 7,328,740.

There are still problems with respect to keel coolers for use with marine vessels having more than one heat source which must have the generated heat removed from the heat source. In some cases, the heat sources generate the same amount of heat, and one way to solve the cooling situation is to have keel coolers for each heat source. This can lead to difficulties for ship builders who find that the footprint taken up by a plurality of keel coolers attached to the hull have collectively large footprints. Thus, ship builders have stated that they are running out of room on the hull.

Another situation that can occur is where there are two or more heat sources of different sizes. One solution would be to have the same size keel cooler for both heat sources, but this would in effect waste space on the hull due to the excess size of the footprint. Another solution would be to have keel coolers of different sizes to accommodate the respective heat sources. For example, there could be a heat sources including the main engines of the ship, auxiliary engines of ship, bow thrusters, air-conditioning systems, hydraulic systems, generators, winch engines and compressors. These could require multiple keel coolers which could, under present technology, require a considerable amount of hull space for the mounting of the keel coolers, to the chagrin of the ship builders and ultimately to the marine shipping companies.

SUMMARY OF THE INVENTION

A general object of the present invention is to provide for a marine vessel a marine heat exchanger having coolant flow tubes located below the ambient water level where the marine vessel is disposed and traveling, for reducing the heat level of the coolant which has absorbed heat from one or more heat sources in the vessel. The marine heat exchanger is described herein usually as a keel cooler, but the invention is not restricted to keel coolers.

Another object of the present invention is to enhance the flow of ambient water across coolant flow tubes in a keel cooler to increase heat transfer from the coolant to the ambient water.

Another object of the present invention is to reduce the laminar boundary layer on the surfaces of keel coolers which serve as an insulating effect by impeding the transfer of heat from the coolant in the keel cooler to the ambient water.

Also, it is an object of the present invention to reduce the stagnation zones in a keel cooler.

It is yet another object of the present invention to divert ambient water flowing past a keel cooler to break up the laminar boundary layer in between the coolant flow tubes to enhance heat transfer, and to improve heat transfer from the coolant flowing through the keel cooler to the ambient water.

It is still a further object of the present invention to provide structure for diverting ambient water from flowing past keel coolers into flowing across and around coolant flow tubes to increase heat transfer.

Another object of the present invention is to provide an improved double-stacked (or multiple-stacked) keel cooler where ambient water flows between the stacked keel coolers to increase heat transfer from the coolant flowing through the keel cooler to the ambient water.

It is yet a further object of the present invention to use stacked keel coolers to effect the flow of water between the keel coolers at a flow rate higher than the speed of the marine vessel to increase heat transfer.

Another object of the present invention is to provide an improved double-stacked keel cooler which causes ambient water to flow as a jet stream between the stacked keel coolers for increasing heat transfer from coolant flowing through the keel coolers.

It is yet another object of the present invention to incorporate spacers located between stacked keel coolers to not only maintain a pre-determined spacing between the keel coolers, but also to enhance turbulent flow of ambient water flowing between and through the respective keel coolers.

Another object of the present invention is to provide a double-stacked keel cooler having beveled forward portions for converging ambient water and to create a stagnation point past which ambient water assumes a jet velocity, and thereby increase heat transfer from the keel coolers to the ambient water.

It is yet still further an object of the present invention to provide spacers for increasing cooling efficiency due to the Von Kármán effect.

A further object of the present invention is to provide a multiple-stacked keel cooler which can be installed on a marine vessel with relative ease.

It is also an object of the present invention to provide a multiple-stacked keel cooler in module form having more than one assemblable component for being assembled on a marine vessel by attaching the components in sequence rather than at the same time.

A further object of the present invention is to provide a multiple-stacked keel cooler in module form wherein different sizes or types of keel coolers and/or keel coolers coming from different manufacturers can be installed in sequence to ease the installation process.

It is also an object of the present invention to provide a multiple-stacked keel cooler for cooling different heat sources on a marine vessel wherein individual keel coolers of the multiple-stacked keel coolers are of different sizes commensurate with variations in the heat source to be cooled.

These and other objects of the present invention shall be clear from the description to follow and from the appended claims.

BRIEF DESCRIPTION OF THE DRAWINGS

Referring to the drawings, wherein reference numbers indicate specific parts referred to in the Description of the Preferred Embodiments.

DESCRIPTION OF THE PREFERRED EMBODIMENTS

Figure 1:
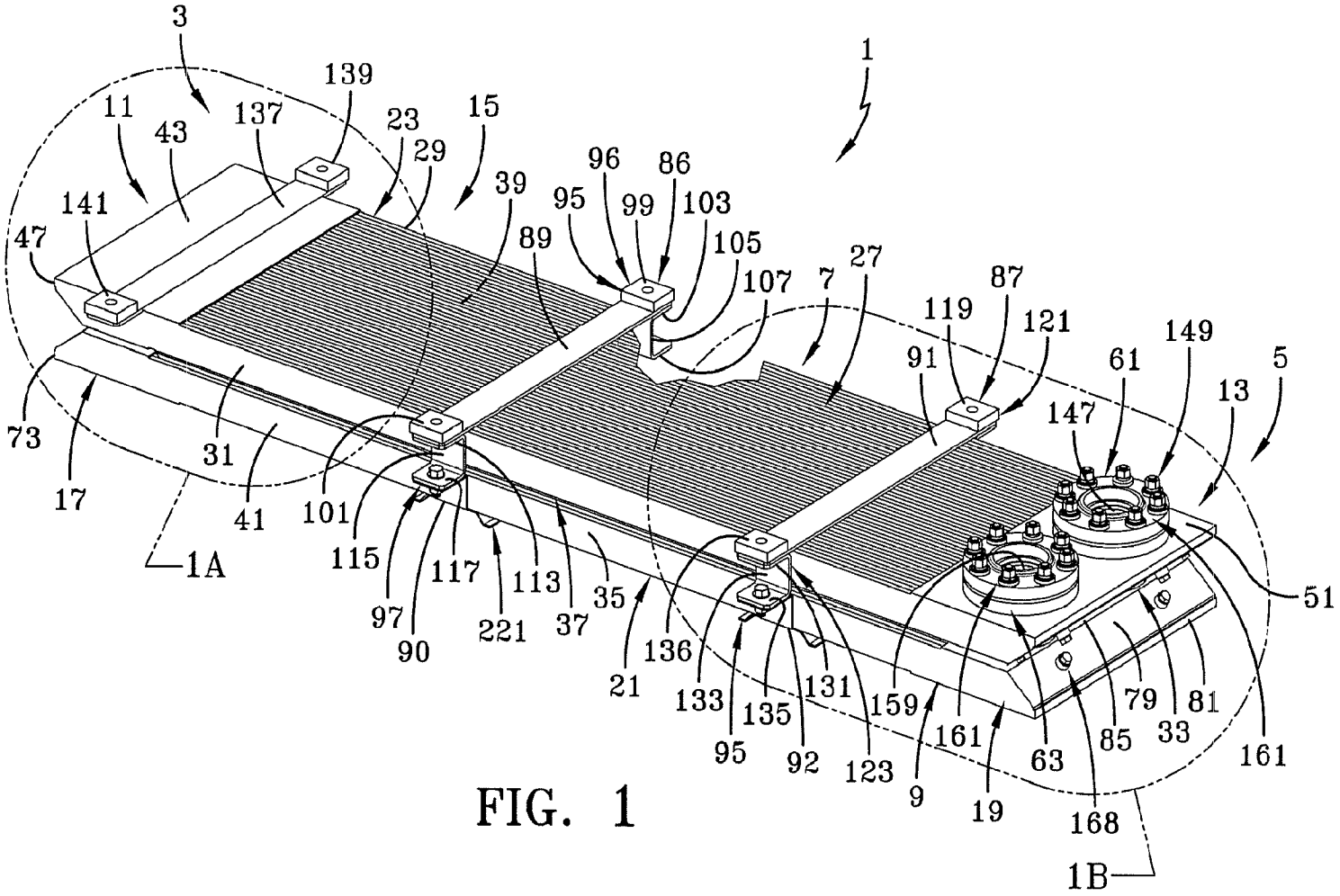
FIG. 1 is a top, rear perspective view of a preferred embodiment of a double-stacked keel cooler incorporating preferred embodiments of the invention.
Figure 1A:
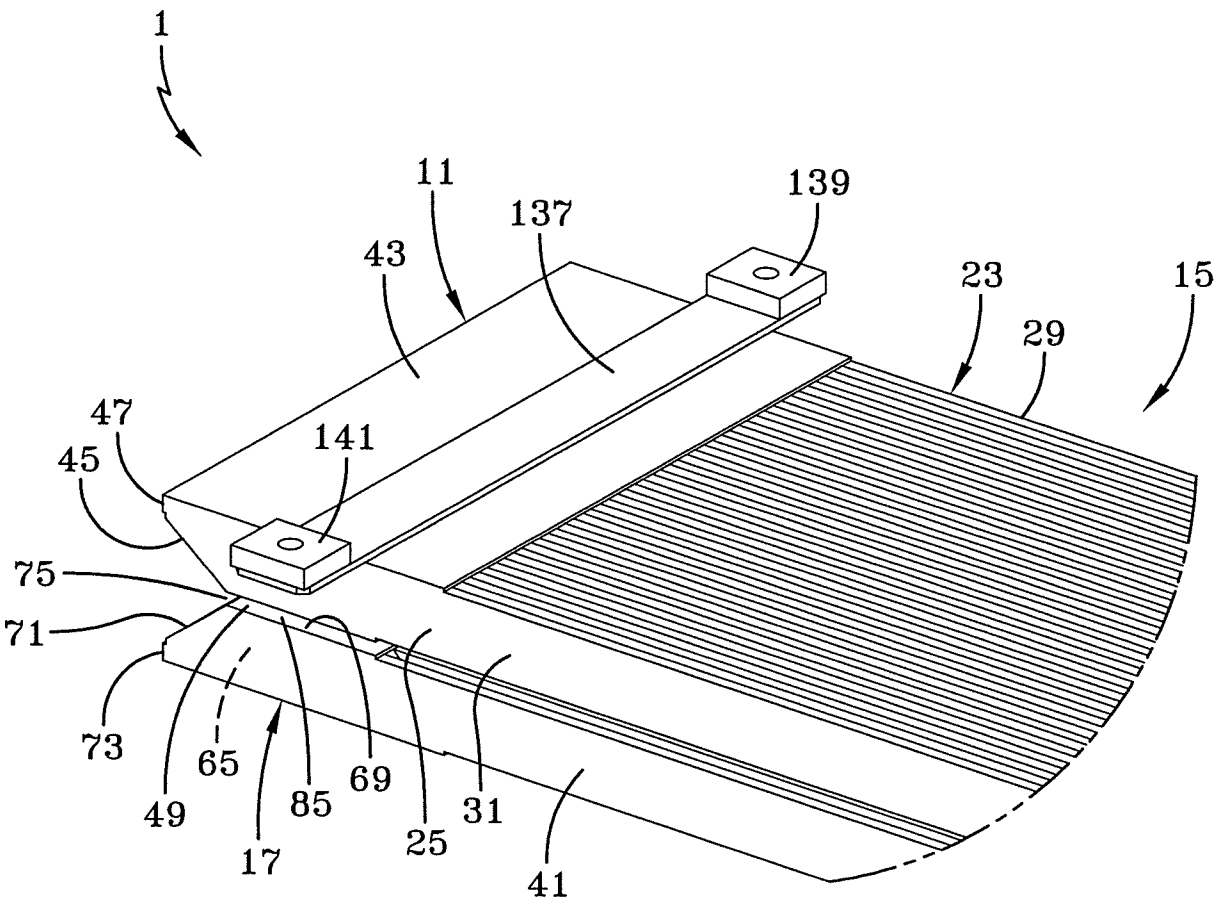
Figure 1B:
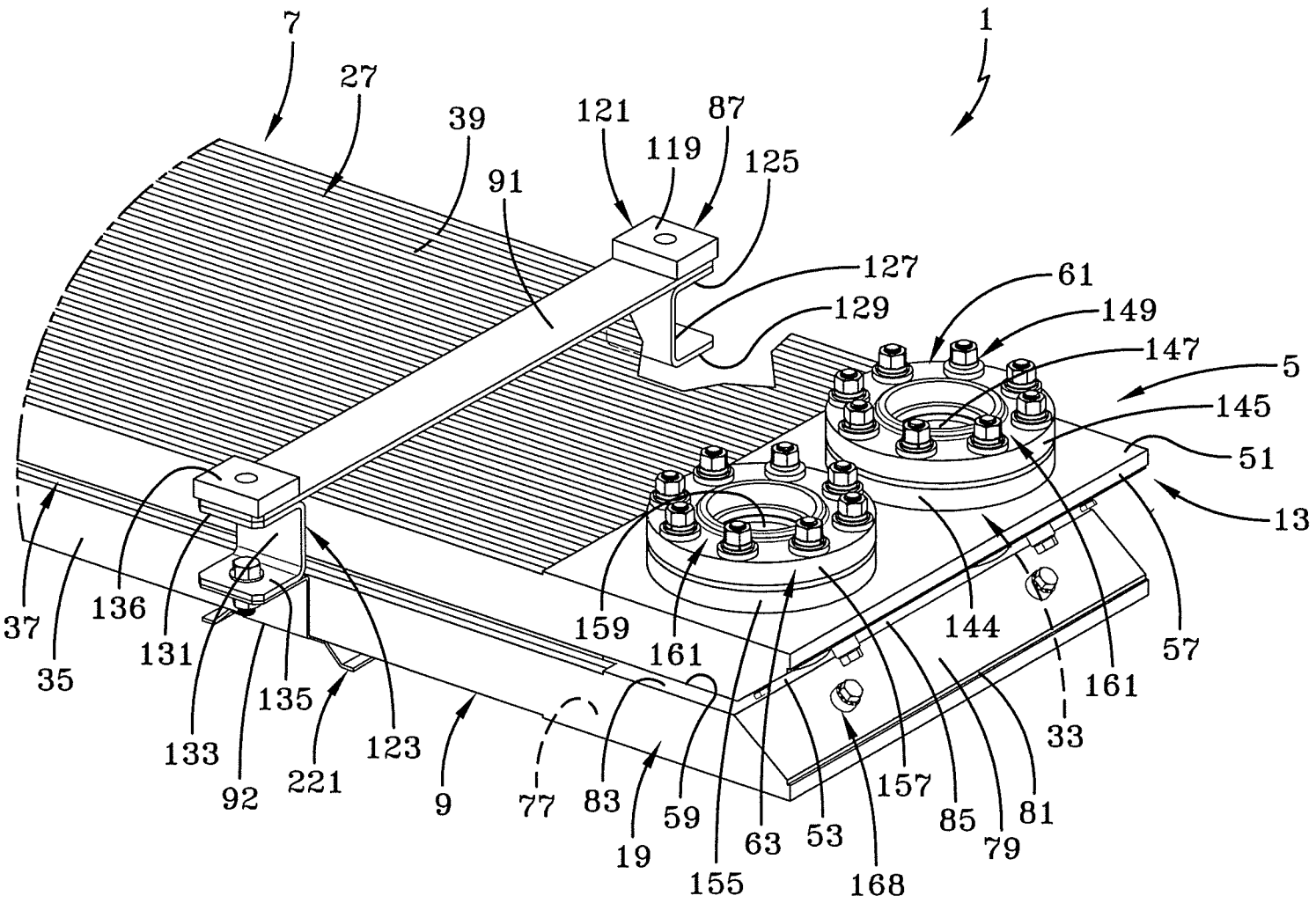

In the description of the preferred embodiments set forth below, like numbers refer to like parts, but the these embodiments are the preferred form of the inventions at the time of filing of this application for letters patent and the full scope of the inventions are defined by the appended claims as understood by those of ordinary skill of those familiar with the art to which the inventions pertain.

Referring first to FIGS. 1, 1A, 1B, 2, 2A, 2B and 3, a marine heat exchanger or keel cooler 1 is shown in top, rear perspective form. Keel cooler 1 has a forward portion 3 and a rearward portion 5. Keel cooler 1 is a multiple-stacked or multi-stacked keel cooler, depicted as a double-stacked keel cooler but which could include more than two stacked keel coolers. Keel cooler 1 may be referred to herein as a double-stacked keel cooler 1 but should be considered as being able to have additional stacked keel coolers. Double-stacked keel cooler 1 has an upper keel cooler 7 and a lower keel cooler 9. Upper keel cooler 7 has an upper, forward header 11 and an upper, rearward header 13, which are connected together by a set of coolant flow tubes 15. Likewise, lower keel cooler 9 has a lower, forward header 17 and a lower, rearward header 19 which are connected by a set of coolant flow tubes 21. Each of headers 11, 13, 17 and 19 are essentially hollow compartments for receiving and discharging coolant fluid. Flow tubes 15 and 21 are hollow tubes which have respective open ends through inclined walls of the respective headers 11, 13, 17 and 19. Headers 11, 13, 17 and 19 receive and discharge coolant liquid from and to the respective coolant flow tubes 15 and 21, and coolant flows through nozzles to be discussed below. Flow tubes 15 and 21 are preferably rectangular in cross-section, having short upper and lower flow tube walls which are collectively in a flat imaginary plane at the respective upper and lower parts of the respective keel coolers 7 and 9, and parallel long respective side walls connecting the respective upper and lower short, upper and lower flow tube walls. Upper keel cooler 7 has upper, outer coolant flow tubes 23 and 25, and inner coolant flow tubes 27. Upper, outer coolant flow tubes 23 and 25 have outer walls 29 and 31, respectively. Lower keel cooler 9 has lower, outer coolant flow tubes 33 and 35, and lower, inner coolant flow tubes 37. Outer coolant flow tubes 23, 25 and 33 form an interface between the ambient, external water when keel cooler 1 is attached to a marine vessel disposed on a body of water. Lower, outer coolant flow tubes 33 and 35 of lower keel cooler 9 have outer walls 39 and 41, respectively. Upper, forward header 11 has an upper, flat, forward header wall 43, an upper, basically beveled, forward header wall 45 having an upper, small, flat, forward header wall 47 perpendicular to upper, flat, forward header wall 43, and an upper, flat, forward header bottom wall 49. (The term "basically beveled" is used due to the upper, small, flat, forward header wall 47, but the term "basically beveled" should be understood to mean "beveled.") Upper, rearward header 13 has an upper, rearward header top wall 51 which is coplanar with upper, flat, forward header wall 43, an upper, basically beveled, rearward header wall 53 having an upper, small, flat, rearward header wall 57 which is perpendicular to upper, rearward header top wall 51, and an upper, flat, rearward bottom header lower wall 59 which is parallel with upper, flat, forward header bottom wall 49. Upper keel cooler 7 has in upper, rearward header top wall 51, an inlet nozzle assembly 61 for admitting hot coolant from a hot heat source in the marine vessel to which double-stacked keel cooler 1 is attached into rearward header 13 and an outlet nozzle assembly 63 for discharging cooled liquid coolant for circulation to the heat source.

Lower keel cooler 9 is constructed similarly to the construction of upper keel cooler 7. Lower, forward header 17 has a lower, flat, forward header bottom wall 65, a lower, flat, forward header top wall 69, a lower, basically beveled, forward header wall 71 with a lower, small, flat, lower, forward header wall 73 perpendicular to lower, basically beveled, forward header wall 71. Upper, small, flat, forward header wall 47 and lower, small, flat, lower, forward header wall 73 are coplanar. Upper, basically beveled, forward header wall 45 and lower, basically beveled, forward header wall 71 are beveled rearwardly, being furthest apart in the forward direction and closest to each other in the rearward direction to converge and form a small, rearward gap 75 between them for reasons discussed below. Lower, rearward header 19 has a lower, flat, rearward header wall 77, a lower, basically beveled, rearward header wall 79 with a lower, small, rearward header wall 81 perpendicular to lower, flat, rearward header wall 77, and a lower, flat, rearward header top wall 83. Upper, basically beveled, rearward header wall 53 and lower, basically beveled, rearward header wall 79 are inclined forwardly, being furthest apart in the rearward direction and closest to each other in the forward direction to terminate at upper, flat, forward header bottom wall 49 and lower, flat, forward header bottom wall 65. Upper, flat, forward header bottom wall 49 and lower, flat, forward header top wall 69 form a small, forward gap 85 for reasons discussed below. The angle of the basically beveled walls has been found to be preferably 45°, but this angle may be changed under various conditions for the present embodiment and others described below.

Figure 2:
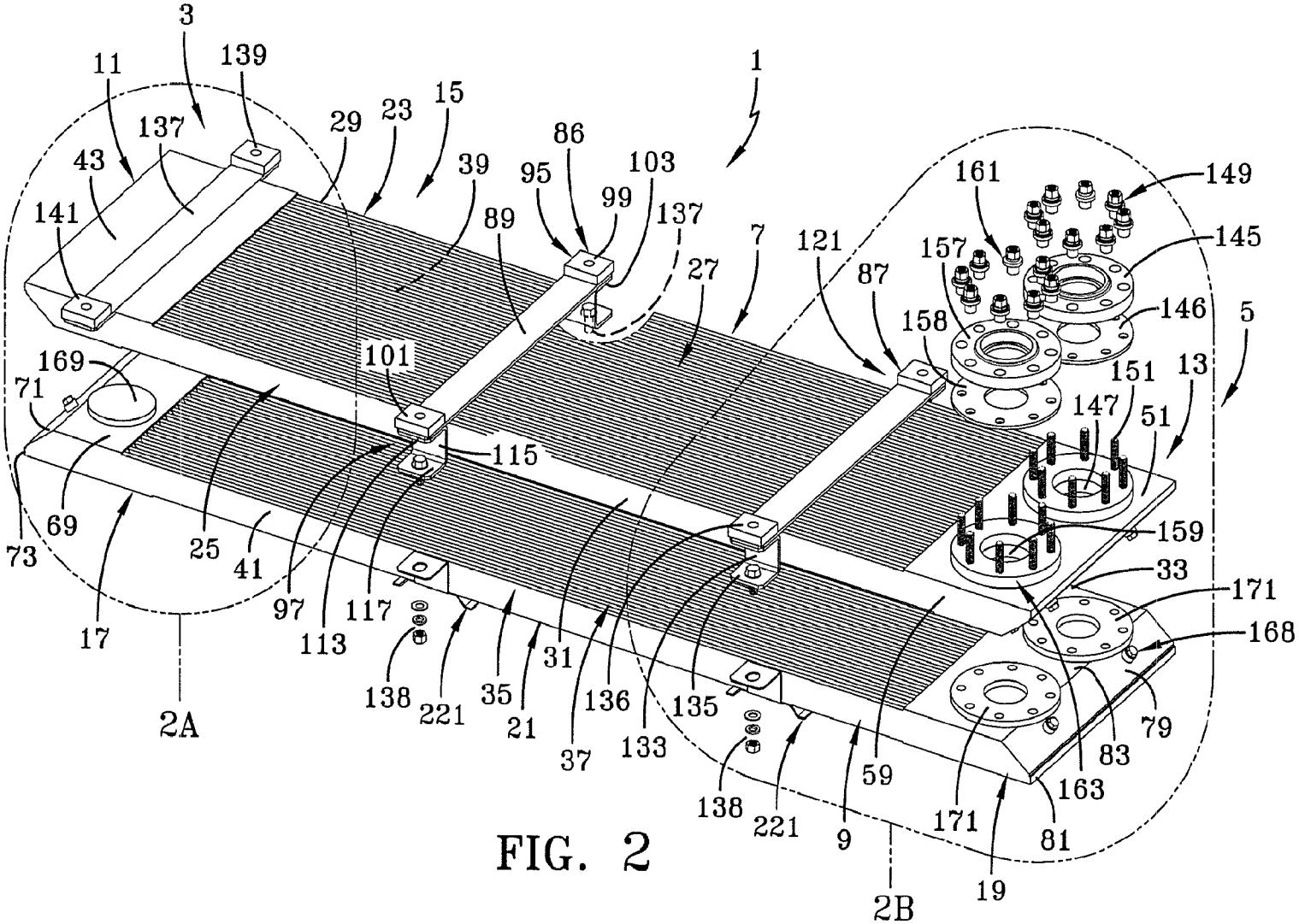
FIG. 2 is an exploded view of the double-stacked keel cooler shown in FIG. 1.

Upper keel cooler 7 and lower keel cooler 9 are connected together by a pair of bracket assemblies 86 and 87. It is important that upper keel cooler 7 and lower keel cooler 9 be separated by a precise amount as explained hereinafter. Each of coolant flow tubes 23, 25, 27, 33, 35 and 37 are rectangular in cross-section, and all being identical in size and shape. Coolant flow tubes 23, 25 and 27 each have flat, parallel, relatively long vertical side walls which have upper and lower ends that are connected by relatively short, flat, top and bottom walls, respectively. The foregoing flat, top walls lie in a common top imaginary plane, and the foregoing bottom walls lie in a common bottom imaginary plane. The latter top and bottom imaginary planes are parallel with each other. Likewise, coolant flow tubes 33, 35 and 37 each have flat, parallel, relatively long vertical side walls which have upper and lower ends (all with reference to the double-stacked keel cooler as shown in FIGS. 1 and 2) that are connected by relatively short top and bottom walls, respectively. The latter flat, top walls lie in a common upper imaginary plane, and the latter flat, bottom walls lie in a common lower imaginary plane. Although the embodiments of the invention discussed herein say that the coolant flow tubes are rectangular in cross section, the invention is not limited by the shape of the coolant flow tubes. The inventive concepts are applicable to other configurations of coolant flow tubes, as well as mixtures of such configuration. Bracket assembly 86 includes a cross piece 89 which extends across and contacts the relatively short top walls of outer coolant flow tubes 23 and 25, and inner coolant flow tubes 27. Similarly, bracket assembly 87 has a cross piece 91 which extends across and also contacts upper surfaces of the relatively short top walls of coolant flow tubes 23, 25 and 27 but located proximal rearward portion 5 of double-stacked keel cooler 1. Disposed on the bottom or underside of double-stacked keel cooler 1 opposite cross piece 89 is a diverter plate 221, and likewise disposed on the bottom or underside of double-stacked keel cooler 1 opposite cross piece 91 is another diverter plate 221. Diverter plates 221 will be discussed below. Interconnecting cross piece 89 are a pair of side C-brackets 96 and 97, respectively. Side C-brackets 96 and 97 each have upper connecting plates 99 and 101, respectively, which rest on the upper surface of the opposite end portions of cross piece 89. Disposed along outer walls 29 and 39 of upper keel cooler 7 and lower keel cooler 9, respectively, is side C-bracket 96 having an upper arm 103, a vertical leg 105 and a lower arm 107. Side C-bracket 96 is identical with side C-bracket 97 disposed on the opposite side of double-stacked keel cooler 1. Side C-bracket 97 has an upper arm 113, a vertical leg 115 and a lower arm 117. Bracket assembly 87 has an upper connecting plate 119 located on an upper end of cross piece 91. Bracket assembly 87 further includes side C-brackets 121 and 123. C-bracket 121 has an upper arm 125, a vertical leg 127 and a lower arm 129. C-bracket 123 is identical with C-bracket 121 (and with side C-brackets 96 and 97) and includes an upper arm 131, a vertical leg 133 and a lower arm 135. A connecting plate 136 is located on upper arm 131. Fastener assemblies 138 extend through aligned holes in respective connecting plates 99, 101, 119 and 136, upper arms 103, 113, 125 and 131, and lower arms 107, 117, 129 and 135. A cross piece 90 underlies cross piece 89 beneath lower keel cooler 9 for attachment to side C-brackets 96 and 97, and a cross piece 92 is located in an opposing relation with cross piece 91 beneath lower keel cooler 9 for attachment to side C-brackets 121 and 123. The foregoing four cross pieces connect upper keel cooler 7 and lower keel cooler 9.

Another cross piece 137 sits on top of upper, flat, forward header wall 43. Upper connecting plates 139 and 141 are located on top of the upper ends of connecting plates 139 and 141 respectively.

Double-stacked keel cooler 1 has nozzles provided for flange mounting. A pipe is welded to a pipe flange as is known in the art. The pipe is extended through the hull and is welded to the hull. Mounting gaskets and plastic isolating washers isolate keel cooler 1 from the hull to minimize galvanic corrosion. This all known in the art. Inlet nozzle 61 is composed of a lower circular ring or flange 144 and an upper circular ring or flange 145 having equally sized central holes which are aligned with an identical hole 147, for providing access to an interior chamber of upper, rearward header 13. Nut assemblies 149 are threaded on upwardly extending bolts 151 (FIG. 2) extending from lower circular ring 144 through an intermediate ring 146 (FIG. 2) surrounding hole 147. Similarly, outlet nozzle 63 is composed of a lower circular ring 155, an upper circular ring or flange 157 having equally sized central holes which are aligned with an identical hole 159 and an intermediate circular ring 158 which have holes equal in size with hole 159 in alignment therewith to provide access to the interior chamber of upper, rearward header 13. Holes 147 and 159 are of the same size. Nut assemblies 161 are threaded on upwardly extending bolts 163 (FIG. 2) extending from lower circular ring 165, through intermediate circular ring 158 and upper circular ring or flange 157 (FIG. 2). Flanges 144 and 145 are attached to the foregoing pipe when keel cooler 1 is installed on a marine vessel.

Figure 2A:
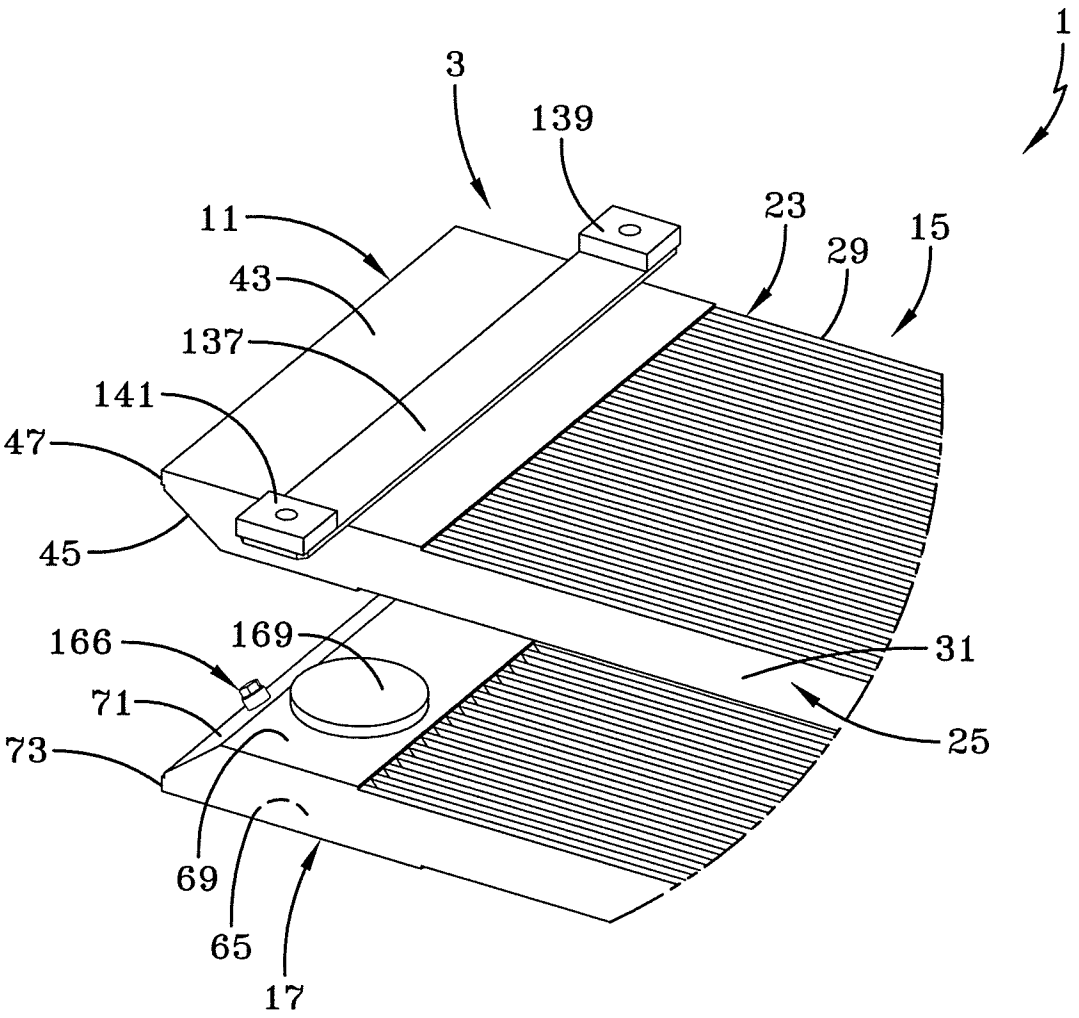
Figure 2B:
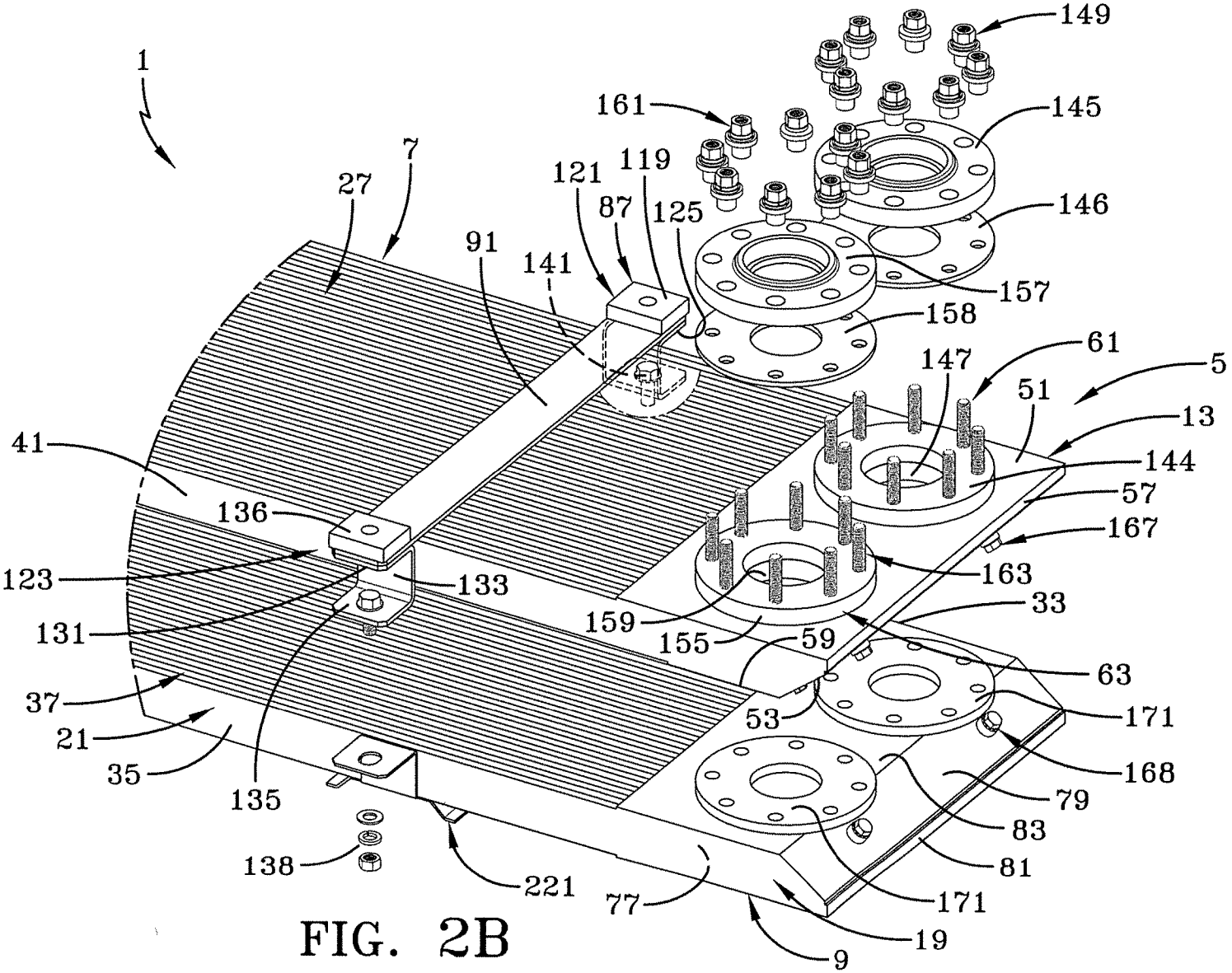
Figure 3:
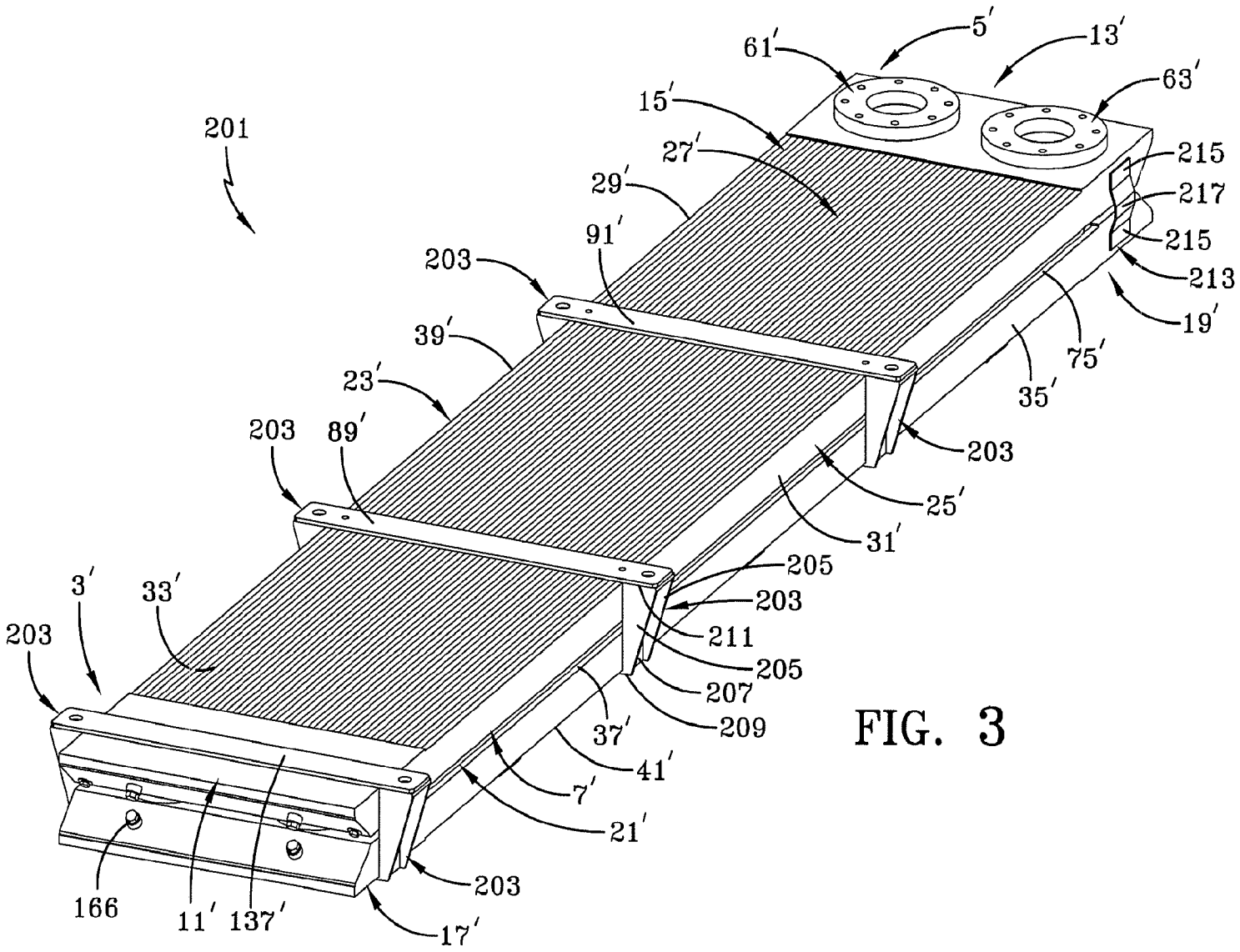
FIG. 3 a front perspective view of the embodiment of the double-stacked keel cooler shown in FIGS. 1 and 2, showing most of the components indicated in FIGS. 1 and 2.
Figure 4:
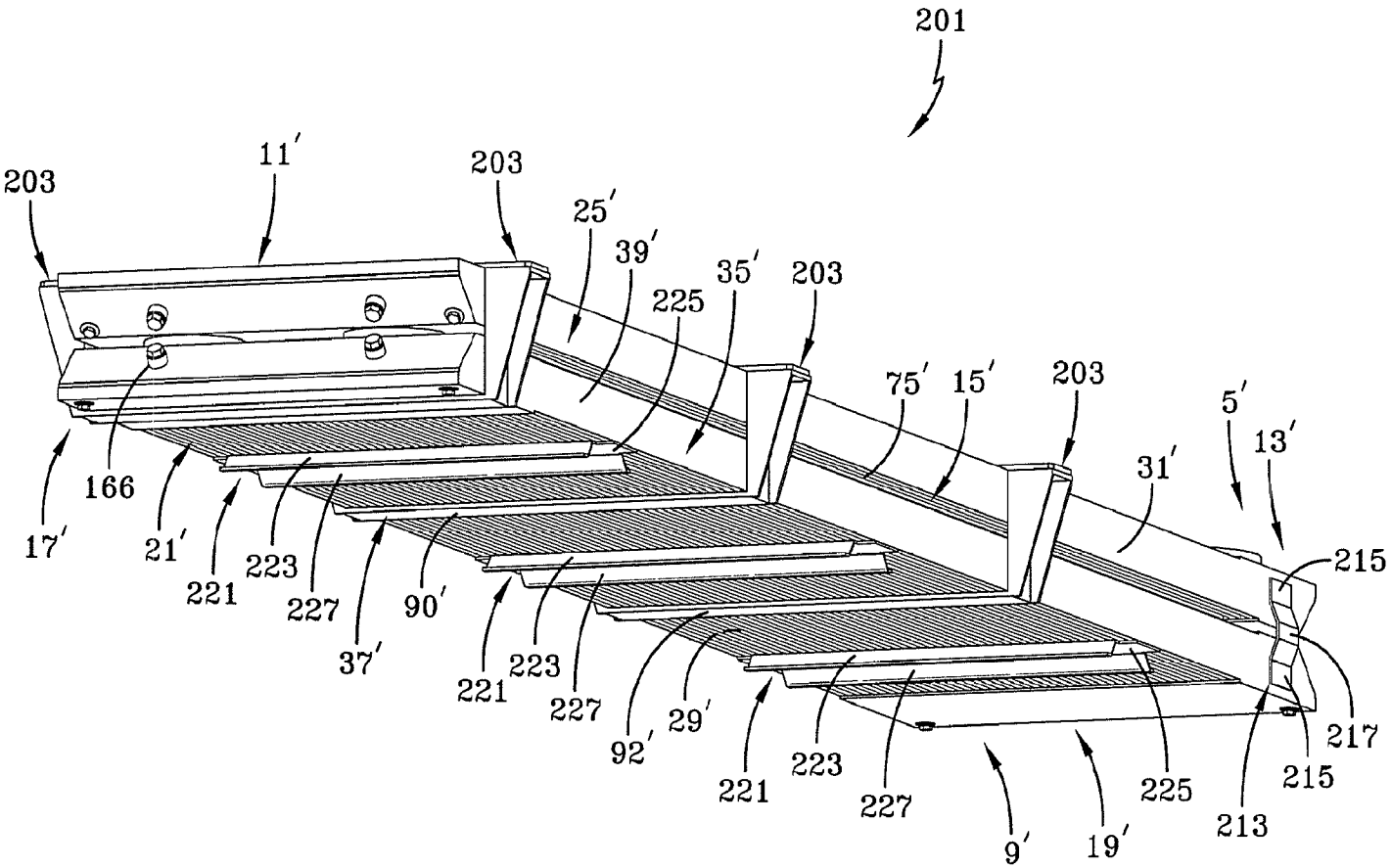
FIG. 4 is a bottom, front perspective view of the embodiment of the double-stacked keel cooler shown in FIGS. 1-3.
Figure 5:
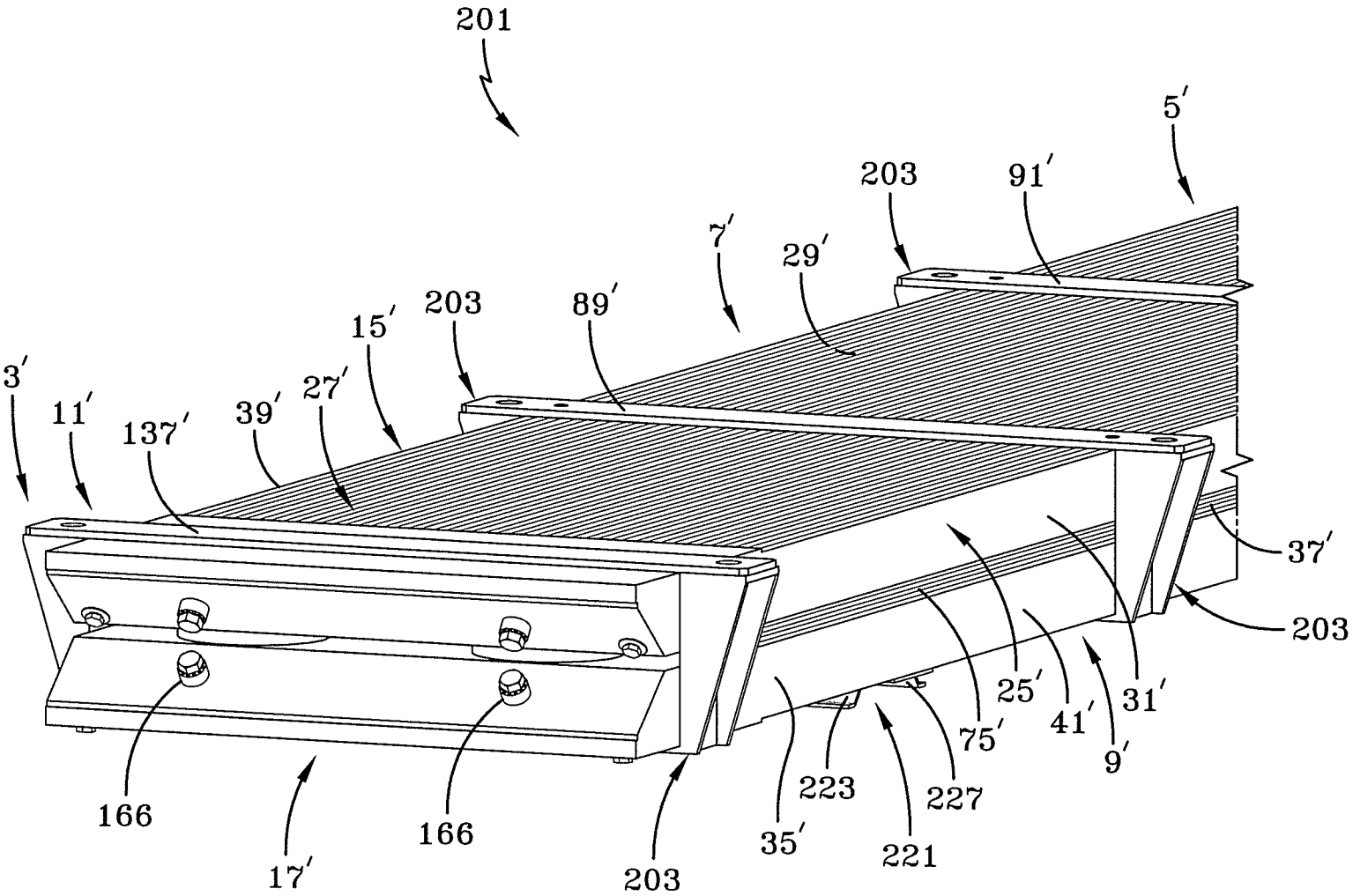
FIG. 5 is an enlarged, partial bottom front view of the embodiment shown in FIGS. 1-4.
Figure 6:
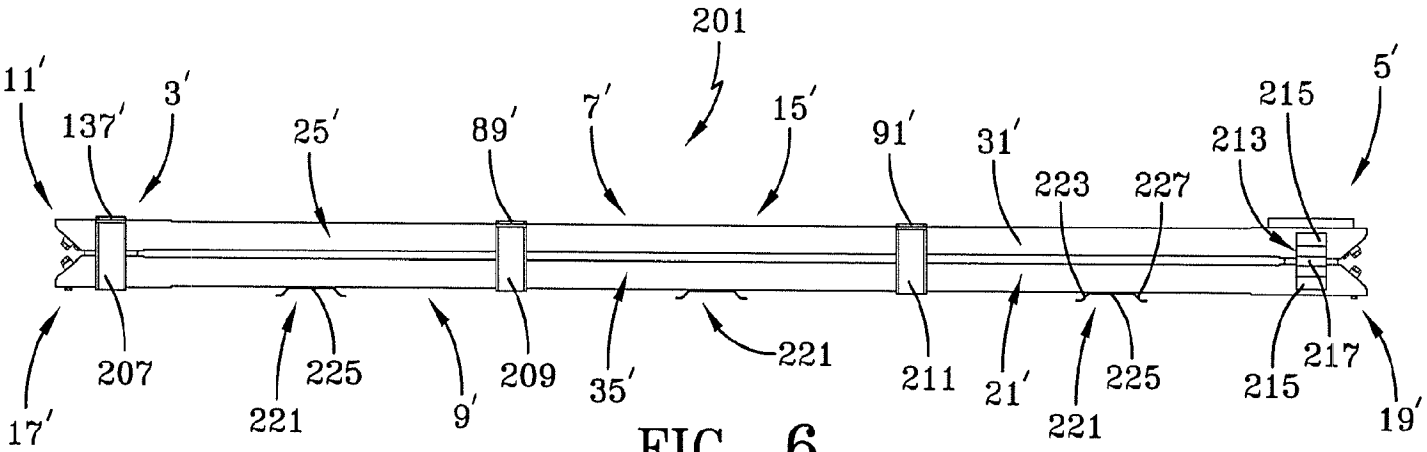
FIG. 6 is a side view of the embodiment of the double-stacked keel cooler shown in FIGS. 1-5.

FIG. 2 is an exploded view of double-stacked keel cooler 1. Lower, forward header 17 has a pair of anodes 166 (FIG. 2A). Lower, rearward header 19 has a pair of anodes 168. Also shown in FIG. 2 are a pair of forward spacers 169 (only one spacer 169 is visible in FIG. 2) fastened between upper, forward header 11 and lower, forward header 17, attached respectively to upper, flat, forward header bottom wall 49 and lower, flat, forward header top wall 69. There is further a pair of lower, rearward circular rings or flanges 171 fastened between upper, rearward header 13 and lower, rearward header 19, fastened respectively to upper, flat, rearward, bottom header lower wall 59 and lower, flat, rearward header top wall 83, for providing coolant access between upper, rearward header 13 and lower, rearward header 19. Further details regarding spacers 169 are discussed below.

A modified version of a multiple-stacked keel cooler from that shown in FIGS. 1 and 2 is depicted in FIGS. 3-6, but where like parts are given the same reference numbers as indicated in FIGS. 1 and 2, but with a prime (') designation. A multiple-stacked keel cooler shown as a double-stacked keel cooler or double-stacked keel cooler 201 has a forward portion 3', a rearward portion 5', an upper keel cooler 7' and a lower keel cooler 9'. Upper keel cooler 7' has an upper, forward header 11' and an upper, rearward header 13' which are connected together by a set of upper coolant flow tubes 15'. Lower keel cooler 9' has a lower, forward header 17' and lower, rearward header 19' which are connected by a set of lower coolant flow tubes 21'. Upper coolant flow tubes 15' include upper, outer coolant flow tubes 23' and 25', and upper, inner coolant flow tubes 27'. Lower keel cooler 9' has lower, outer coolant flow tubes 33' and 35', and lower, inner coolant flow tubes 37'. Upper, outer coolant flow tubes 23' and 25' have outer walls 29' and 31' respectively. Lower, outer flow tubes 33' and 35' respectively have outer walls 39' and 41'. All of coolant flow tubes 15' and 21' are rectangular in cross-section, having relatively long parallel opposing side walls which are connected by horizontal relatively short opposing horizontal walls as are known in present integral keel coolers when the keel cooler 1' is in the position shown in FIGS. 3-6. The headers 11' and 13' all have the same components as indicated in FIGS. 1 and 2. Cross pieces 89', 91' and 137' are all as previously described. The brackets attaching cross pieces 89', 91' and 137' differ from those shown in FIGS. 1 and 2. Bracket assemblies 203 are identical, and each have flat front and rear plates 205 extending perpendicularly from flat plates 207 fastened respectively to outer walls 29', 31', 39' and 41'. Each bracket assembly 203 has a small, lower, edge portion 209 and an opposing parallel large, upper, edge portion 211, the latter being perpendicular to respective outer walls 29', 31', 39' and 41', respectively. Each of bracket assemblies 203 are made from an integral piece with front and rear plates 205 being folded or bent from flat plates 207. Cross pieces 89', 91' and 137' are each attached to larger, upper, edge portions 211 of bracket assemblies 203. Rear brackets 213 connect the rear parts of upper keel cooler 7' and 9' together. Rear brackets 213 (only one is visible) have flat, upper and lower parts 215, and are bent outwardly at bent portion 217 across gap 75'.

Figure 7:
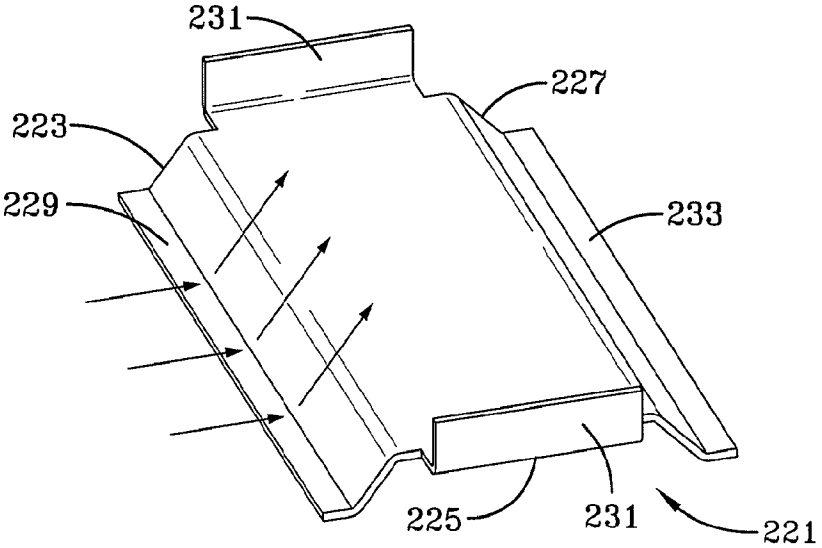
FIG. 7 is a perspective view of a preferred embodiment of a diverter plate according to a preferred embodiment of the invention incorporated in double-stacked the keel cooler shown in FIGS. 1-6, indicating in schematic lines the liquid flow pattern of liquid flowing across the diverter plate.

Inlet nozzle 61' and outlet nozzle 63' are located on upper, rearward header 13'. Bottom cross pieces 90' and 92' that lie flat against bottom respective outer walls of bottom keel cooler coolant flow tubes 33', 35' and 37' are attached to respective bracket assemblies 203. Three diverter plates 221 are attached to the lower walls of lower keel cooler coolant flow tubes 33', 35' and 37'. Each diverter plate 221 has a forwardly, downwardly, forwardly bent portion or diverter 223, a flat, center portion 225 attached to the lower walls of coolant flow tubes 33', 35' and 37' and a downwardly, rearwardly bent portion 227. The details of diverter plates 221 are shown clearly in FIG. 7, where diverter plate 221 is shown in perspective. Diverter plate 221 has downwardly, forwardly bent portion 223, flat, center portion 225 and downwardly, rearwardly bent portion 227. Downwardly, forwardly bent portion 223 has a flat portion 229 which merges into bent portion 223. Flat, center portion 225 has tabs 231 which are folded up by 90° for attachment by brazing the respective coolant flow tubes. Downwardly, rearwardly bent portion 227 has a rearward, flat portion 233. The purpose of the configuration of diverter plate 221 shall be explained hereinafter.

Figure 8:
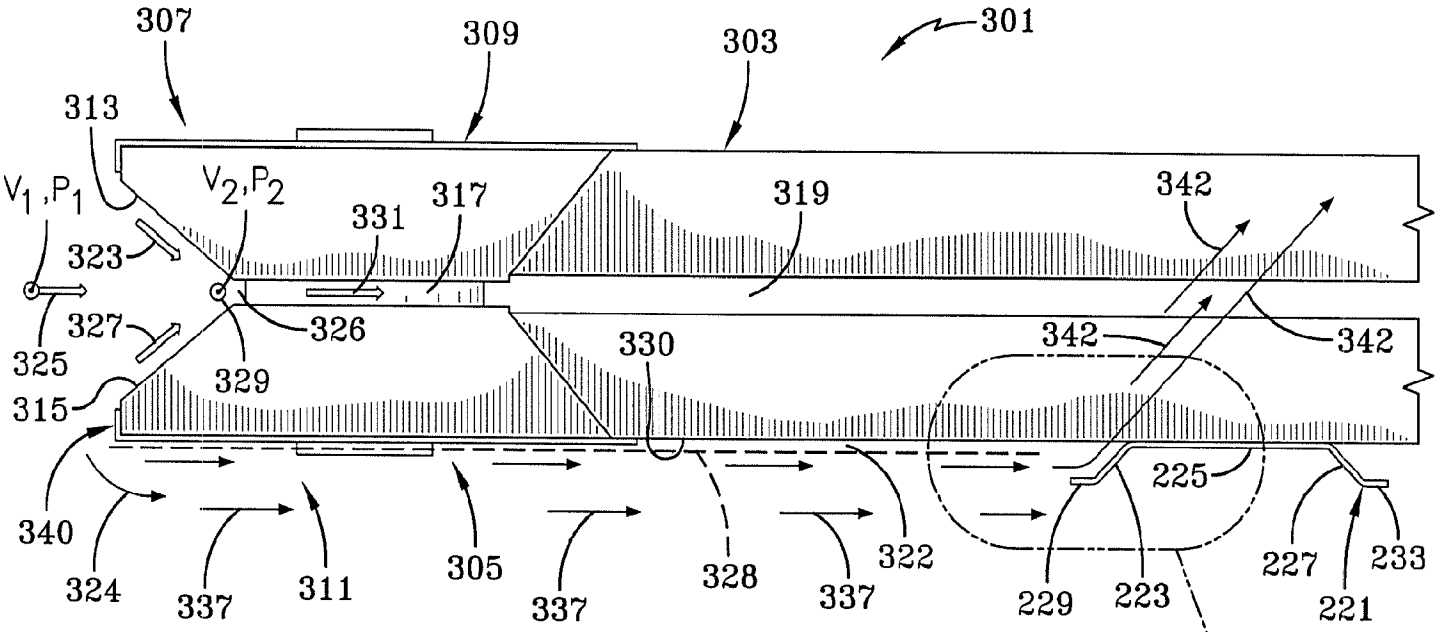
FIG. 8 is a side schematic side view of a preferred embodiment of double-stacked keel cooler according to the invention showing fluid flow lines and the stagnation point at the entrance to the separation area between double-stacked keel coolers and the liquid flow lines of liquid flowing past and being diverted by a diverter also according to a preferred embodiment of the invention, and further showing laminar flow area beneath the lower keel cooler of the double-stacked keel coolers.

FIG. 8 shows in schematic form a double-stacked keel cooler 301. Keel cooler 301 has an upper keel cooler 303 and a lower keel cooler 305. Only a forward end portion 307 is shown. Upper keel cooler 303 has an upper, forward header 309, and lower keel cooler 305 has a lower, forward header 311. Upper keel cooler 303 and lower keel cooler 305 are essentially of equal configuration and symmetrically located in a mirror-like relationship. Upper keel cooler 303 has an upper, basically beveled, forward wall 313 and lower keel cooler 305 has a lower, basically beveled, forward wall 315. Some of the reasons for these bevels is explained in commonly assigned and included herein by reference U.S. Pat. Nos. 6,575,227, 7,044,194 and 7,328,740. There is a gap 317 between upper, forward header 309 and lower, forward header 311, which gap is somewhat wider at gap 319 located rearwardly of gap 317. Beveled walls 313 and 315 have flat equally beveled, symmetrical forward surfaces and are thus convergent beveled walls 313 and 315 which cooperatively converge the flow of ambient water as a marine vessel, the hull of which has keel cooler 301 attached thereto, moves forwardly through the ambient water. The flow of ambient water across and past convergent upper, basically bevelled, forward wall and convergent lower, basically beveled, forward wall 315 is shown by arrows 323, 325 and 327. The foregoing flow can be characterized as a convergent external inlet of ambient water which establishes a stagnation point 329. The existence of stagnation point 329 necessarily increases the stagnation pressure due to fluid inertia. The foregoing can be explained as follows.

As keel cooler 301 travels through ambient water with a marine vessel to which it is attached, a thin laminar insulating layer or region 322 of ambient water is disposed between a laminar boundary 328 and a bottom surface 330 of the respective coolant flow tubes of keel cooler 301. (Bottom surface is actually the bottoms of the respective coolant flow tubes and lower headers (including lower header 311) in lower keel cooler 305, but is considered a bottom surface for the present description.) As the uniform flow of ambient water approaches a leading edge 340 of lower keel cooler 305 to form laminar insulating layer 322, the ambient water immediately adjacent to laminar boundary 328 moves downwardly with respect to lower keel cooler 305 shown by arrow 324 away from the surface of lower, forward header 311. This perturbation causes a stagnation region 335 shown in FIG. 9.

Far upstream from stagnation point 329 of convergent keel cooler 301, the bulk of the ambient water flowing around keel cooler 301 as the marine vessel moves forwardly is at a velocity V1. As the ambient water enters a convergent region 326 between beveled walls 313 and 315, the velocity V2 shown at the reference is relatively quite small, much less than V1. As the velocity decreases, the pressure at V2 increases, and allows for a Bernoulli Effect. Thus, P2 is greater than P1, and ambient water enters gap 317 at jet velocity indicated by the arrow 331. That is, the stagnation pressure at stagnation point 329 allows for a posieuille-driven jet of water to flow between the upper and lower sets of coolant flow tubes. The water immediately downstream of stagnation point 329 will see the increase in velocity of approximately 20%-100% depending on the exterior bulk fluid velocity. The fast moving ambient water flowing through gap 317 and 319 is turbulent flow, and this necessarily increases the heat transfer from coolant flow tubes of upper and lower keel coolers 303 and 305 to increase the cooling effect of keel cooler 301. The foregoing flow of ambient water at jet velocity in the gaps 317 and 319 forms a "cooling core," which increases the heat transfer over what would have been the velocity without the beveled (or converging) surfaces and the resulting cooling core.

Figure 9:
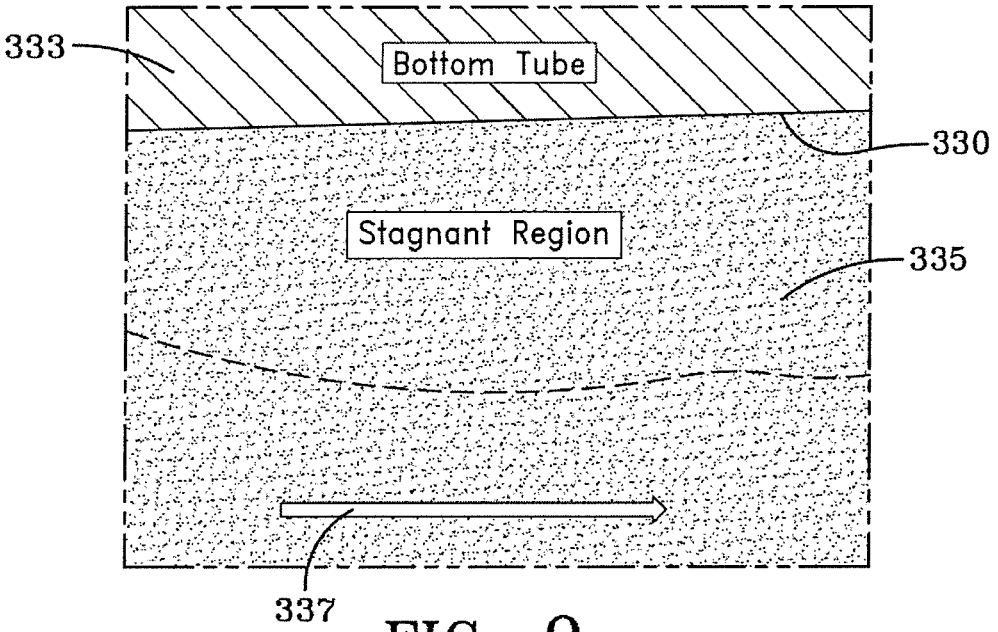
FIG. 9 is a pictorial graph showing liquid layers on a coolant flow tube.

FIG. 9 shows the bottommost part of one of the bottom tubes (corresponding to one of coolant flow tubes 15 and 21 in FIGS. 1 and 2), designated by the reference number 333. A stagnant ambient water region 335 is located beneath coolant flow tubes 15 and 21 as the marine vessel travels through the ambient water. There is virtually no movement of ambient water in stagnant ambient water region 335 and marked as such. The stagnant ambient water region has a stagnant ambient water depth which varies for many reasons. There is only ambient water movement parallel to the flow tubes (in this depicted view, parallel to tube 333) as indicated by the ambient water flow line shown by arrows 337. One of the goals of the present invention is to obtain external temperatures in the vicinity of the coolant flow tubes at a relatively constant level rather than a linearly increasing temperature along the length of coolant flow tubes.

Figure 10:
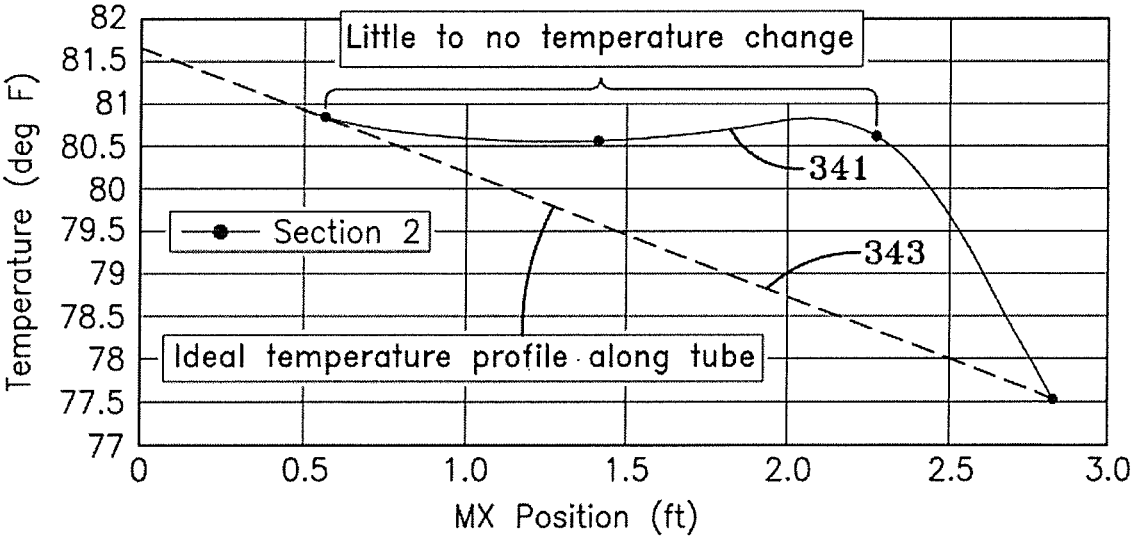
FIG. 10 is graph indicating temperatures from the bottom wall of a coolant flow tube in a double-stacked keel cooler.

Turning next to FIG. 10, a graph is shown indicating the temperatures measured by thermocouples attached to the bottom wall of a lower coolant flow tube in a double-stacked (or multiple-stacked) keel cooler along measured a portion of the length of the tube. The graph in FIG. 10 has a solid, slightly curved line 341 extending from a little beyond 0.5 feet along a bottom tube of a keel cooler 301 from the forward end of keel cooler 301 until between 2.3 inches and 2.4 feet along the foregoing tube where there is little or no temperature change along the tube. Ideally, the temperature should decrease along the length of the tubes as show by the dotted line 343.

In order to increase the heat flow, it is necessary to in effect break up the stagnant region along the surface of the coolant flow tubes and the headers. The inventors have found that by breaking up the stagnant region, heat transfer through the surface of a keel cooler can increase the heat transfer. Referring to lower keel cooler 305 in FIG. 8, diverter 223 and flat portion 229 extend through the stagnant region shown in FIG. 9. The flow of ambient water is indicated by arrows 337 in FIG. 8. Downwardly, forwardly bent portion 223 of diverter plate 221 extends through the stagnant region. Ambient water is diverted to a flow path indicated by arrows 342 to break up the stagnant region and flow across coolant flow tubes incorporated in double-stacked keel cooler 301. This increases the cooling effect of keel cooler 301 over what the cooling effect of coolant flowing through keel cooler 301 without diverter plates 221. The same phenomenon would occur with respect to upper keel cooler 303 and diverter plates 221 extending upwardly through the stagnation region existing near the upper surface of keel cooler 301.

Figure 11:
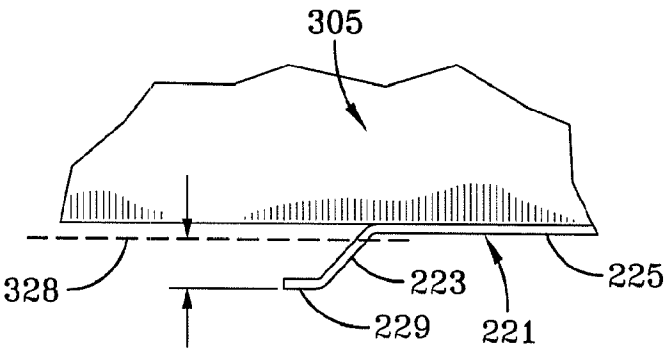
FIG. 11 is similar to FIG. 12, and shows a laminar boundary of an ambient liquid adjacent a coolant flow tube.

An enlargement of the forward part of diverter plate 221 is shown in FIG. 11. This figure shows flat, center portion 225 attached by brazing of folded up tabs 231 and its edges contacting the coolant flow tubes, to bottom surface 330 of lower coolant flow tubes 21 including lower keel cooler 305. Bottom surface 330 is really a combination of the lower surfaces of each of flow tubes (corresponding to flow tubes 21) of lower keel cooler 305. Downwardly, forwardly bent portion 223 can be seen, with flat portion 229 extending forwardly from the bottom portion of bent portion 223. An angle CI shows the angle between flat portion 229 and bent portion 223 as the acute angle between those two portions of diverter plate 221. An angle Φ is the angle between bent portion 222 and a perpendicular to flat, center portion 225 of diverter plate 221, as well as the angle between bent portion 223 and the horizontal plane including bottom surface 330 of lower keel cooler 305.

Figure 12:
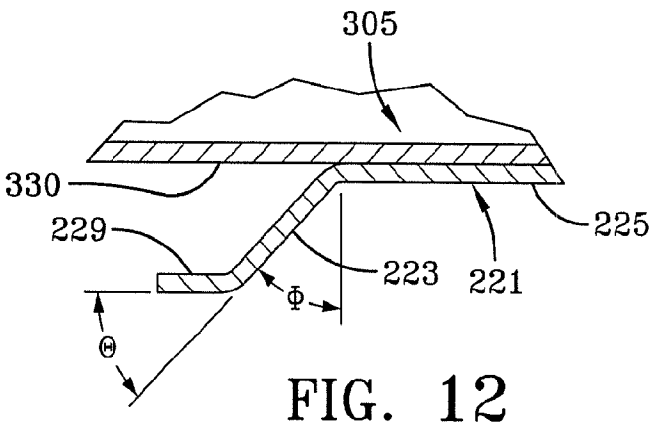
FIG. 12 is an enlargement of part of a diverter plate shown in FIGS. 6-8 showing certain angular relationships of portions of the diverter attached to the bottom of the coolant tubes of a keel cooler forming part of the double-stacked keel coolers according to a preferred embodiment of the invention.

FIG. 12 also indicates how diverter plate 221 operates. Downwardly, forwardly bent portion 223 penetrates the ambient water stagnant region. Ambient water flows along flat portion 229 along bent portion 223 and between the respective coolant flow tubes, as indicated in FIG. 8. This effects the enhanced transfer from the tubes to the diverted ambient water than water occurs without the diverters.

Diverter plate 221 can be mounted on either the upper portion, the lower portion or the sides of keel cooler 301, or any combination thereof. This decision would be made according to the size of the keel cooler, how it is mounted on the marine vessel, and various other factors. In the embodiment of the invention shown in FIGS. 1-6 and 8-12, diverter plates 221 are shown extending from the bottom of lower keel cooler 305. As shown in FIG. 8, flow diverter plate 221 functions and changes the overall vectoral path of the ambient water. As the ambient water flows, the height of diverter plate 221 must be large enough to penetrate the stagnant region and divert the ambient water within the free stream whose flow is shown by the arrow 337. As explained earlier, the ambient water will be directed between the coolant flow tubes to allow the much cooler ambient water to direct the heat away from keel cooler 301 by convection.

An angle Φ, which can be termed the angle of the diverter "scoop," must allow the ambient water to be directed around the coolant flow tubes (when diverter plates 221 are attached to lower keel cooler 305). Angle Φ is the incline of downwardly, forwardly bent portion 223 measured from a vertical to bottom surface 330 and flat, center portion 225 beneath bottom surface 330. It has been found that good results are achieved when Φ=45° The same would apply to whatever mounting takes place between diverter plates and the respective keel coolers. Diverter plates 221 (or any version of the diverters) can be placed on the surface of the coolant flow tubes as described above, or can be fitted in between each of the respective coolant flow tubes or be in a combination of being mounted on the surface and mounted in between the tubes. One of the purposes of the flow diverters is to allow the ambient water having a constant temperature to penetrate the high temperature coolant flow tubes to enhance heat transfer. The diverters can be mounted in series or parallel in any axial location along the keel cooler. It is mentioned above that diverters prevent or significantly reduce stagnant regions from occurring within the keel cooler to allow enhanced heat flow that would occur without the diverters. Furthermore, the diverters allow water to move at a higher flow rate through and next to the adjacent coolant flow tubes than the bulk flow around the keel cooler.

Figure 13:
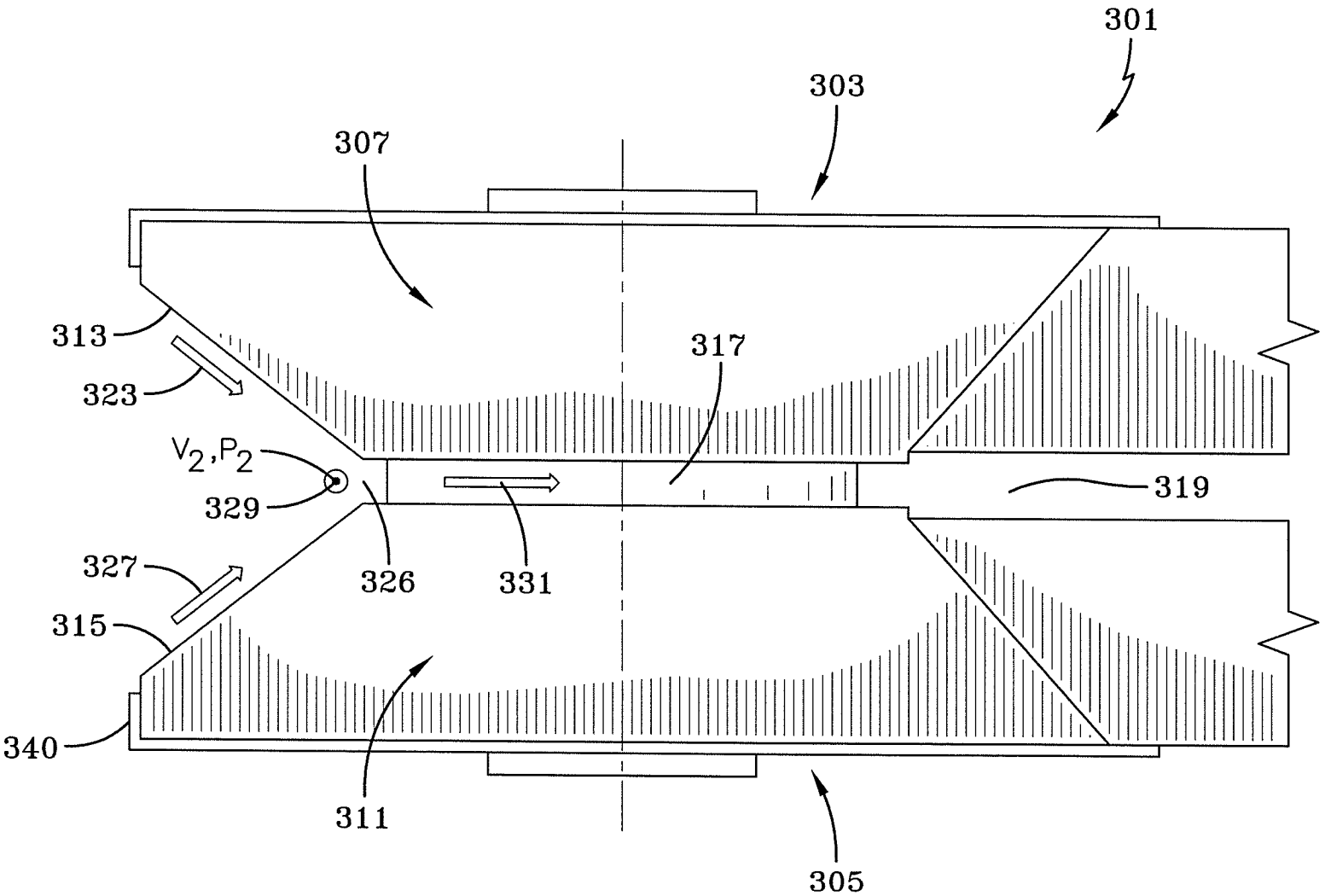
FIG. 13 is a side schematic view of a double-stacked keel cooler incorporating an embodiment of the invention, showing in schematic form ambient water flow lines and a stagnation point of the water flowing through the entrance between the upper and lower keel coolers according to a preferred embodiment of the invention.

An enlarged version of the forward portion of keel cooler 301 is shown in FIG. 13. FIG. 13 shows the forward portion of keel cooler 301 having upper keel cooler 303 and lower keel cooler 305. Upper keel cooler 303 has an upper, basically beveled, forward wall 313 and a lower keel cooler 305 has a lower, basically beveled, forward wall 315. Stagnation point 329 is shown, and in the same location is convergent region 326. As explained earlier, this arrangement allows for a posieuille driven jet of water to flow from convergent region 326 through gaps 317 and 319 and upwardly and downwardly between the respective coolant flow tubes of upper keel cooler 303 and lower keel cooler 305 to increase the heat transfer that would occur without the convergent surfaces due to the jet stream of water.

Figure 14A:
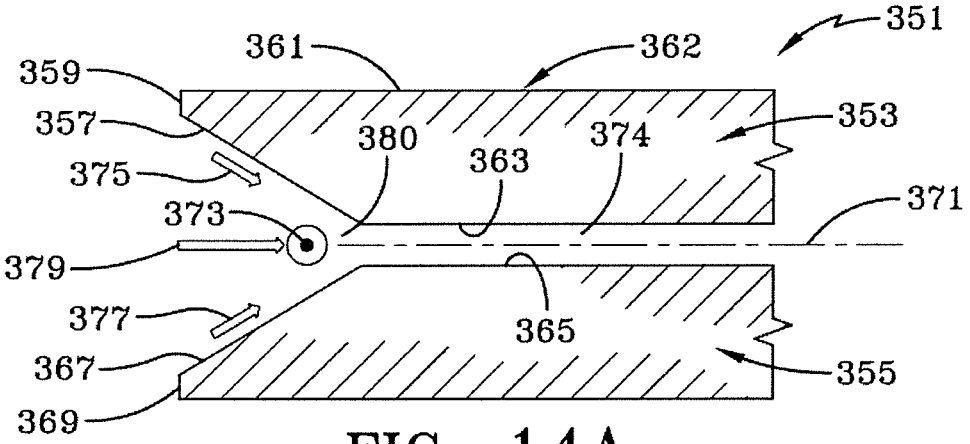
FIGS. 14A-14C alternative embodiments of the entrance between upper and lower keel coolers of double-stacked keel coolers according to other preferred embodiments of the invention.
Figure 14B:
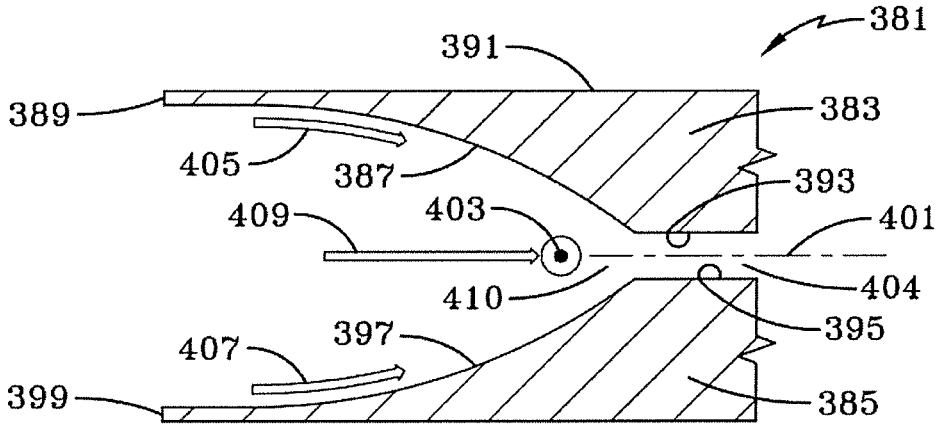
Figure 14C:
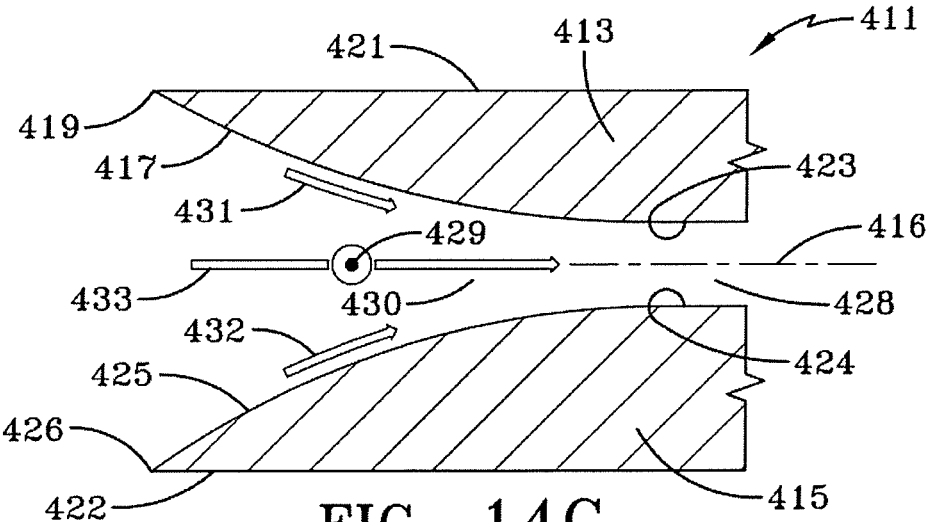

FIGS. 14A-14C show different types of convergent header profiles for a pair of stacked keel coolers similar to the embodiment shown in FIG. 13. Thus, FIG. 14A shows a keel cooler 351 having an upper keel cooler 353 and a lower keel cooler 355. Only the forward part of keel cooler 351 is shown in FIG. 14A. Upper keel cooler 353 and lower keel cooler 355 are mounted in a mirror relationship. Upper keel cooler 353 has an upper, forward, beveled wall 357 which commences at the lower portion of an upper, forwardmost, flat portion 359 which is perpendicular to a flat, top wall 361 of an upper header 362 and extends to the forwardmost part of an upper, forward, bottom surface 363 of upper header 362. Upper keel cooler 353 and lower keel cooler 355 are composed of coolant flow tubes of preferably rectangular cross-section. Lowermost flat walls of the coolant flow tubes including upper keel cooler 353 are broadly identified as upper, bottom, keel cooler surface 364, and a corresponding upper surfaces of the coolant flow tubes of lower keel cooler 355 as a lower, top, keel cooler surface 365. Upper keel cooler 353 and lower keel cooler 355 are mounted in a mirror relationship, and are centrally located on opposite sides of an imaginary central plane 371. Lower keel cooler 355 has a lower, forward, beveled wall 367 which defines a convergent water flow path with upper, forward, beveled wall 357. A stagnation point 373, as discussed above, is also shown in FIG. 14A. Ambient water flows along beveled walls 357 and 367 as indicated by arrows 375 and 377. Ambient water also flows through stagnation point 373 as indicated by arrow 379. The ambient water accelerates to jet velocity for the reasons explained earlier at convergent region 380. Ambient water flows along liquid flow path 374.

Referring next to FIG. 14B, a keel cooler 381 having an upper keel cooler 383 and a lower keel cooler 385, mounted symmetrically in a mirror relationship about an imaginary central plane 401. Upper keel cooler 383 and lower keel cooler 385 have converging, opposing, concave-like beveled walls 387 and 397. Upper keel cooler 383 has an upper, flat surface 391, and at the forward end thereof is a perpendicular upper, forwardmost, flat portion 389. Coplanar with portion 389 is a lower, forwardmost, flat portion 399 of lower keel cooler 385. Upper keel cooler 383 has an upper keel cooler bottom 393 which are the bottom of the respective coolant flow tubes of upper keel cooler 383. Lower keel cooler 385 has a lower, upper keel cooler top 395 which is symmetrically located with respect to upper keel cooler bottom 393, lower, upper keel cooler top 395 is basically the top portion of the coolant flow tubes in lower keel cooler 385 which are rectangular in cross-section having short upper and lower, flat walls and long opposing flat side walls.

Keel cooler 381 has a stagnation point 403, and a convergent region 410 where ambient water achieves a jet velocity as it flows along a coolant flow path 404 between upper keel cooler 383 and lower keel cooler 385. Ambient water flows along beveled walls 387 and 397 as indicated by arrows 405 and 407, and a further along ambient flow path shown by generally arrow 409 and upwardly and downwardly between the respective coolant flow tubes.

Another convergent type keel cooler 411 is shown in FIG. 14C. Keel cooler 411 has an upper keel cooler 413 and a lower keel cooler 415 which are symmetrically located about an imaginary central plane 416. Upper keel cooler 413 has an upper, converging, convex-like beveled wall 417 which extends from an upper, forwardmost tip 419 to smoothly join an upper keel cooler bottom 423 without any corners.

Lower keel cooler 415 has a lower, converging, convex-like beveled wall 425 which is symmetrical with upper, converging, convex-like beveled wall 417, and extends from a lower, forwardmost tip 426 and merges smoothly into a lower keel cooler top 424 to jointly form a fluid flow path 428. Keel cooler 411 has a stagnation point 429 a nd a convergent region 430 where ambient water flowing in the direction indicated by arrows 433, 431 and 432 to obtain jet velocity and the ultimate heat transfer enhancements which occur as a result.

Upper keel cooler 413 has a upper, flat surface 421 (made of an upper forward header and the tops of the component coolant flow tubes) which terminates upper, forwardmost tip 419 from which upper, converging, convex-like beveled wall 417 commences towards a fluid flow path 428. Lower keel cooler has a lower, flat surface 422 (made at a lower, forward header and the bottom of the component coolant flow tubes).

Figure 15A:
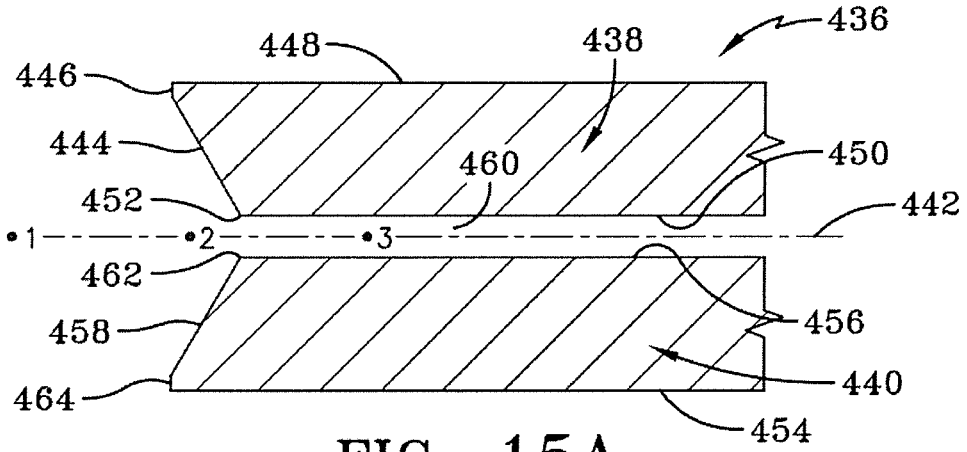
FIGS. 15A-15C show in schematic form several liquid flow entrances to double-stacked keel coolers according to the invention with variations from those double-stacked keel coolers shown in FIGS. 14A, 14B and 14C.

Another double-stacked design is shown in FIG. 15A, which is similar to FIG. 14A. In this figure, a double-stacked keel cooler 436 is shown having an upper keel cooler 438, a lower keel cooler 440 which arranged symmetrically about an imaginary central plane 442. Upper keel cooler 438 has an upper, forward, beveled wall 444 beveled rearwardly from an upper, forwardmost portion 446 and the forward end of an upper, flat surface 448 (actually an imaginary upper surface defined by the upper walls of coolant flow tubes having rectangular cross-sections with relatively flat, short, upper and lower horizontal walls extending between opposing, flat, long opposing vertical side walls) to the forward end of an upper, bottom surface 450 (the description applies as was given for upper, flat surface 448) to an upper, forward end 452. Lower keel cooler 440 has corresponding lower, flat surface 454, lower, upper, flat surface 456, lower, beveled wall 458 which converges with upper, forward, beveled wall 444 to form between them an ambient flow path 460. Lower, beveled wall 458 extends between a lower, forward end 462 and a lower tip 464. Beveled walls 444 and 458 make an angle with respect to beveled walls 444 and 458.

Figure 15B:
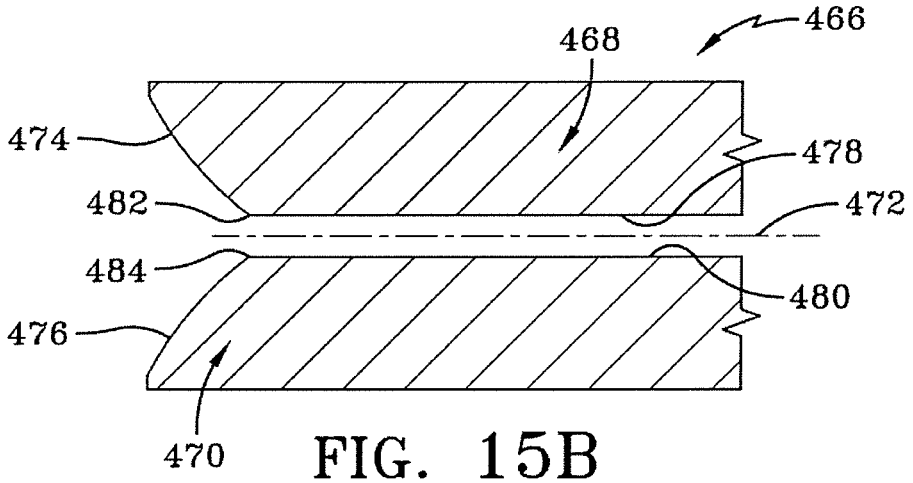

Referring to FIG. 15B, which is similar to FIG. 14C, a double-stacked keel cooler 466 is shown having an upper keel cooler 468 and a lower keel cooler 470 that are symmetrically located about an imaginary central plane 472. Reference is made to the description of FIG. 14C, except that the respective upper and lower, convex, beveled converging walls 474 and 476, respectively, meet respective upper and lower bottom surfaces 478 and 480 at respective corners 482 and 484.

Figure 15C:
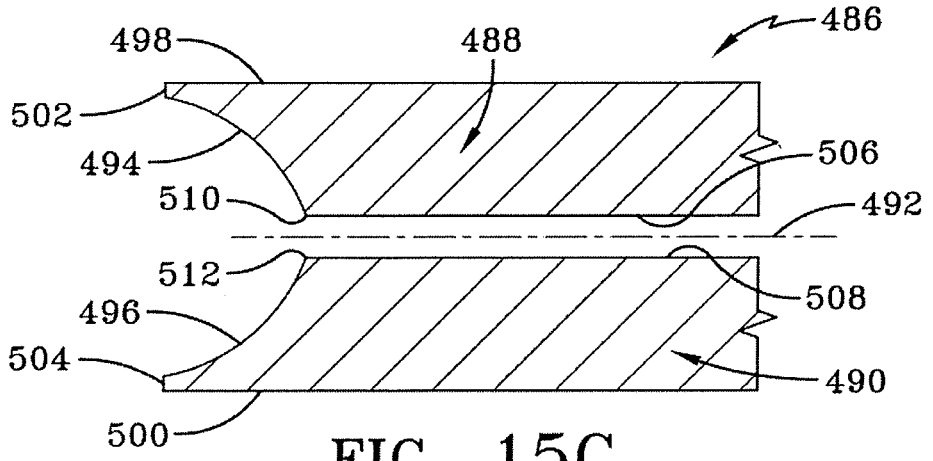

Another double-stacked keel cooler 486 is shown in FIG. 15C. This embodiment is similar to that shown in FIG. 14B. An upper keel cooler 488 and a lower keel cooler 490 are identical and symmetrically located about an imaginary central plane 492. Reference is made to the description set forth above with respect to FIG. 14B. However, respective upper and lower, concave, beveled walls 494 and 496 are joined to upper and lower keel cooler surfaces 498 and 500, respectively, at respective upper and lower approximate tips 502 and 504. An upper, bottom surface 506 and a lower, top surface 508 (in each case referring to the respective bottom and top surfaces of coolant flow tubes in respective upper and lower keel coolers 488 and 490) terminate at their respective forward ends at respective upper and lower end corners 510 and 512 respectively.

Another aspect of the present inventive concepts relates to cross flow surface enhancements for the development of turbulent flow on a keel cooler or marine heat exchanger. More particularly, another aspect of the present invention relates to the provision of spacers for separating stacked marine keel coolers for altering the flow of ambient water to enhance the heat transfer from the coolant flow tubes to the ambient water beyond those limits that would be possible with presently known double-stacked keel coolers which are presently separated without any means for enabling the provision of creating turbulent flow of ambient water.

Since multiple-stacked marine heat exchangers or keel coolers must be spaced apart, it has been found with the present invention that appropriate s pacing and proper designing spacers for accomplishing the purpose of spacing the keel coolers apart can also be used to enhance turbulent flow and therefore heat transfer from the coolant flow tubes to the ambient water. The term Kármán vortex shedding or Kármán vortex street is a useful phenomenon, and these terms relate to a repeating pattern of swirling vortices caused by the unsteady separation of the flow of a fluid such as water. The foregoing terms determine the periodic detachment of pairs of alternate vortices from a bluff-body immersed in fluid flow which generates an oscillating wake behind the vortex street. This causes fluctuating forces which are experienced by the spacer. Kármánvortex shedding has been well documented for three-dimensional bodies and for non-uniform flow fields. As a result of Kármán vortex shedding, energy subtracted from the flow field of water or other fluid by the body drag is not dissipated directly into an irregular motion in the wake, but is initially transferred to a regular vortex motion.

A Kármán vortex street only forms at certain range of flow velocities which are specified as a range of Reynolds numbers (Re). These are typically above a limiting Re value of around 90. The Reynolds number is a measure of the ratio of inertial to viscous forces in the flow of a liquid.

The Reynolds number can be defined as follows:

$$Re = \frac{Vd}{v}$$

where:

V=the steady velocity of the water flow upstream of the spacer, where the spacer is a cylinder d=the diameter of the spacer (where the spacer is a cylinder), which is a measure of the width of the spacer ν=the kinematic viscosity of water This can also be recited as:

$$v = \frac{\rho}{\mu}$$

where:

ν=the kinematic viscosity of water

ρ=the density of water

μ=the dynamic viscosity of water

Another way to describe this mathematically is as follows:

$$Re = \frac{\rho\infty V\infty d}{\mu\infty}$$

where:

$\rho_\infty$=the free main water density $v_\infty$=the steady free stream velocity of the flow upstream of the body (which is presumed to be a cylinder)

d=the diameter of the cylinder (or some other suitable measure of the width of a non-circular spacer) about which the water is flowing $\mu_\infty$=the free stream dynamic viscosity of the water The vortices on either side of the spacer have opposite intensities (directions of rotation). These intensities are arranged in a particular geometric pattern. The vortices do not mix with the outer flow and are dissipated by viscosity long after their creation.

Figure 16:
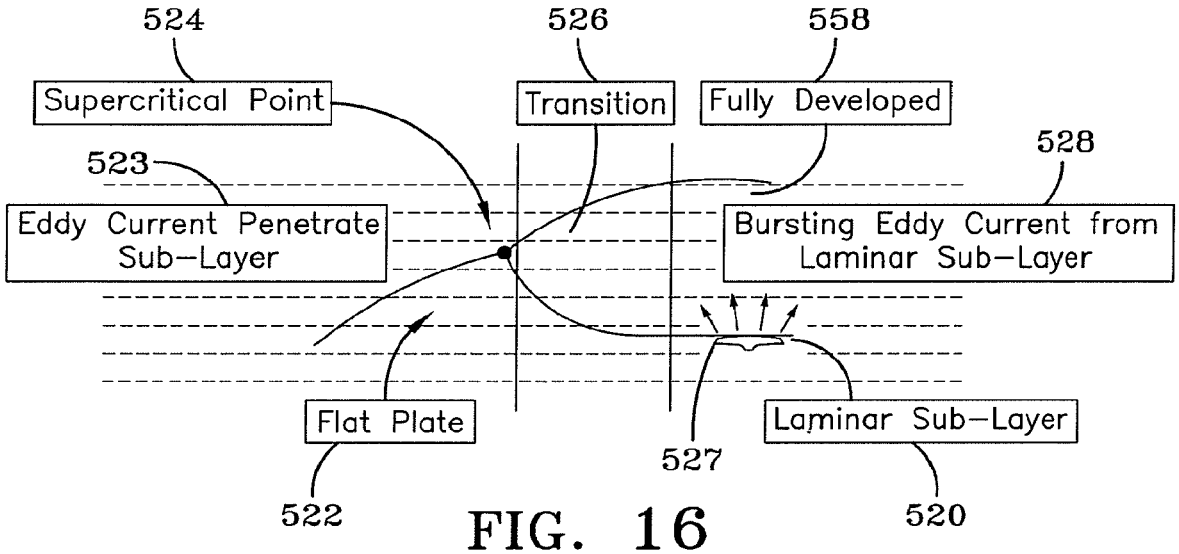
FIG. 16 shows in schematic form boundary layer development over a flat plate.

The physics related to the phenomenon of turbulence to increase heat transfer resides on how the fluid (i.e. liquid) behaves when in the turbulent regime. FIG. 16 shows the typical formation of the laminar and turbulent boundary layer over a flat plate. A flat plate 522 is shown. A laminar sublayer 520 is disposed on a flat plate 522. An eddy current 523 penetrates the sublayer at a super critical point 524. A transition 526 appears at super critical point 524 and fully-developed turbulence 527 appears as shown. A bursting eddy current 528 occurs at laminar sublayer 520.

Figure 17:
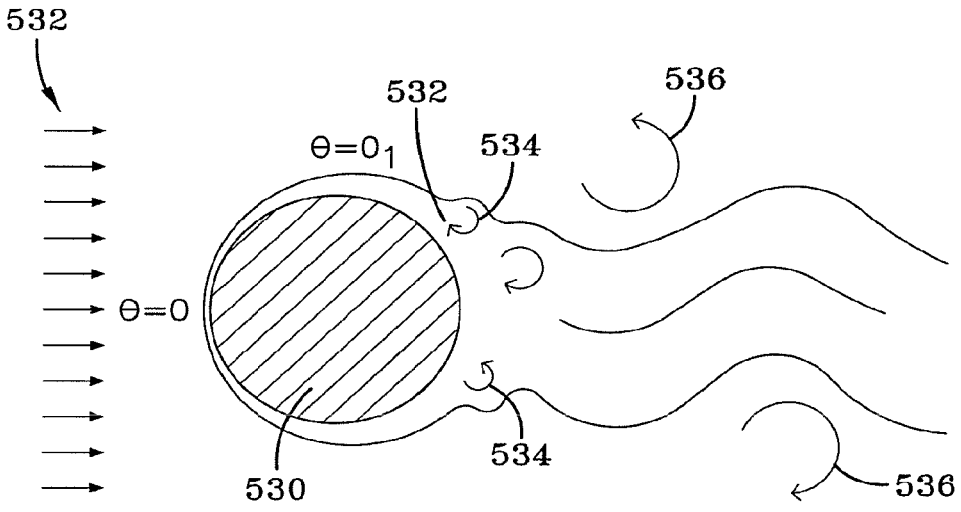
FIG. 17 shows in schematic form a spacer in the form of a cylinder in cross-section with surrounding stream lines and flow profiles of water flowing thereby.

FIG. 17 further explains the physics of turbulence caused by spacers. A spacer 530 is shown as being a cylinder. The upstream flow of water is shown by arrows 532 shown as having a free stream dynamic viscosity goo and a temperature $T_\infty$. The bulk fluid approaches spacer 530 as a circular geometry at a velocity $v_{inf}$. One could assume a single particle of water along a streamline from θ=0 to $\theta=0_1$. If the Reynold's number is sufficiently high at θ=0, the water flow would begin to separate from the surface of spacer, as indicated by the turbulent arrows 534 where the foregoing separation occurs indicated by the downstream wake. The flow profile over cylindrical spacer 530 at the high Reynold's number enables the formation of eddies approaching the size of cylindrical spacer 530 to "shed" periodically as indicated by eddies 536 with a frequency proportional to the flow velocity.

$$f_v \sim 0.21\frac{\mu\infty}{D}$$

where:

$f_v$=frequency of vortical shed ($S^{-1}$)

$\mu\infty$=free stream velocity

S=second

Downstream a buckling wake or "meandering" 536 occurs downstream of spacer 530. These occur at sufficiently high Reynolds numbers, and are governed by a number of factors, the most important of which is proportionality between the buckling wavelength and the transversal length scale of the stream. The large scale structure of turbulent streams can be regarded as the fingerprint of buckling.

Figure 18A:
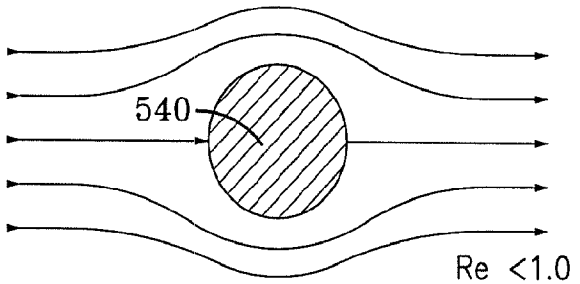
FIGS. 18A-18E are stream line profiles for flow of water around a spacer having a cylindrical configuration for various Reynold's numbers.
Figure 18B:
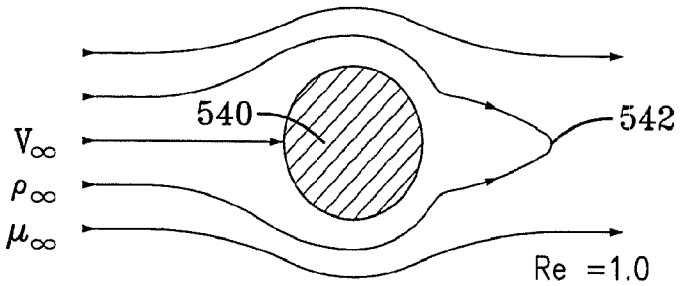
Figure 18C:
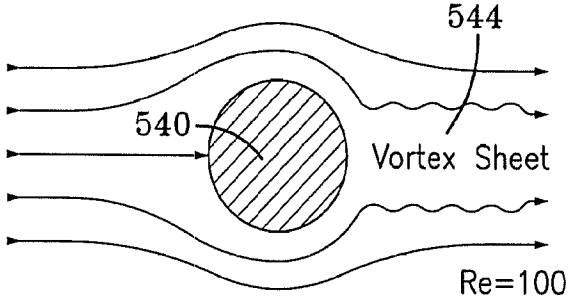
Figure 18D:
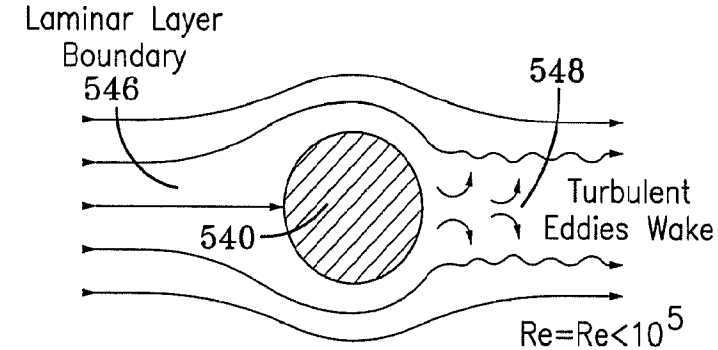
Figure 18E:
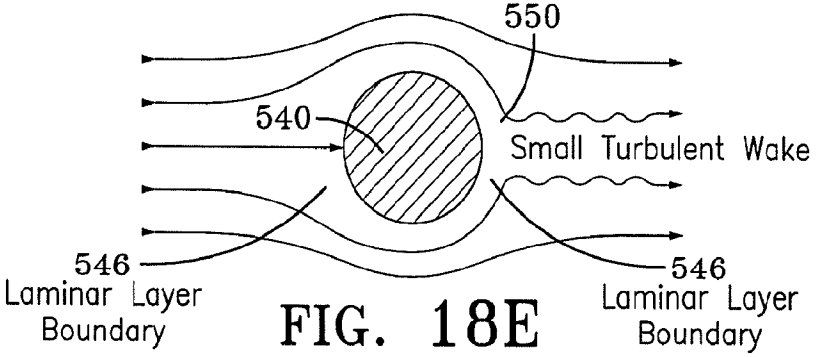

Referring next to FIGS. 18A-18E, FIG. 18A shows laminar flow of a liquid, in this case water, where the Reynold's number is less than 1.0. A cylindrical spacer 540, is shown in each of the latter figures. The laminar region, shown in FIG. 18A is parabolic in nature, and would remain so up to the transition point/super critical point discussed below. Referring to FIG. 18B, where the Reynold's number equals 1.0, the flow of the liquid is still parabolic, but there is a transition indicated at numeral 542. Turning next to FIG. 18C, the liquid flow is shown where the Reynold's number exceeds 1.0, and a vortex sheet 544 is formed. In FIG. 18D, the liquid flow turns from a laminar layer boundary 546 to a partially unstable region indicated by turbulent eddies wake 548 because inertial forces have overpowered the dominant viscous forces. The eddies wake 548 burst with energy from the wall of spacer 540. This "bursting" carries momentum from the sub-layer away. In FIG. 18D, the liquid flow has reached a super critical Reynold's number. In FIG. 18E, a small turbulent wake 550 is shown. The eddies shown in FIG. 18D transport large quantities of thermal energy away from the core flow tubes.

The development of turbulence from ambient water flowing over spacers as discussed above between overlapping keel coolers does not require that the spacers have cylindrical configurations. Water flow profiles over external surfaces such as spacers between keel coolers can have various configurations designed to create turbulence and vortical cell profiles which may be more effective than cylindrical profiles.

Figure 19A:
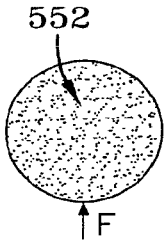
FIGS. 19A-19F are plan views of various spacer profiles according to an aspect of the invention for the development if Von Kármán Vortical Profiles for turbulent flow.
Figure 19B:
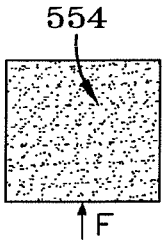
Figure 19C:
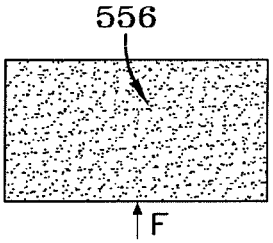
Figure 19D:
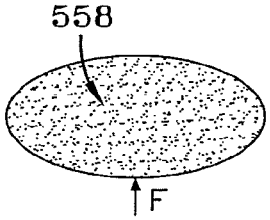
Figure 19E:
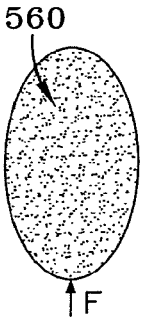
Figure 19F:
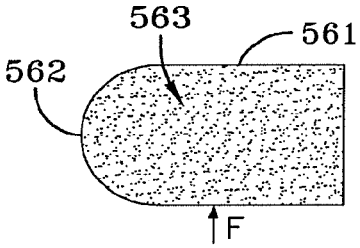

FIGS. 19A-19F have the cross-sections of various types of spacers, and indicate the relative flow of ambient water as the vessel, with the multiple-stacked keel coolers being separated by the spacers, proceeds in a direction opposite to the ambient flow lines indicated by the respective arrows. FIG. 19A shows in cross-section, a cylindrical spacer 552 against which ambient water follows a flow path F. In FIG. 19B, a spacer 554 with a square cross-section is shown, and against which a flow path F is shown. A spacer 556 with a rectangular cross-section is shown in FIG. 19C where a long side faces the flow F of ambient water. FIG. 19D shows a spacer 558 with an oval cross-section, having its major axis perpendicular to the ambient fluid flow F, and FIG. 19E shows a spacer 560 having an oval cross-section with the major axis parallel with the ambient fluid flow F. Turning next to FIG. 19F, a spacer 561 is shown having a cross-section which at its left end approximates a semicircle 562, and at its right end a rectangle 563, with the long edges merging with semicircle 562. The long central axis of spacer 561 is perpendicular to the ambient flow F. About one third of spacer 561 is basically a half cylinder, and the rest is a parallelepiped.

Figure 20A:
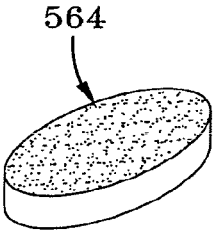
FIGS. 20A-20C are perspective views of various spacer configurations according to other aspects of the invention for the development of Von Kármán vortices.
Figure 20B:
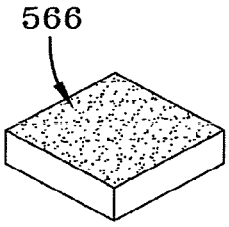
Figure 20C:
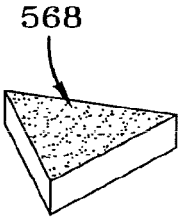

FIGS. 20A-20C show spacers in three dimensional form. FIG. 20A shows a spacer 564 having a circular cross-section, although spacer 564 could be an elliptic cylinder having an oval cross-section. Referring to FIG. 20B, a parallelepiped spacer 566 is shown having a square cross-section. Turning next to FIG. 20C, a triangular prism spacer 568 is shown having a triangular cross-section. Any of these spacers could be moved in different directions relative to the liquid flow, and this could change the effect on the liquid flow depending on such position.

Figure 21:
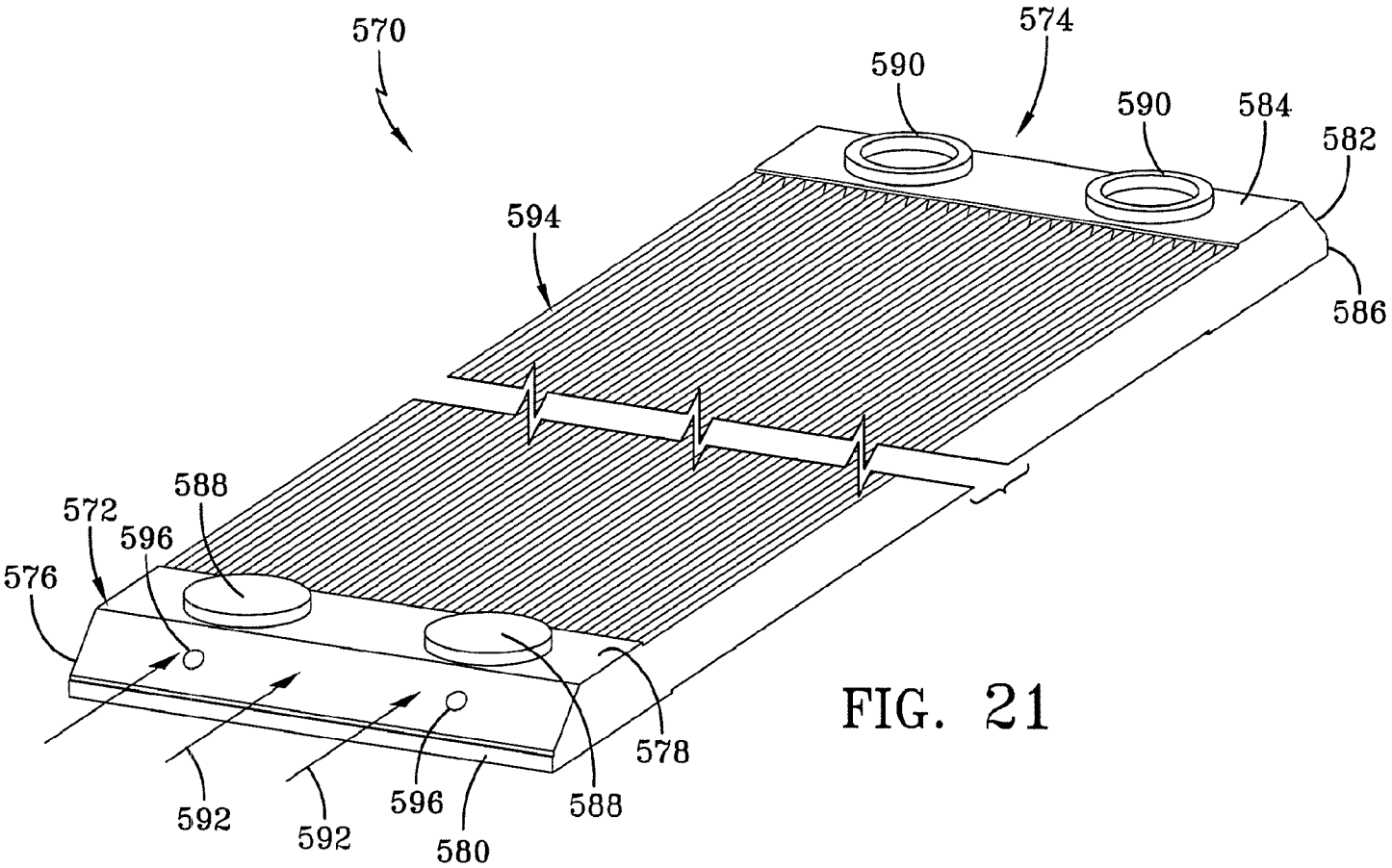
FIG. 21 is a perspective view of one keel cooler of a multiple-stacked keel cooler with a portion cut away, showing a set of spacers according to an embodiment of the invention.

FIG. 21 shows in perspective a keel cooler 570 which is the lower part of a multiple-stacked keel cooler or more particularly a double-stacked keel cooler. Keel cooler 570 has a lower, forward header 572 and a lower, rearward header 574. Lower, forward header 572 has a lower, basically beveled, forward header wall 576 tapering from a lower, flat, forward header top wall 578. At the lower end of lower, basically beveled, forward header wall 576 is a lower, small, forward header wall 580. Likewise, lower, rearward header 574 has a lower, basically beveled, rearward header wall 582 which extends between a lower, flat, rearward header top wall 584 and a lower, small, flat, rearward header wall 586.

Lower, forward header 572 has disposed thereon a pair of cylindrical spacers 588, and rearward header 574 likewise has a pair of nozzle rings 590. Spacers 588 perform the functions noted above, namely to contribute to the formation of turbulence from the flow of ambient fluid, shown by the arrows 592, as the ambient fluid proceeds through keel cooler 570. Keel cooler 570 further includes a set of coolant flow tubes 594 extending between forward and rearward headers 572 and 574. Coolant flow tubes 594 have the same shape and function as keel coolers 1 and 201, as discussed above. Anodes are not on header 572, but electric conducting wires extend from locations 596 to anodes on the hull of the marine vessel.

Figure 22:
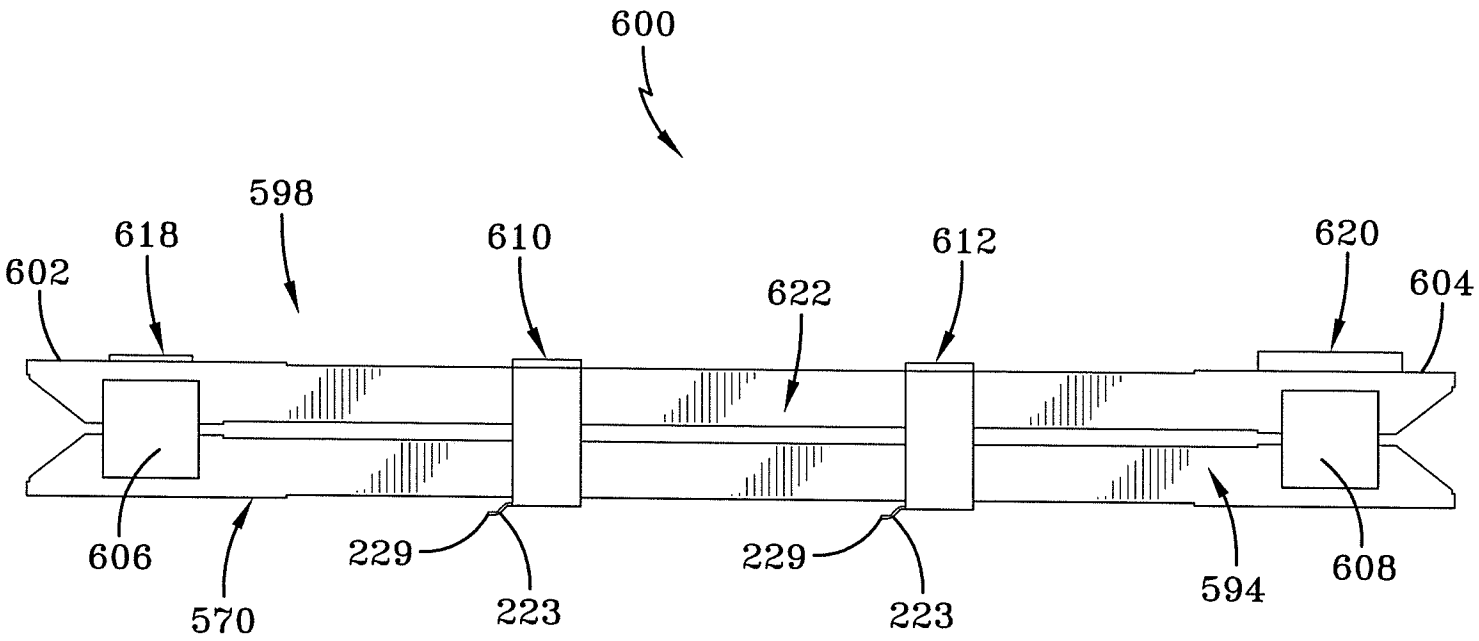
FIG. 22 is a side schematic view of a double-stacked keel cooler according to a preferred embodiment of the invention having converging beveled walls at the forward and rearward end of the double-stacked keel cooler, and having diverters extending from the bottom of the lower keel cooler.

FIG. 22 is a side view of a double-stacked keel cooler 600 which has as its lower keel cooler, keel cooler 570 and an upper keel cooler 598. Double-stacked keel cooler 600 is similar to keel cooler 201 shown in FIG. 6. Double-stacked keel cooler 600 has a forward end 602 and a rearward end 604. The forward ends of lower keel cooler 570 and upper keel cooler 598 are held together by respective pairs of connecting plates 606 and 608, with the other pairs of bracket plates 606 and 608, not being visible in FIG. 22. A forward bracket assembly 610 and a rearward bracket assembly 612 connect together the interim parts of keel coolers 570 and 598. Unlike keel cooler 201 shown in FIG. 6, double-stacked keel cooler 600 has two lower, forward diverters 223 which are held in place by brazing the diverter plates to lower coolant flow tubes 594. Double-stacked keel cooler 600 has a forward nozzle assembly 618 and a rearward nozzle assembly 620. Lower keel cooler 570 also incorporates upper coolant flow tubes 622.

Figure 23A:
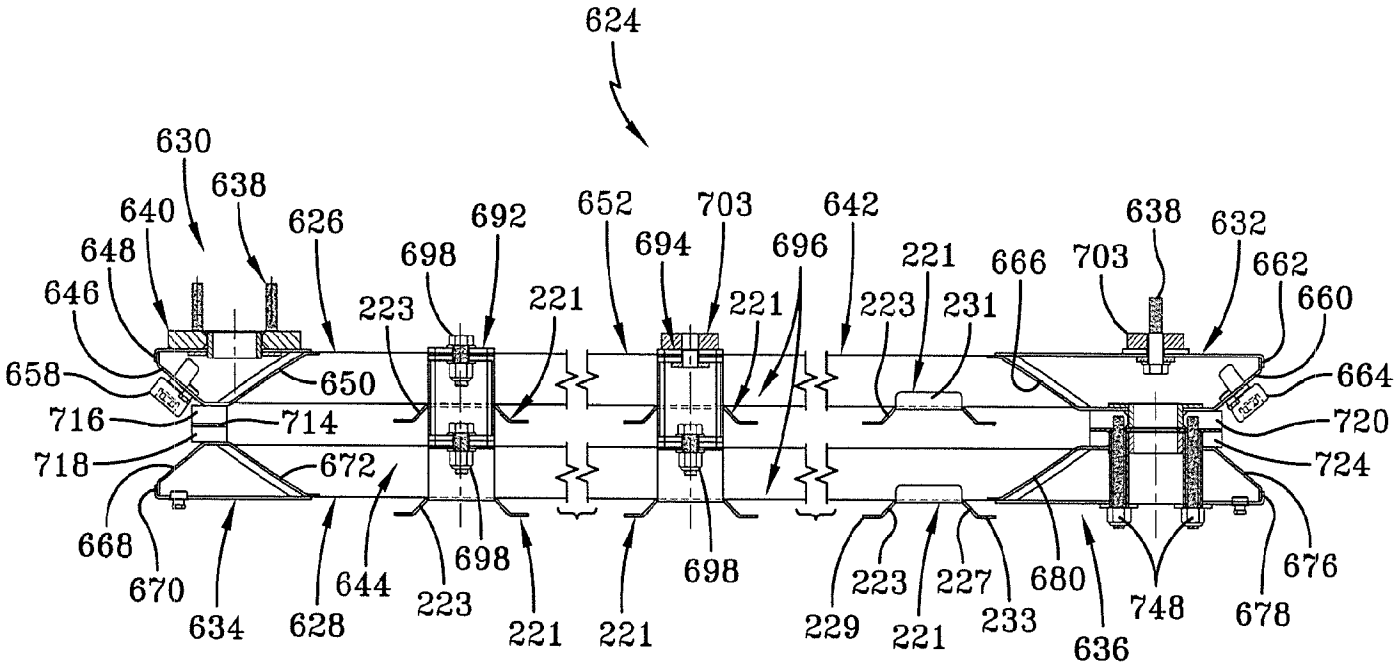
FIGS. 23A-23C are side, top and bottom detail views of a double-stacked keel cooler with converging beveled walls at the forward and rearward ends of the double-stacked keel cooler, and with diverters extending downwardly from the respective keel coolers.
Figure 23B:
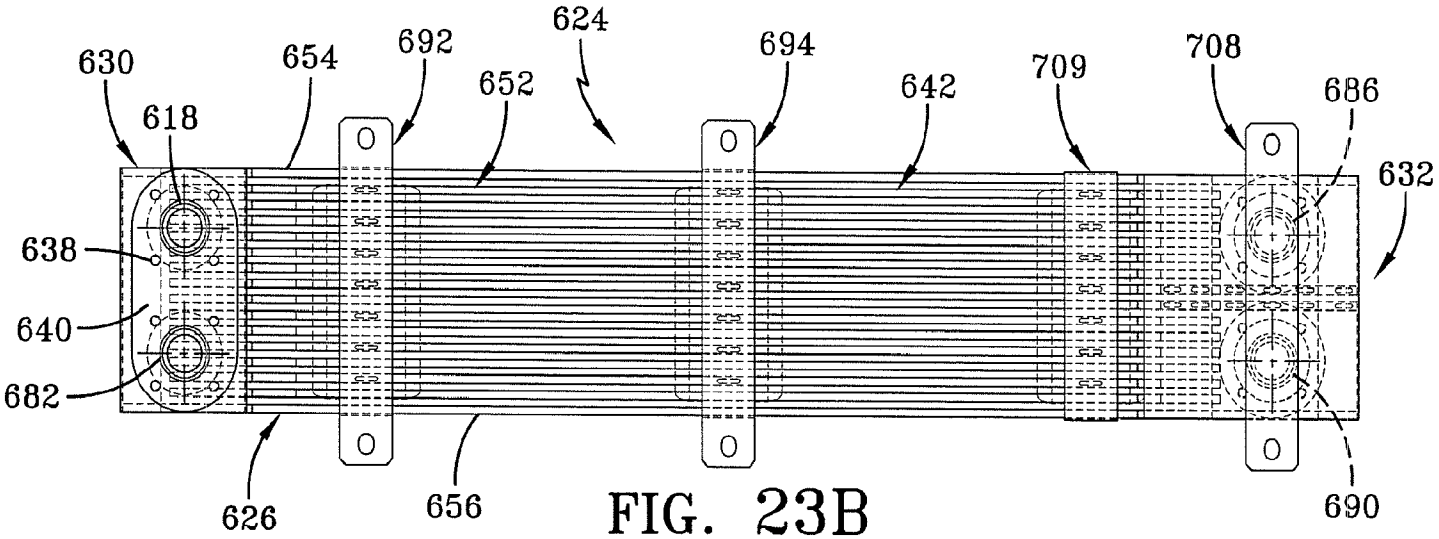
Figure 23C:
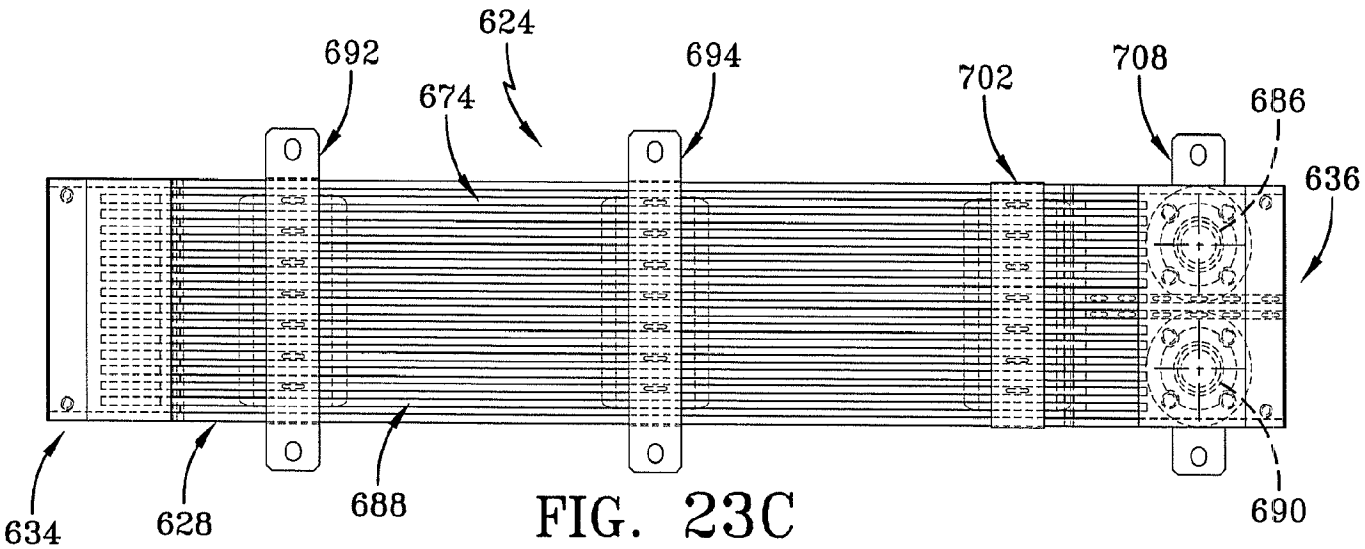

A detailed view of a double-stacked keel cooler 624 is shown in FIGS. 23A-23C. Double-stacked keel cooler 624 includes an upper keel cooler 626 and a lower keel cooler 628. Upper keel cooler 626 includes an upper, forward header 630 and an upper, rearward header 632. Lower keel cooler 628 has a lower, forward header 634 and a lower, rearward header 636. Upper, forward header 630 and both rearward headers 632 and 636 are shown as cutaways. Upper, forward header 630 has fastener assemblies 638 which extend through a gasket 640 into the hull of a marine vessel to which double-stacked keel cooler 624 is to be attached. A set of upper coolant flow tubes 642 extend between upper, forward header 630 and upper, rearward header 632. Similarly, a set of lower coolant flow tubes 644 extend between lower, forward header 634 and lower, rearward header 636. Upper coolant flow tubes 642 and lower coolant flow tubes 644 are like the coolant flow tubes described hereinbefore, and have a rectangular cross-section with longer walls extending vertically which are connected by shorter walls extending horizontally when double-stacked keel cooler 624 is positioned in a horizontal position such as when it is disposed on the keel of a marine vessel.

Upper keel cooler 626 has an upper, forward, beveled wall 646 with an upper, small, flat, forward header wall 648. Upper, forward header 630 further has an inclined wall 650 for receiving the ends of a portion of upper, inner coolant flow tubes 652 which are all inside a pair of upper, outer coolant flow tubes 654 and 656. Coolant fluid flows between upper, forward header 630, through upper, inner coolant flow tubes 652 through orifices in upper, forward, inclined wall 650 at the end of the respective upper, inner coolant flow tubes 652. Flow from upper, outer coolant flow tubes 654 and 656 is effected by means of orifices in the inner walls of upper, outer coolant flow tubes 654 and 656 which open into the chamber of upper, forward header 630. An upper, forward anode 658 extends through upper, forward, beveled wall 646. Likewise, upper keel cooler 626 has an upper, rearward, beveled wall 660 with an upper, small, rearward header wall 662. Upper, rearward header 632 further includes an upper, rearward anode 664 extending through upper, rearward, beveled wall 660. Upper, rearward header 632 also includes an upper, rearward inclined wall 666 corresponding to upper, forward, inclined wall 650. The foregoing parts all function as the corresponding parts associated with upper, forward header 630.

Lower keel cooler 628 has a similar construction to that of upper keel cooler 626. Lower keel cooler 628 has a lower, forward beveled wall 668 which adjoins at its lower end, a lower, small, forward header wall 670. There is likewise a lower, forward, inclined wall 672 through which a set of lower, inner coolant flow tubes 674 find access to the interior of lower, forward header 634. Lower, rearward header 636 has a corresponding lower, rearward, beveled wall 676 which joins at its lower portion a lower, small, rearward header wall 678. A lower, rearward, inclined wall 680 is also provided on lower, rearward header 636, and holds therein provide an access for lower, inner coolant flow tubes 674 to transfer liquid coolant.

Referring to FIG. 23B, it can be seen that upper, forward header 630 has a pair of inlet nozzle assemblies, namely upper, forward nozzle assembly 618 discussed previously, and an additional upper, forward nozzle assembly 682. Upward, forward insulating gasket 640 can be seen in FIG. 23B as having apertures for receiving fastener assemblies 638.

Double-stacked keel cooler 624 is a two pass keel cooler system. Assuming forward nozzle assembly 618 is an upper, input nozzle assembly, coolant would flow into nozzle assembly 618, flow towards upper, rearward header 632, flow down through a lower nozzle 686 which extends between upper, rearward header 632 and lower, rearward header 636, and flows forwardly in a set of lower coolant flow tubes 688 (which include lower, inner coolant flow tubes 674) and towards and through lower, forward header 634 and back through to a nozzle 690 interconnecting lower, rearward header 636 at upper, rearward header 632, and then flows towards outlet nozzle assembly 682 in a cool state so that the coolant can continue through its circulatory path in proximity to the heat source.

An upper, forward cross piece 692 and an upper, intermediate cross piece 694 extend across upper keel cooler 626, and cooperate with side brackets to assist in connecting upper keel cooler 626 and lower keel cooler 688. Pairs of diverter plates 221 are brazed to respective coolant flow tubes 642 and 688. A fastener assembly 698 connects brackets to cross pieces 692 and 694. A fastener extends through gasket 703 upward for attachment to the hull of a marine vessel. Each diverter plate 221 has a forward diverter 223 and a rearward diverter 227. A rearward cross piece 708 extends across upper, rearward header 632. It cooperates with brackets to assist in connecting upper keel cooler 626 and lower keel cooler 628 together. Another pair of diverter plates 221 is disposed between upper, intermediate cross piece 694 and rearward cross piece 701.

Double-stacked keel cooler 624 is attached to the hull of a ship by means of fastener assemblies 638 discussed previously, as well as by fastener 638 extending upwardly through gaskets 640 at upper, rearward header 632.

Double-stacked keel cooler 624 functions with respect to the creation of turbulent flow as explained previously, for breaking up the laminar boundary layer. As the marine vessel moves forwardly, ambient water flows into a water flow passage 714 defined by an upper, forward spacer 716 and a lower, forward spacer 718 (corresponding rearward, upper and lower spacers 720 and 722 are likewise provided) for creating turbulent flow as discussed earlier. Ambient water proceeds across upper, forward, beveled wall 646 and lower, forward, beveled wall 668 and passing through the stagnation point. Forward diverters 223 all contribute to diverting ambient water flow from within water flow passage 714 upwardly through upper, inner coolant flow tubes 652 to increase the cooling effect of double-stacked keel cooler 624. Lowermost, forward diverters 223 are disposed below the stagnant ambient water region along the bottom surface of double-stacked keel cooler 624 and divert the ambient water upwardly through lower coolant flow tubes 688.

Lower keel cooler 628 and upper keel cooler 626 are held together by means of forward cross piece 692, intermediate cross piece 694, rearward cross piece 708 and cross pieces 702 and 709, and brackets as explained earlier. As with other embodiments of the invention, keel cooler 624 operates when the marine vessel travels in the rearward direction due to upper, rearward header 632, lower rearward header 636, rearward diverters 227 and rearward spacers.

Figure 24A:
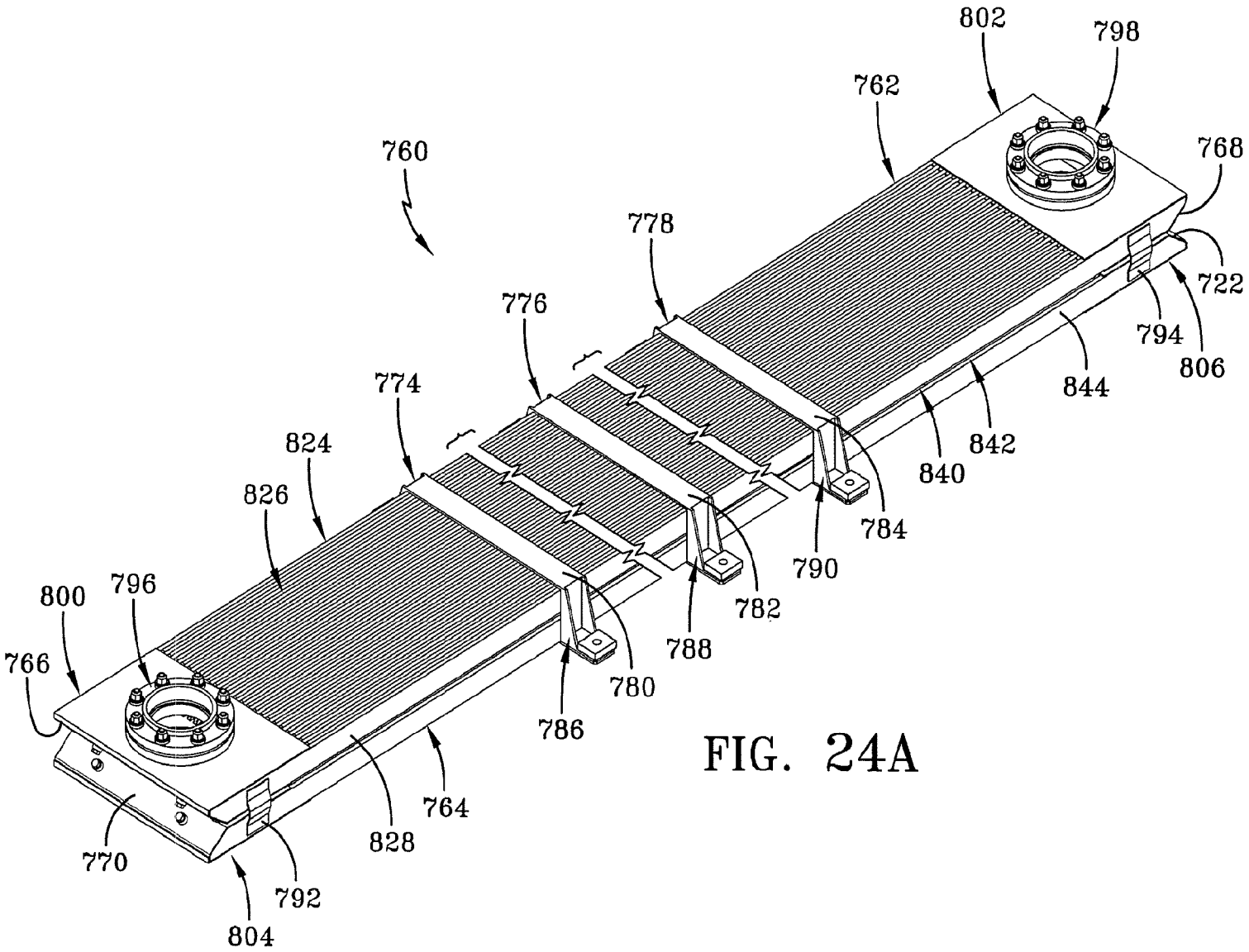
FIG. 24A is a top perspective view of a double-stacked keel cooler according to another preferred embodiment of the invention.
Figure 24B:
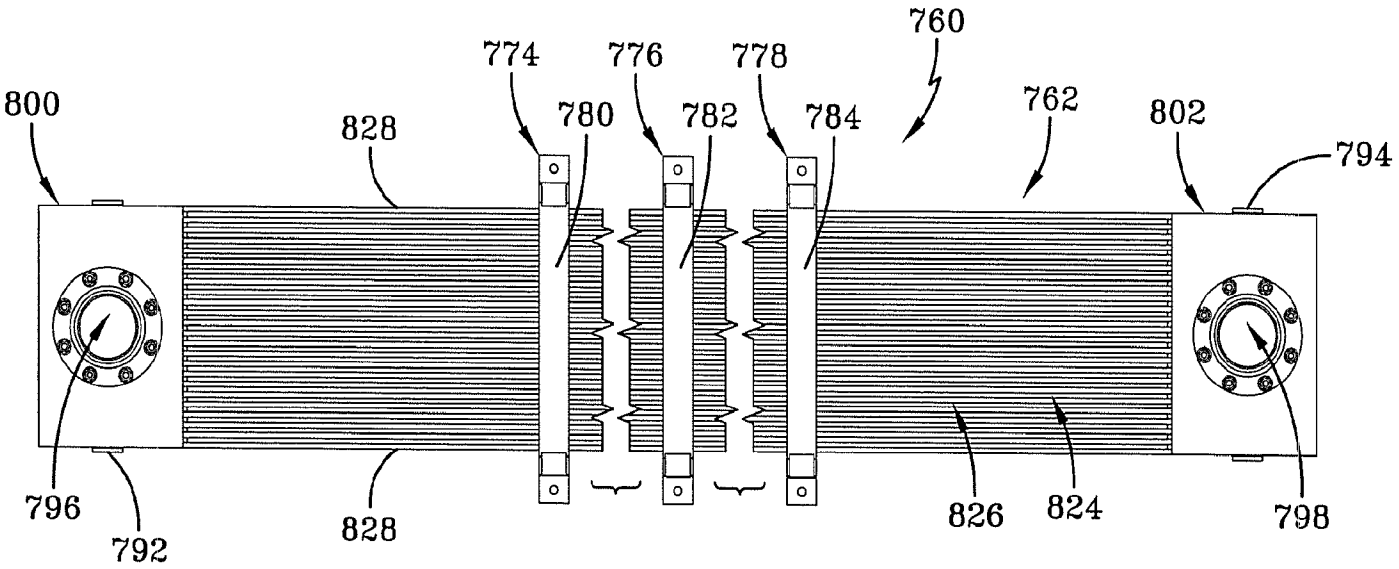
FIG. 24B is a plan view of the double-stacked keel cooler shown in FIG. 24A.
Figure 24C:
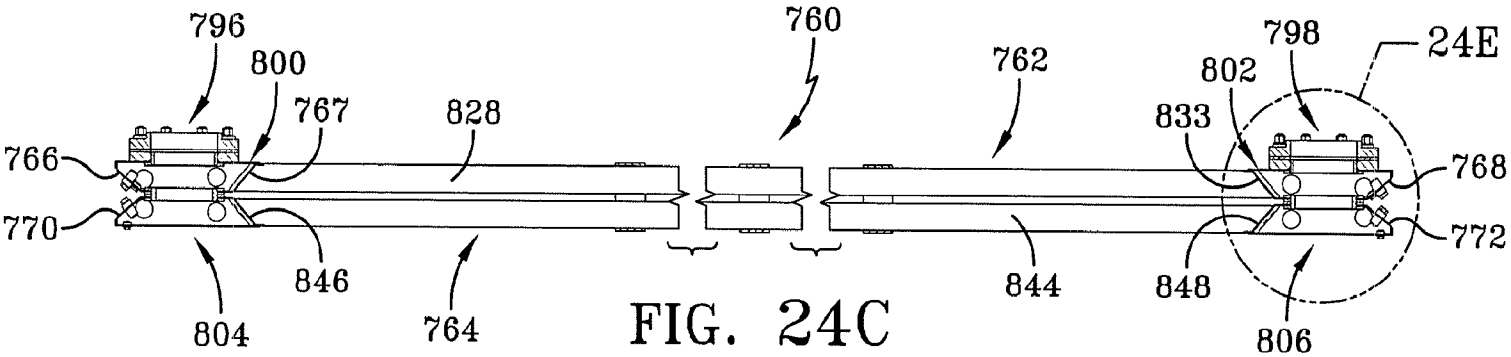
FIG. 24C is a side view of the double-stacked keel cooler shown in FIG. 24A-24B.
Figure 24D:
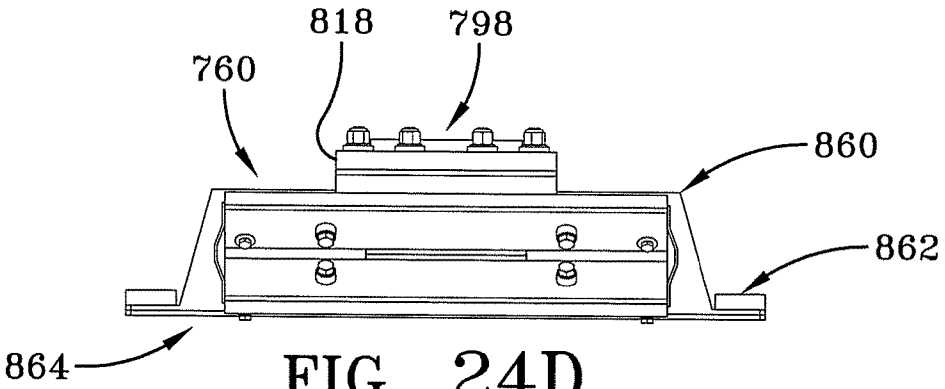
FIG. 24D is an end view of the double-stacked keel cooler shown in FIG. 24A-24C.
Figure 24E:
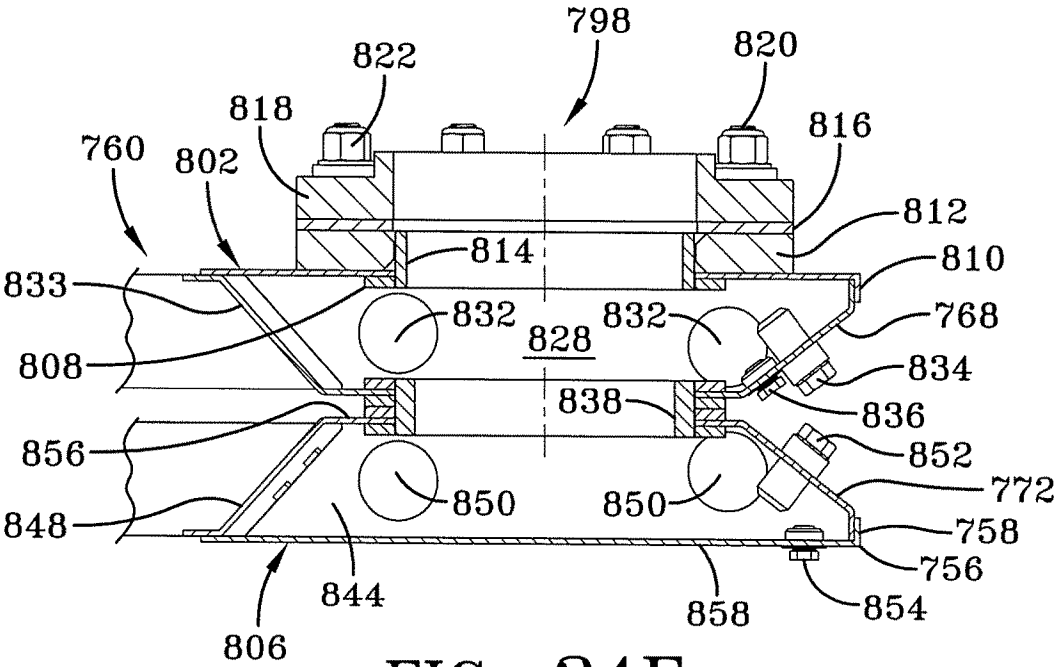
FIG. 24E is a detailed enlarged view of the portion of the keel cooler encircled in FIG. 24C.

Another embodiment of the invention is shown in FIGS. 24A-24E. These figures show a double-stacked keel cooler 760 having an upper keel cooler 762 and a lower keel cooler 764. Upper keel cooler 762 has a beveled, forward end defined by upper, forward, basically beveled wall 766, an upper, forward, inclined wall 767 and an upper, rearward, basically beveled wall 768. Lower keel cooler 764 has a lower, forward, basically beveled wall 770 and a lower, rearward, basically beveled wall 772. Upper keel cooler 762 and lower keel cooler 764 are held together and attached to a vessel by means of a forward, wraparound bracket 774, an intermediate, wraparound bracket 776 and a rearward, wraparound bracket 778. Each of brackets 774, 776 and 778 are composed of cross pieces 780, 782 and 784, and have at their respective ends side members 786, 788 and 790. A forward pair of opposing side plate brackets 792 and 794 connect the forward and rearward portions of upper keel cooler 762 and lower keel cooler 764 together. Double-stacked keel cooler 760 is equipped for flange mounting. Double-stacked keel cooler 760 has a forward nozzle assembly 796 and a rearward nozzle assembly 798. Forward nozzle assembly 796 extends upwardly from an upper, forward header 800, and rearward nozzle assembly 798 extends upwards from an upper, rearward header 802. Lower keel cooler 764 has a lower, forward header 804 and a lower, rearward header 806. Rearward nozzle assembly 798, with reference to FIG. 24E, is composed of an inner spacer plate 808, a manifold 810 and a flange 812, all of which have aligned orifices and surround a connector 814 extending upwardly from inner spacer plate 808 to which it is connected. A flange gasket kit 816 rests upon flange 812, and a slip-on pipe flange 818 sits upon flange gasket kit 816. A set of studs 820 extend through hexagonal lock nuts 822 to hold the foregoing flange 812, flange gasket kit 816 and slip-on pipe flange 818 against manifold 810 of upper, rearward header 802.

A set of upper coolant flow tubes 824, each having the rectangular cross-section as discussed previously, extend between upper, forward header 800 and upper, rearward header 802. Upper coolant flow tubes 824 include upper, inner coolant flow tubes 826 and upper, outer flow tubes 828. Considering FIG. 24E, an upper, outer coolant flow tube 828 can be seen between manifold 810 and inner spacer plates 808. A pair of upper, outer, coolant flow tube orifices 832 provide access from an upper, outer coolant flow tube 828 into upper, rearward header 802.

Upper, rearward header 802 includes an upper, rearward inclined wall 833. An upper, rearward anode 834 extends through upper, rearward, basically beveled wall 768. An upper, rearward drain plug 836 is located immediately below upper, rearward anode 834. A rearward connector 838 extends between upper, rearward header 802 and lower, rearward header 806.

Lower keel cooler 764 has lower coolant flow tubes 840 with lower, inner coolant flow tubes 842 and lower, outer coolant flow tubes 844. As shown in FIG. 24E, lower, outer coolant flow tube 844 has lower, outer coolant flow tube orifices 850.

Lower keel cooler 764 has a lower, forward inclined wall 846 and a lower, rearward inclined wall 848. Considering again FIG. 24E, lower, rearward header 806 has a lower, rearward anode 852 and a lower, rearward drain plug 854. Lower, rearward header 806 is housed by a lower, rearward manifold top section 856 and a manifold bottom section 858. Referring to FIG. 24D, an end section of double-stacked keel cooler 760 is shown having some of the items previously discussed, and further including a rearward wrap-around bracket 860, and a bracket mounting kit 862. Also shown in FIG. 24D is a pair of hanger brackets 864.

Another embodiment of a double-stacked keel cooler is shown in FIGS. 25A-25E. A double-stacked keel cooler 870 has an upper keel cooler 872 and a lower keel cooler 874. Upper keel cooler 872 has an upper, forward header 876 and an upper, rearward header 878. Lower keel cooler 874 likewise includes a lower, forward header 880 and a lower, rearward header 882. Lower keel cooler 874 is larger than upper keel cooler 872. This construction was made because upper keel cooler 872 would be required to cool the heat source giving out less heat than the heat source which is being cooled by lower keel cooler 874. Upper keel cooler 872 includes a set of upper coolant flow tubes 884 extending between an upper, forward inclined wall 886 and an upper, rea rward inclined wall 888. Upper, forward header 876 has an upper, forward, basically beveled wall 890 with an upper, small, forward wall 892. Upper, rearward header 878 has an upper, rearward, basically beveled wall 894 with an upper, small, rearward wall 896.

Similarly, lower keel cooler 874 has a set of lower coolant flow tubes 885. Lower keel cooler 874 has lower, forward header 880 with a lower, forward, basically beveled wall 898 having at its lower part having a lower, small, forward wall 900. Lower, forward header 880 further has a lower, forward inclined wall 902. Lower, rearward header 882 has a lower, rearward, inclined wall 904 and a lower, rearward, basically beveled wall 906 beneath a lower, small, rearward wall 908. Lower coolant flow tubes 885 extend between lower, forward, inclined wall 902 and lower, rearward, inclined wall 904.

Upper, forward, basically beveled wall 890 has an anode 910 disposed therein. Upper, rearward, basically beveled wall 894 has a drainage plug 912.

Upper keel cooler 872 has a pair of nozzle assemblies 914 and 916, and upper, rearward header has a single, upper, rearward nozzle assembly 917. With reference to FIGS. 25D and 25E, the details of upper, forward header 876 and lower, forward header 880 are shown. Upper, forward nozzle assembly 914 has four upwardly extending fasteners shown as studs 918 for attaching this portion of double-stacked keel cooler 870 to a copper-nickel flange 922 which is in turn fastened to the hull of a marine vessel. The other upper, forward nozzle assembly 916 is also shown as studs. Studs 920 extend upwardly through a flange 924 and surround the entrance to upper, forward header 876 and lower, forward header 880. A connector 926 forms a passageway into upper, forward header 876. Another connector 928 extends through upper, forward header 876 and enters lower, forward header 880. Lower, forward header 880 is attached to upper, forward header 876 by means of a pair of fastener assemblies 930 extending through stiffener tubes 931 into a spacer or flange 934 and a spacer or flange 932 to further connect together upper, forward header 876 and lower, forward header 880.

Further incorporated between upper, forward header 876 and lower, forward header 880 are an upper spacer 932 and a lower spacer 934 for contributing to the development of turbulence as ambient water flows between upper keel cooler 872 and lower keel cooler 874.

Upper, forward header 876 has an upper, bracket 936 and lower, forward header 880 has a lower bracket 938. A C-shaped side bracket 940 engages and extends between each of upper bracket 936 and lower bracket 938, and furthermore engages a side wall of a bracket 943 of a coolant flow tube. Aligned holes extend between each of the upper portion and the lower portion of C-shaped side bracket 940 and the respective walls with which they are engaged. There are aligned holes in the respective engaged surfaces, and upper and lower fastener assemblies 941 extend through the latter holes in order to contribute in holding upper keel cooler 872 and lower keel cooler 874 in engagement with each other. An opposing, C-shaped side bracket 940 is on the other side of upper, forward header 876 and extends between wall brackets 936 and 938 having similar aligned holes through which a fastener assembly 948 extends, as well as through an isolator 944 which is provided to isolate keel cooler 870 from the hull, and fastener assembly 941 extends through side bracket 940 and through wall bracket 938 to contribute holding upper and lower keel coolers 872 and 874 together. A drain plug 962 extends through lower, forward header 880.

An upper, forward cross piece 964 and an upper, rearward cross piece 966 extend across upper keel cooler 872 and attach upper keel cooler 872 to lower keel cooler 874 by means of fasteners extending through respective pairs of orifices 968 and 970 through upper, forward cross piece 964 and orifices 970 through upper, rearward cross piece 966, through respective pairs of orifices 976 and 978 of a lower, forward cross piece 972 and a lower, rearward cross piece 974 extending across lower keel cooler 874.

Lower keel cooler 874 has a lower, forward nozzle assembly 960 and a lower, rearward nozzle assembly 980. Lower, forward nozzle assembly 960 is composed of a lower, forward nozzle assembly 982 having a flange 982 attached to lower, forward header 980 by fastener assemblies 952 discussed previously. Lower, rearward nozzle assembly 980 likewise has a flange 984 which is held in place by a set of fasteners 986.

Figure 25A:
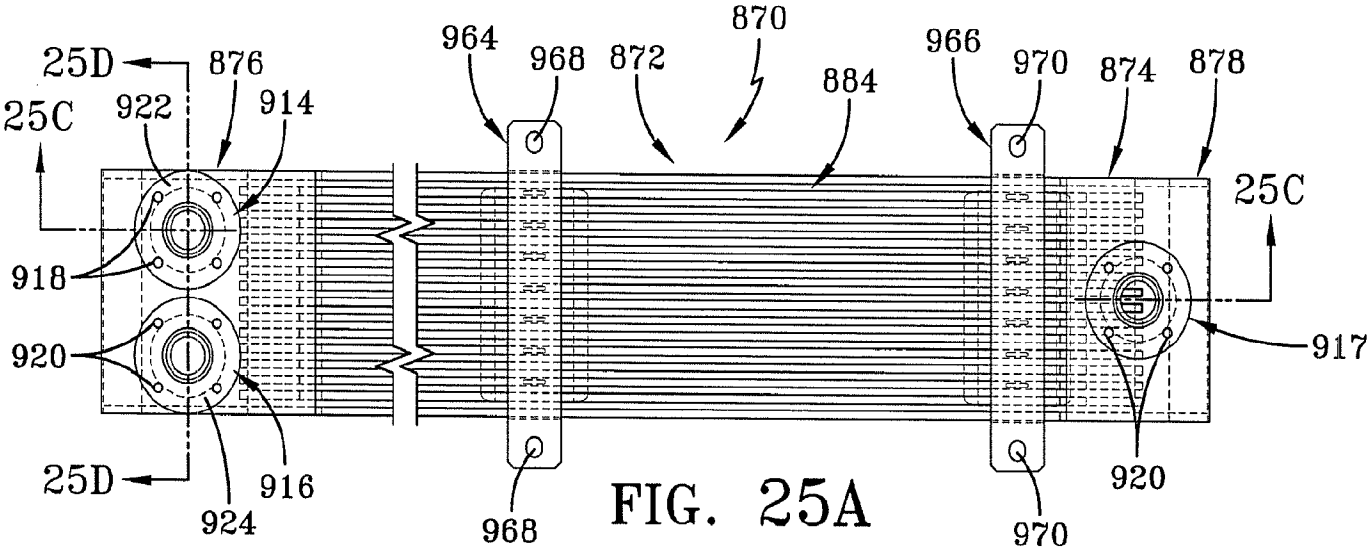
FIG. 25A is a plan view of an upper keel cooler of a double-stacked keel cooler as shown in FIG. 25C.
Figure 25B:
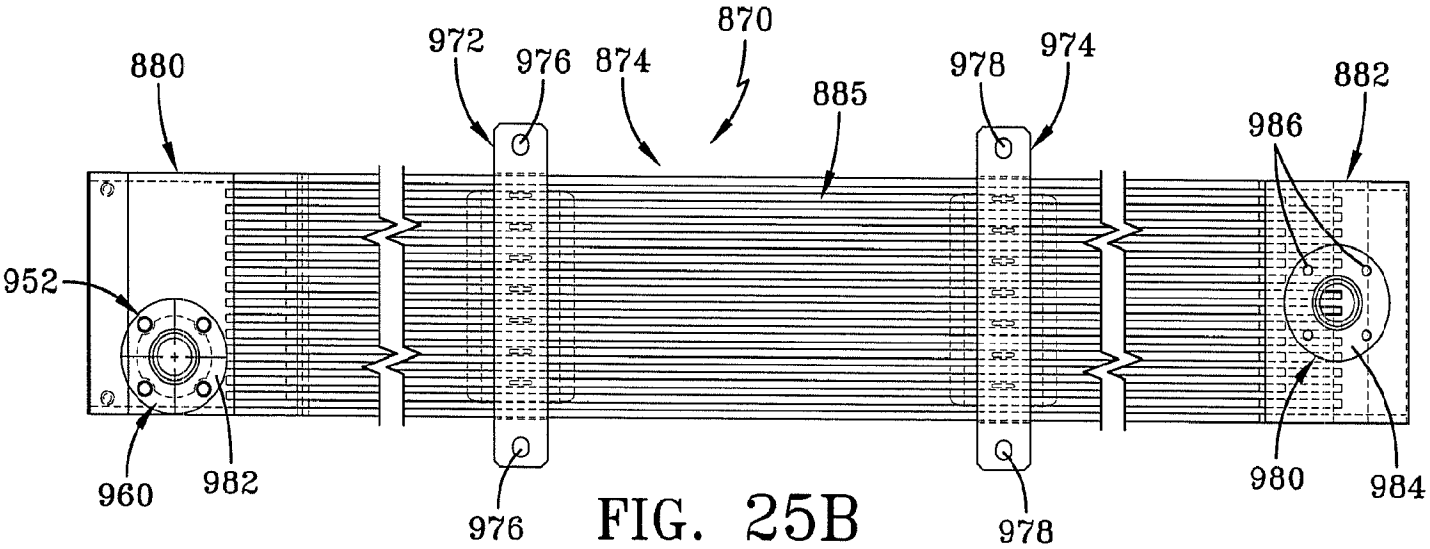
FIG. 25B is a top view of the lower keel cooler shown in FIG. 25A.
Figure 25C:
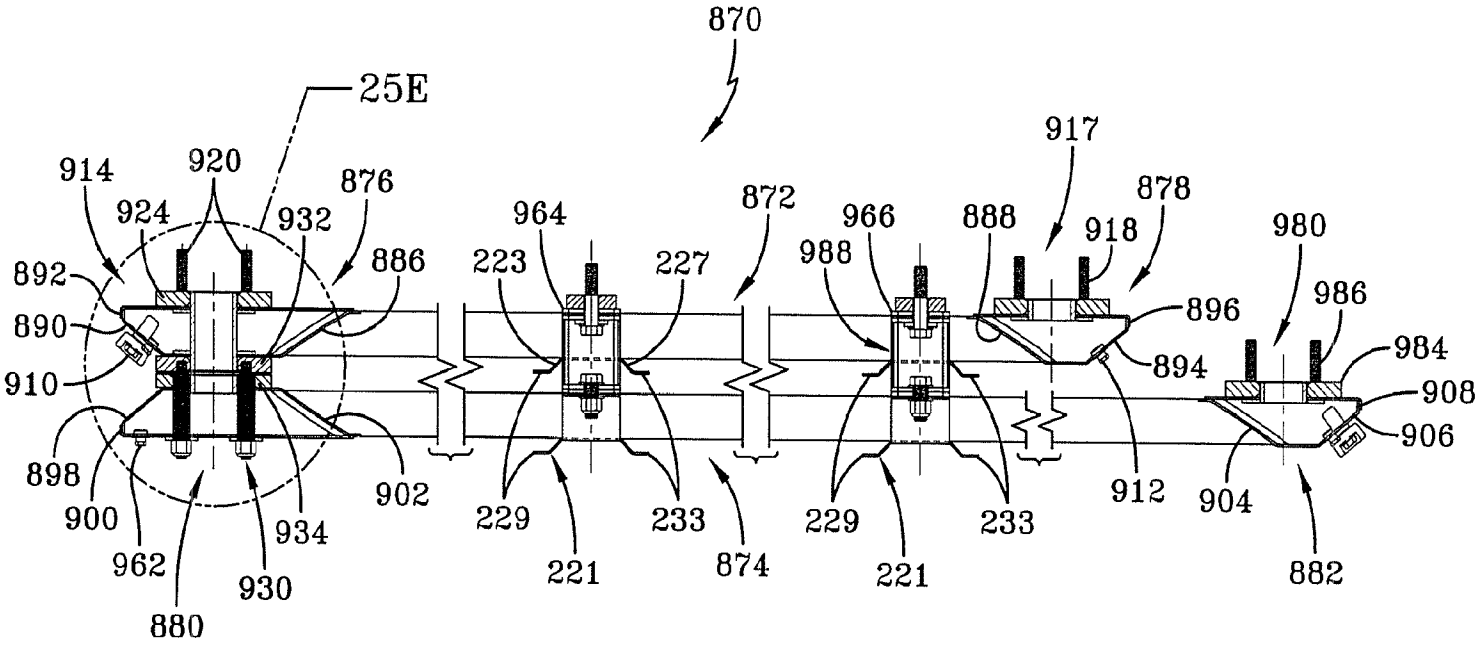
FIG. 25C is a view of a double-stacked keel cooler according to a preferred embodiment of the invention having keel coolers of unequal length taken in the direction 25C-25C in FIG. 25A with a portion cut away.
Figure 25D:
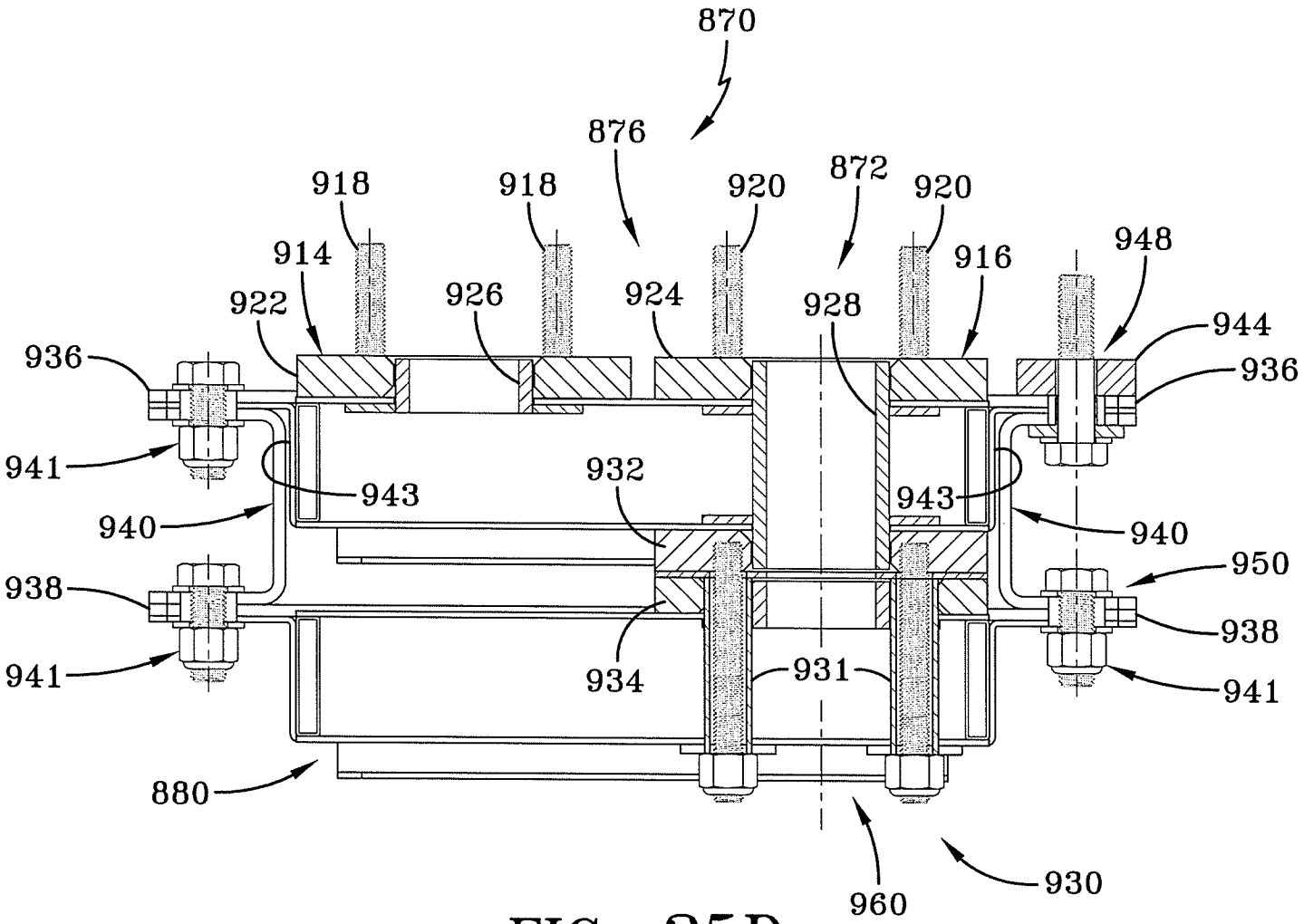
FIG. 25D is a view taken in the direction 25D-25D in FIG. 25A.
Figure 25E:
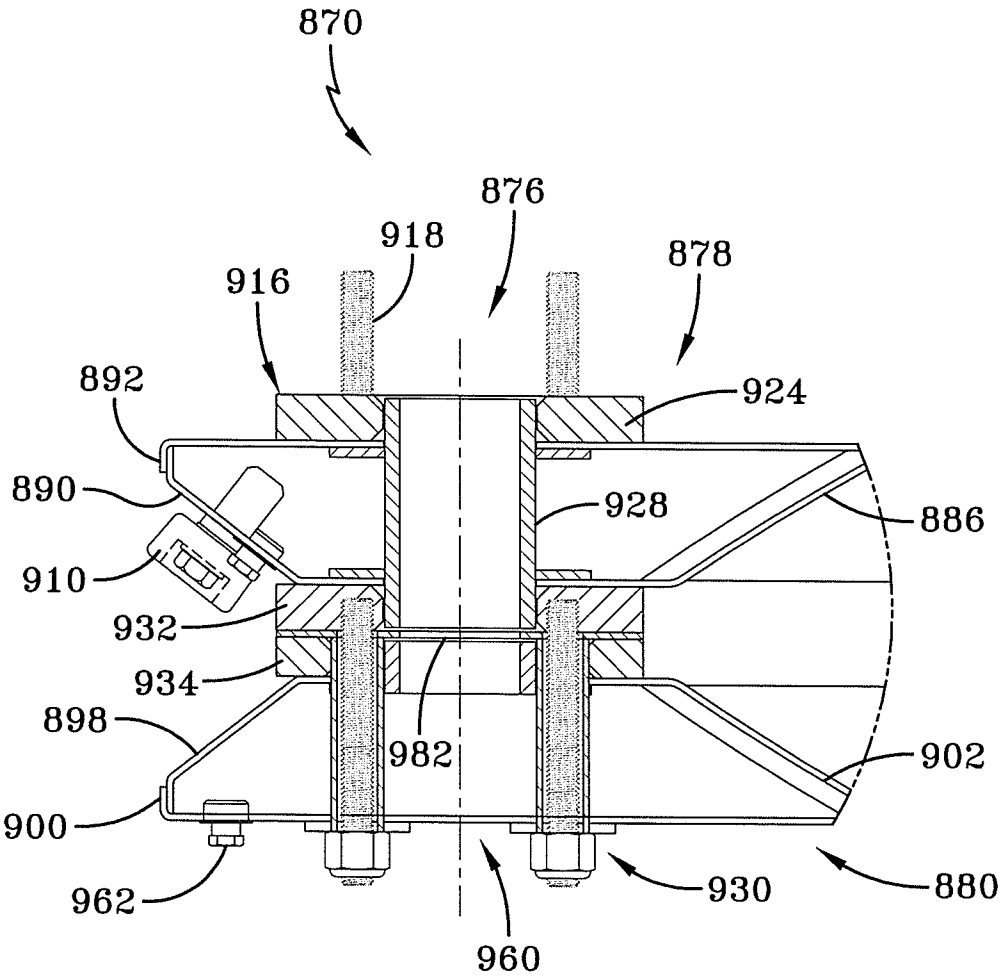
FIG. 25E is an enlarged view of the portion of the double-stacked keel cooler shown in the circle formed by phantom lines in FIG. 25C.

Referring to FIG. 25C, diverter plates 221 (FIG. 7) are disposed in double-stacked keel cooler 870. A pair of diverter plates 221 are attached to upper coolant flow tubes 884 and to lower coolant flow tubes 885. Diverter plates 221 have extending from them forward diverters 223 and rearward diverters 227. Tabs 231 of diverter plates 221 are brazed to coolant flow tubes along with the edges of diverter plates 221, to fix diverter plates 221 in place. Forward diverters 223 extend through the stagnant ambient water region as the marine vessel moves forwardly. The same holds true with respect to rearward diverters 227 as the marine vessel moves rearwardly.

Turbulent flow of ambient water is effected by upper, forward, basically beveled wall 890 and lower, forward, basically beveled wall 898; by forward upper spacer 932, forward lower spacer 934 and respective diverters 221—for all of the reasons discussed previously with respect to corresponding parts.

In operation, heated coolant from the heat source emitting the lower amount of heat enters upper keel cooler 872 through upper, forward nozzle assembly 914, proceeds through connector 928 to lower keel cooler 874, flows through lower keel cooler 874 and exits through nozzle assembly 980. Coolant from the small heat source flows into nozzle assembly 916 into upper coolant flow tubes 884 and is discharged into upper, rearward header 878 for circulation back to the latter heat source.

Another embodiment of the invention is shown in FIGS. 26A-26E of a double-stacked keel cooler 1020. Double-stacked keel cooler 1020 includes an upper keel cooler 1022 and a lower keel cooler 1024, the latter keel coolers being of equal size. Upper keel cooler 1022 has an upper, forward header 1026 and an upper, rearward header 1028. Lower keel cooler 1024 has a lower, forward header 1030 and a lower, rearward header 1032. Upper keel cooler 1022 includes upper coolant flow tubes 1034 extending between upper, forward header 1026 and upper, rearward header 1028. Likewise, lower keel cooler 1024 includes lower coolant flow tubes 1036 extending between lower, forward header 1030 and lower, rearward header 1032. Upper, forward header 1026 includes upper, forward, basically beveled walls 1038 which cooperate with converging lower, forward, basically beveled walls 1040 and contribute in the forming of turbulent flow of ambient water. An upper, small, forward wall 1042 is at the upper end of beveled wall 1038, and a lower, small, forward wall 1044 is merged with lower, forward, basically beveled wall 1040. Upper, forward header 1026 has an upper, forward, inclined wall 1046, and upper, rearward header 1028 has an upper, rearward, inclined wall 1048. Lower, forward header 1030 has a lower, forward, inclined wall 1050, and lower, rearward header 1032 has a lower, rearward, inclined wall 1052.

Upper coolant flow tubes 1034 extend between upper, forward, inclined wall 1046 and upper, rearward, inclined wall 1048. Lower coolant flow tubes 1036 extend between lower, forward, inclined wall 1050 and lower, rearward, inclined wall 1052.

Figure 26A:
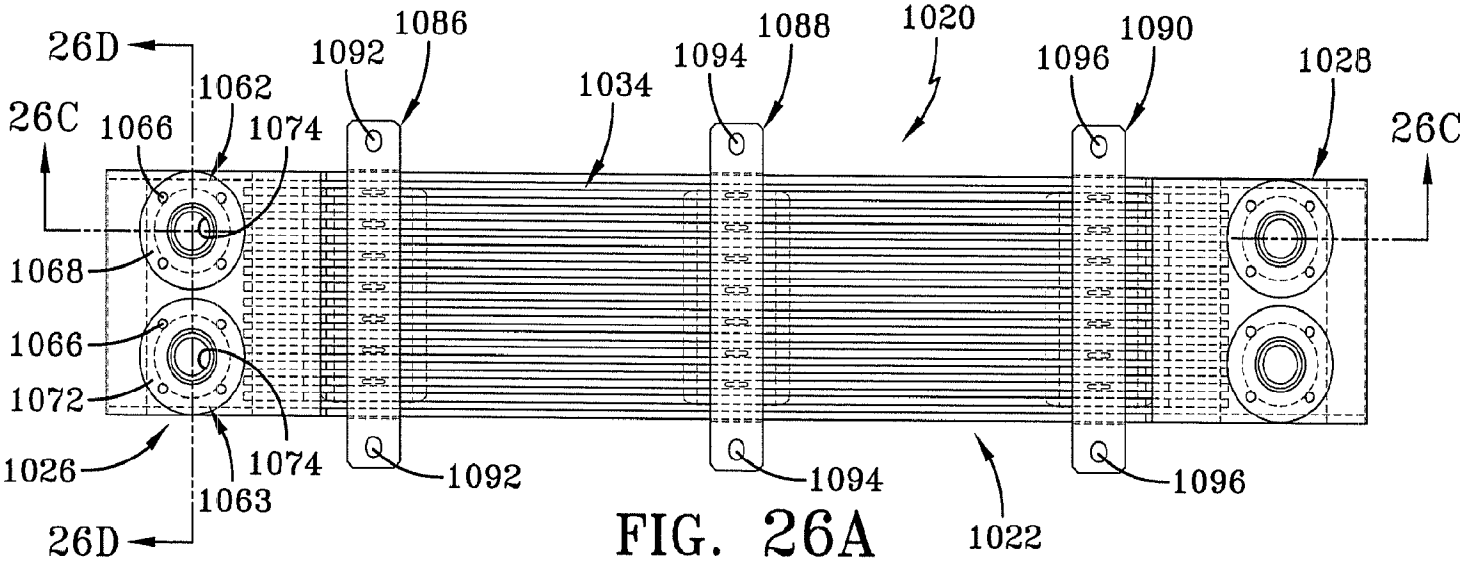
FIG. 26A is a plan view of the upper keel cooler of another preferred embodiment of the invention.
Figure 26B:
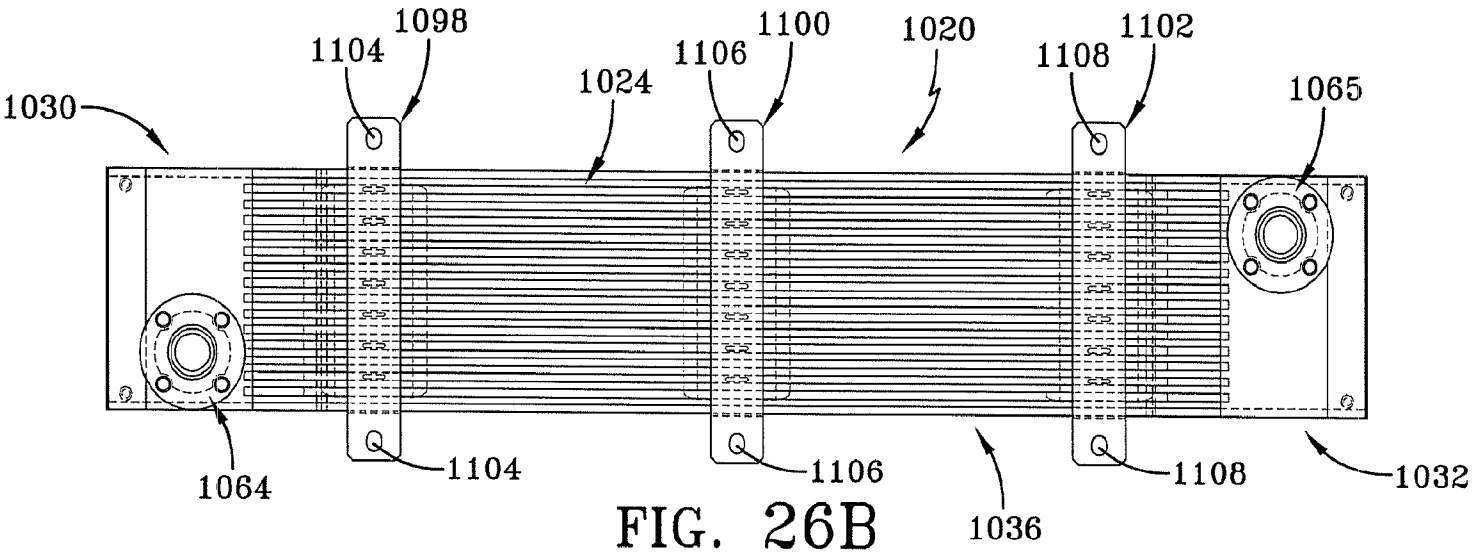
FIG. 26B is a plan view of the lower keel cooler shown in the embodiment of the invention shown in FIG. 26C.
Figure 26C:
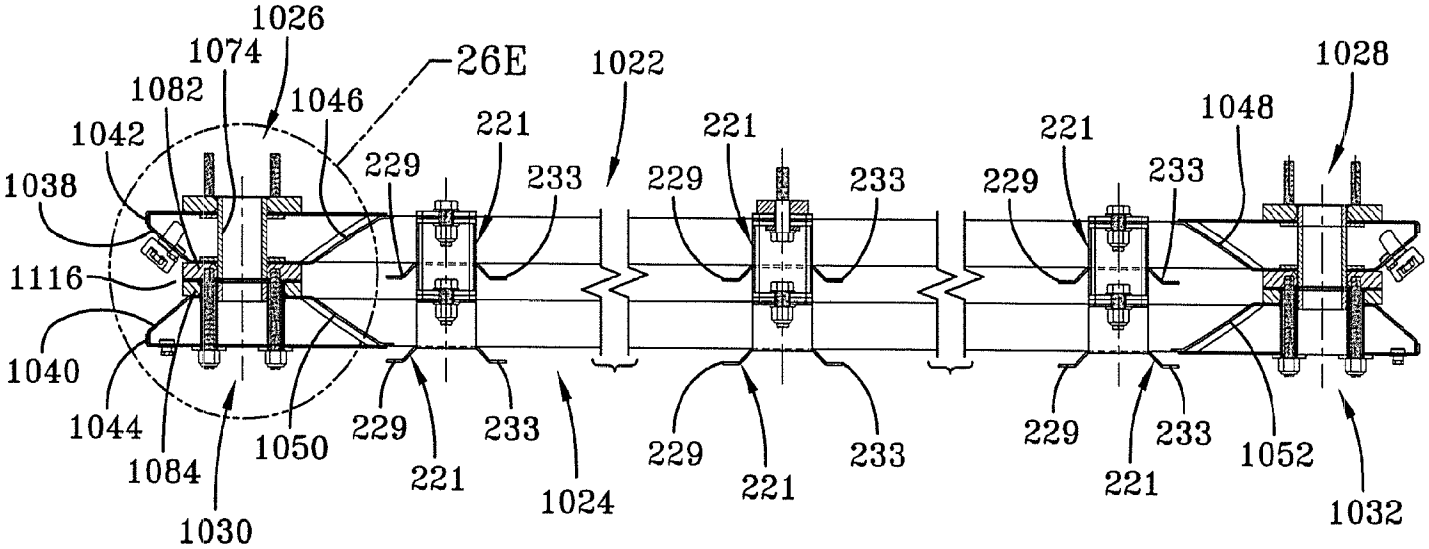
FIG. 26C is a cross-sectional side view of the double-stacked keel cooler taken in the direction 26C-26C in FIG. 26A.
Figure 26D:
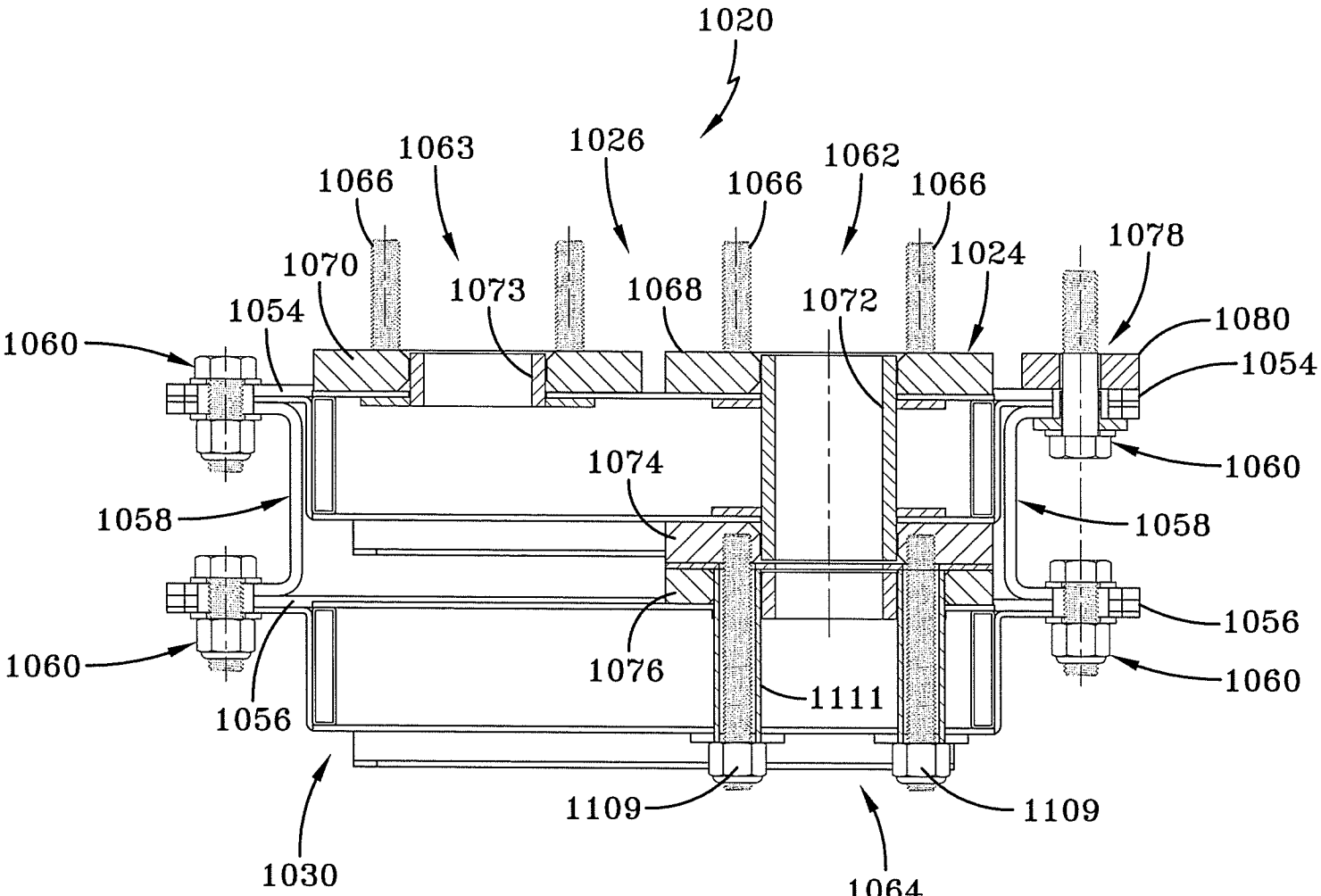
FIG. 26D is a cross-sectional view of the keel cooler taken in the direction 26D-26D in FIG. 26A.
Figure 26E:
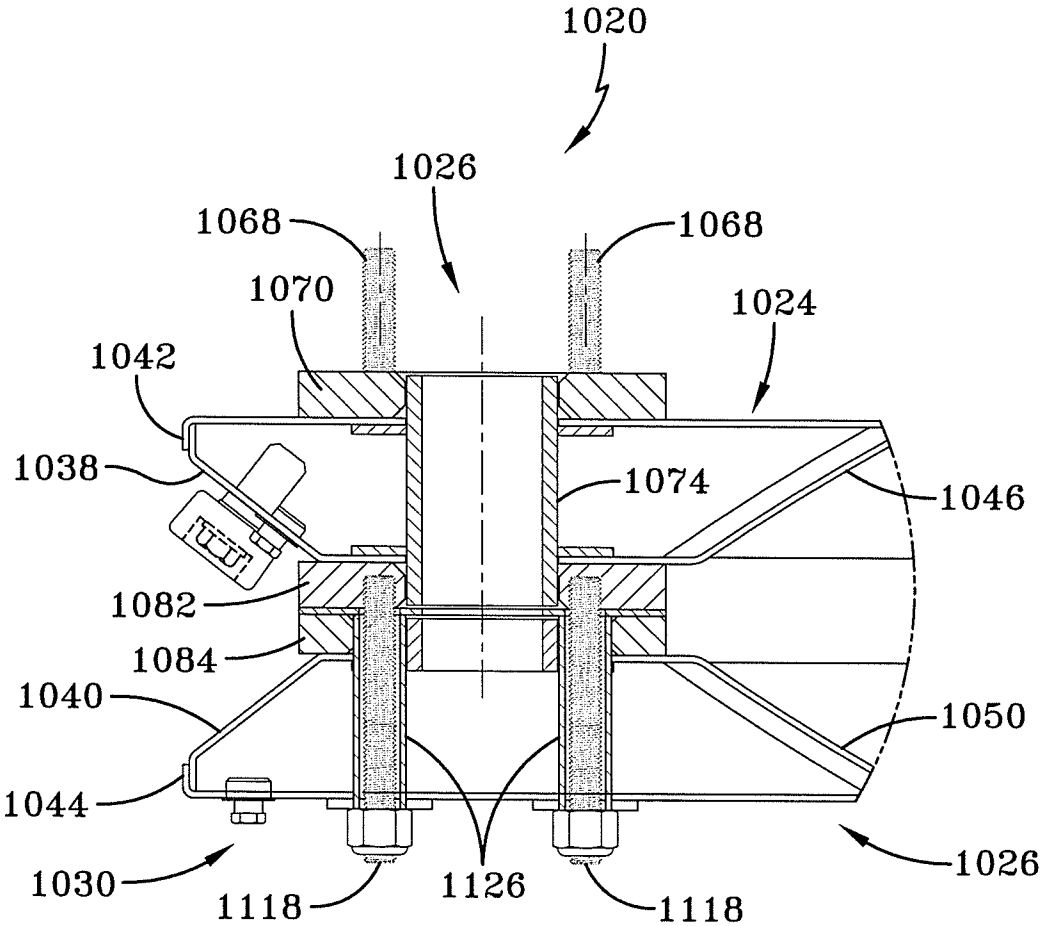
FIG. 26E is an enlarged view of a portion of the keel cooler shown in FIG. 26C shown in the phantom line circle.

Referring to FIG. 26D, upper, forward header 1026 has an upper bracket 1054, and lower, forward header 1030 has a lower, forward bracket 1056. C-shaped side brackets 1058 each have two opposing arms in engagement with upper bracket 1054 and lower bracket 1056 respectively. The latter brackets have holes aligned with corresponding holes in C-shaped side bracket 1058, and upper fastener assemblies 1060 extend through the respective holes in order to attach upper, forward header 1026 to lower, forward header 1030. Upper keel cooler 1022 has an upper, forward nozzle assembly 1062 and another upper, forward nozzle assembly 1063. Fasteners in the form of studs 1066 extend through a copper-nickel flange 1068 and another set of studs 1066 extend through upper, forward flange 1070. These fasteners contribute to holding double-stacked keel cooler 1020 to the hull of a marine vessel. A connector 1072 extends through upper, forward flange 1068 through upper, forward header 1026 and through an upper, lower flange 1074 and a flange 1076 to lower, forward headers 1064. Fastener assemblies 1109 extend through appropriate receptacles in lower, forward header 1030 through lower, upper flange 1076 and into upper, lower flange 1074 to assist in the connection together of upper, forward header 1026 and lower, forward header 1030. Another C-shaped side bracket 1058 disposed on the opposite sides of upper, forward header 1026 and lower, forward header 1030 between upper bracket 1054 and lower bracket 1056 having respectively aligned holes for receiving fastener assemblies 1066 and another fastener assembly 1078, respectively. Fastener assembly 1078 extends through an upper insulator 1080 disposed on bracket 1054. Upper fastener assembly 1078, along with fastener assemblies 1066, are used to secure double-stacked keel cooler 1020 to the hull of a marine vessel. A connector 1073 is part of upper, forward nozzle assembly 1063, and extends through flange 1070 into upper, forward header 1026. Lower keel cooler 1024 has a lower, forward nozzle assembly 1064 and a lower, rearward nozzle assembly 1065.

Double-stacked keel cooler 1020 further has an upper, forward spacer 1082 and a corresponding lower, forward spacer 1084 which function as explained earlier, by initiating further turbulent flow of ambient water as the marine vessel proceeds forwardly through the water.

Upper keel cooler 1022 is connected to lower keel cooler 1024 by means of an upper, forward cross piece 1086, an upper, intermediate cross piece 1088 and an upper, rearward cross piece 1090. These cross pieces are connected to underlying cross pieces 1098, 1100 and 1102 by means of fasteners extending through respective pairs of orifices 1092, 1094 and 1096 at opposite ends of cross pieces 1086, 1088 and 1090, orifices 1104, 1106, 1108 in cross pieces 1098, 1100 and 1102 respectively. Fastener assemblies 1109 extending through stiffener tubes 1111 and into upper flange 1074 contribute in holding upper keel cooler 1022 and lower keel cooler 1024 together. Another set of fastener assemblies 1118 extend through stiffener 1084 for the same purpose.

Five sets of pairs of diverter plates 221 are provided. Each diverter plate 221 has forward diverter 223 and a rearward diverter 227 and respective flat portions 229 and 233.

An ambient water flow path or ambient water passageway 1116 extends between a space between upper, forward spacer 1082 and lower, forward spacer 1084, and between upper keel cooler 1022 and lower keel cooler 1024. Diverters 223 (assuming the marine water vessel is moving forward) diverts ambient water flowing through ambient water flow path 1116 in between upper coolant flow tubes 1034 by extending through the stagnant layer of ambient water residing along the underside of upper coolant flow tubes 1034 and in ambient water passageway 1116.

Thus, there are a number of factors which increase the cooling effect accomplished by double-stacked keel cooler 1020. These include the upper, forward, basically beveled wall 1038 and cooperating lower, forward, basically beveled wall 1040, upper, forward spacer 1082 and lower, forward spacer 1084 and the various diverters 223 (or 227) discussed immediately above to achieve results of this embodiment of the invention.

Figure 27:
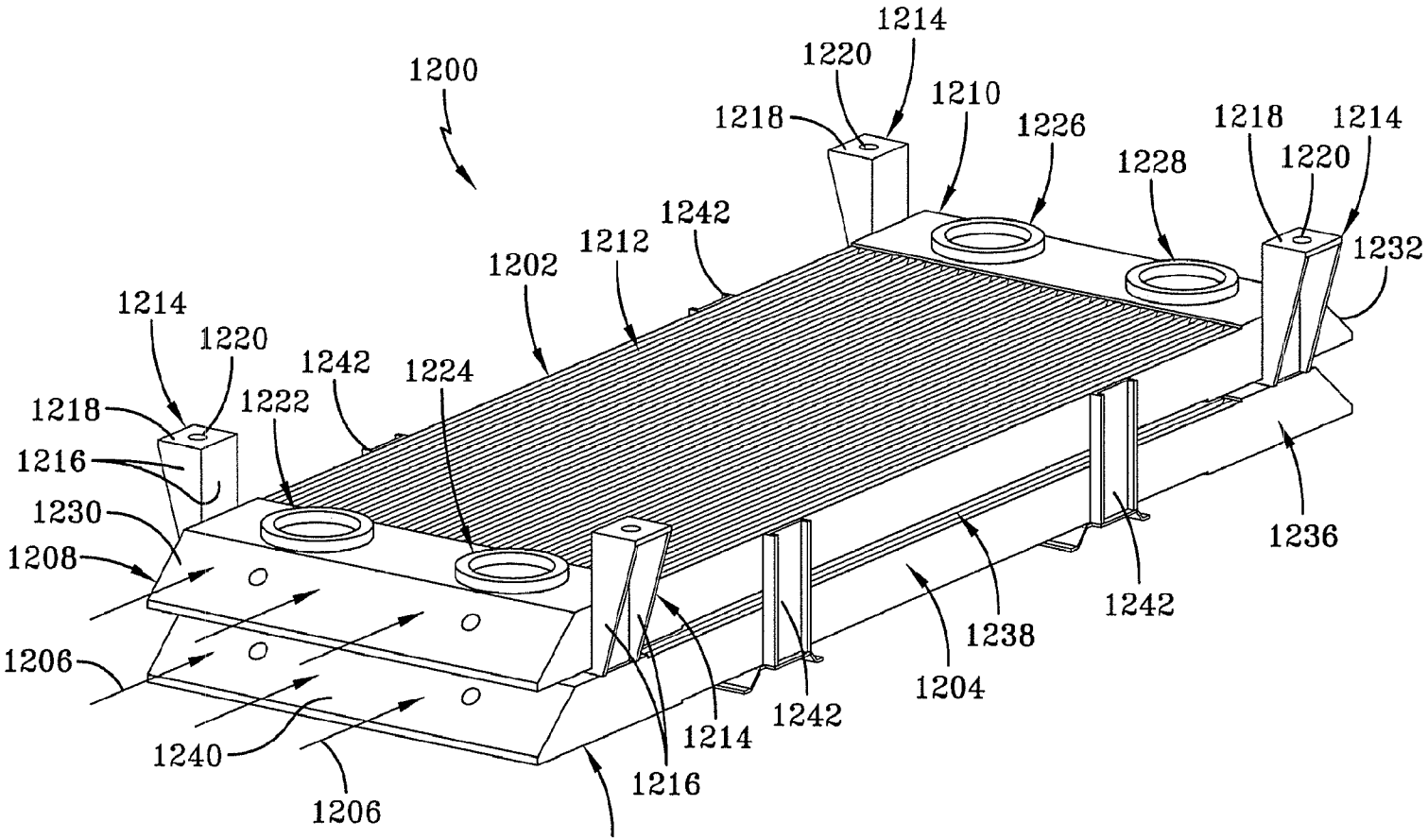
FIG. 27 is a perspective view of another embodiment of the invention wherein the upper and lower keel coolers of a double-stacked keel cooler are made for modular assembly, but where there is no flow of ambient liquid between the upper and lower keel coolers.

Referring next to FIG. 27, a portion of a multiple-stacked keel cooler 1200 is shown. Omitted is an upper keel cooler which is virtually identical to the top keel cooler shown, but in a reversed position. Multiple-stacked keel cooler 1200 includes a first keel cooler 1202 and a second keel cooler 1204 beneath the first keel cooler. Ambient water flowing through multiple-stacked keel cooler 1200 is indicated by the arrows 1206. First keel cooler 1202 incorporates a first, forward header 1208 and a first, rearward header 1210. A set of first coolant flow tubes 1212 extends between first, forward header 1208 and first, rearward header 1210. A set of corner brackets 1214 is disposed near each corner of first keel cooler 1202. Each corner bracket 1214 has a pair of parallel, vertical legs 1216 which are perpendicular both to second keel cooler 1204 and to the longer side walls of first coolant flow tubes 1212. The respective pairs of legs 1216 are connected by a flat, bridge-like portion 1218. Each corner bracket 1214 has an orifice 1220 in the center of each flat, bridge-like portion 1218. The respective corner brackets 1214 are fastened to both first keel cooler 1202 and second keel cooler 1204, and fasteners extend through orifices 1220 to suspend multiple-stacked keel cooler 1200 to the hull of a marine vessel. First, forward header 1208 includes one forward nozzle assembly 1222 and another forward nozzle assembly 1224. First, rearward header 1210 has one rearward nozzle assembly 1226 and another rearward nozzle assembly 1228.

First keel cooler 1202 comprises a first forward, basically beveled wall 1230, which is beveled to converge with the upper but omitted upper keel cooler discussed hereinbefore. Upper, forward, basically beveled wall 1230 makes an angle with respect to the horizontal base of upper keel cooler 1202. A first, rearward, basically beveled wall 1232 is disposed at the rearward end portion of multiple-stacked keel cooler 1200.

Second keel cooler 1204 has a second, forward header 1234 and a second, rearward header 1236. Second, rearward header 1236 further has a second set of coolant flow tubes 1238 extending between second, forward header 1234 and second, rearward header 1236. Second, forward header 1234 has a second, forward, basically beveled wall 1240 which is angled with respect to the horizontal base of second keel cooler 1204.

Multiple-stacked keel cooler 1200 is constructed so that is can be attached to hull of a marine vessel in a modular manner. This important because the omitted upper keel cooler, first keel cooler 1202 and second keel cooler 1204 are very heavy, since they are made of a nickel-copper alloy. It would be very difficult to support these keel coolers together to attach them to the hull of a marine vessel. Thus, upper keel cooler, which is not shown could be attached to the hull of a marine vessel by means of elevating that upper keel cooler and putting brackets 1214 in engagement with the marine vessel by having respective flat, bridge-like portions 1218 engage the hull of a marine vessel, and applying an appropriate fastener to attach that upper keel cooler to the vessel. Thereafter, first keel cooler 1204 could be attached to upper keel cooler. The latter is accomplished by positioning first keel cooler 1202 beneath the upper keel cooler after the latter has been attached to the hull of a marine vessel, and attaching side brackets 1242 to both upper keel cooler and first keel cooler 1202. Then, second keel cooler 1204 could similarly be attached to basically assemble multiple-stacked keel cooler 1200. Although multiple-stacked keel cooler 1200 lacks the arrangement of a full set of stacked keel coolers with opposing beveled walls to create stagnation points for pairs of keel coolers all having converging beveled headers for the purpose of accelerating ambient flow to create turbulence of the ambient water within multiple-stacked keel cooler 1200, the modular assembly arrangement is very beneficial. The use of spacers and diverters is still possible.

Figure 28:
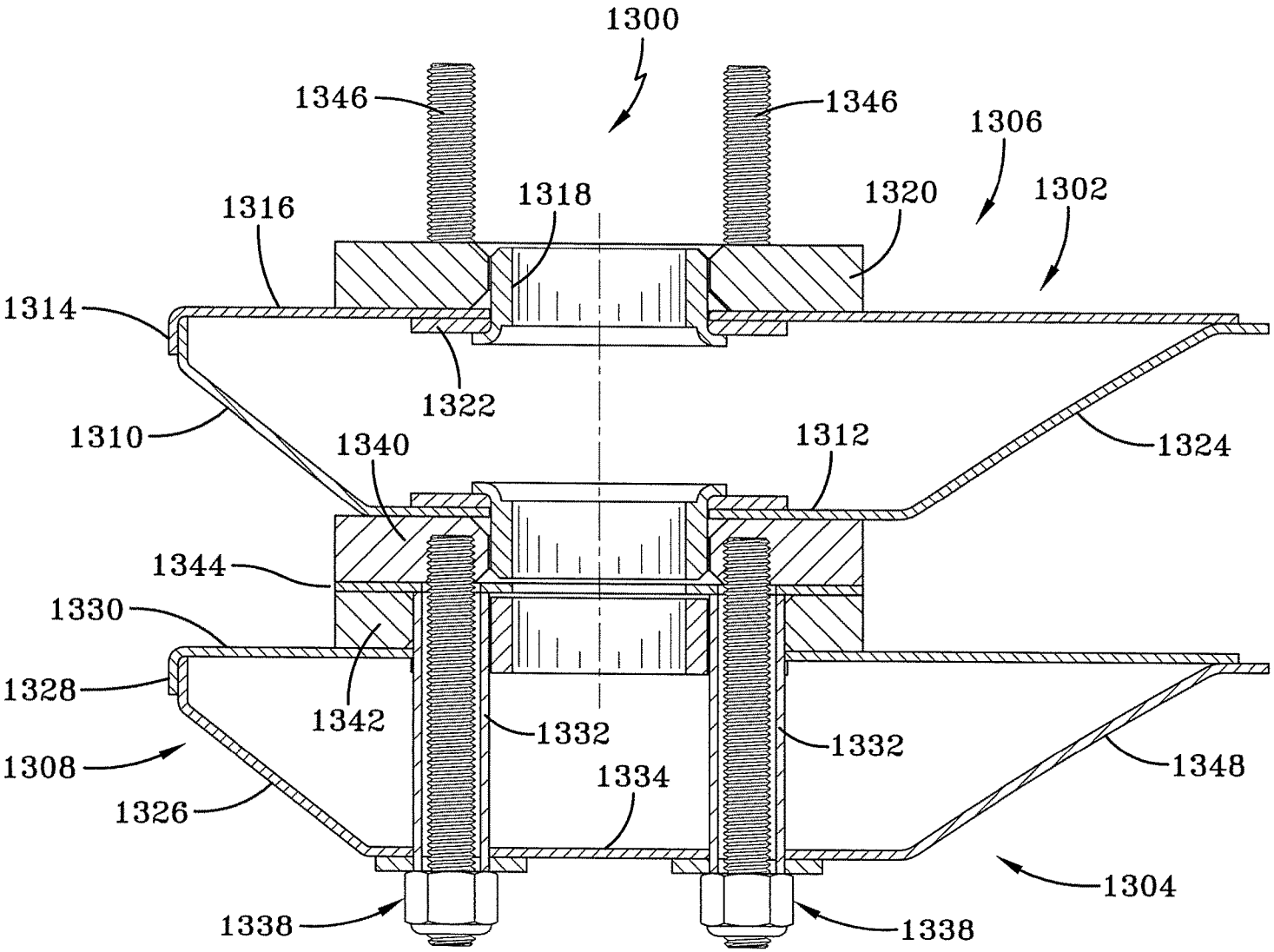
FIGS. 28 and 29 are side cross-sectional views of double-stacked keel coolers where the upper and lower keel coolers are made for modular assembly, and the orientation of the lower keel coolers are reversed in the respective figures.

Referring next to FIG. 28, a cross-section of a double-stacked keel cooler 1300 is shown. A portion of an upper keel cooler 1302 and lower keel cooler 1304 is depicted, with particular emphasis on an upper, forward header 1306 and a lower forward header 1308. FIG. 28 shows essentially keel coolers in FIG. 27 turned by 180°. Upper, forward header 1306 has an upper, forward, basically beveled wall 1310 which is beveled upwardly from an upper base wall 1312. An upper, small, forward wall 1314 forms a juncture with an upper, forward, top header wall 1316. A connector 1318 extends upwardly through an opening in top header wall 1316 for providing a path for coolant to or from upper, forward header 1306 and lower, forward header 1308. Connector 1318 extends through an upper flange 1320. An upper spacer plate 1322 is positioned against the underside of upper, forward, top header wall 1316 and is held in place by an outward bend in connector 1318.

An upper, inclined wall 1324 is disposed rearwardly of upper, forward, basically beveled wall 1310 through which coolant flow tubes have access for transporting coolant to or from upper, forward header 1306.

Lower, forward header 1308 has a lower, forward, basically beveled wall 1326 which merges into a lower, small, forward wall 1328. A lower top wall 1330 extends across the top of lower, forward header 1308. Lower, forward header further has an inclined wall 1348. A pair of stiffeners 1332 in the form of cylindrical tubes extend through a lower base wall 1334, and run parallel to and outside from a lower connector 1336. Fastener assemblies 1338 extend upwardly through stiffeners 1332 to connect upper keel cooler 1302 and lower keel cooler 1304 together.

A pair of spacers, namely upward, forward spacer 1340 and lower, forward spacer 1342, which have between them a gasket 1344, are provided. Fastener assemblies shown as studs 1346 extend from upper flange 1320 are screwed into the hull of a marine vessel.

Upper, forward, basically beveled wall 1310 and lower, forward, basically beveled wall 1308 face in the same direction and not towards each other, wherefore they cannot create a stagnation point. However, the embodiment of the invention shown in FIG. 28 can also be attached sequentially to the hull of a marine vessel. Studs 1346 would first be used to attach upper, forward header 1302 to a marine vessel. Thereafter, fastener assemblies 1338 attach lower keel cooler 1304 to the underside of upper keel cooler 1307. This modular construction facilitates the installation of a double-stacked (or a multiple-stacked) keel cooler since roughly half of the weight of the entire unit is assembled initially, followed by the assembly of the latter part of the unit.

Figure 29:
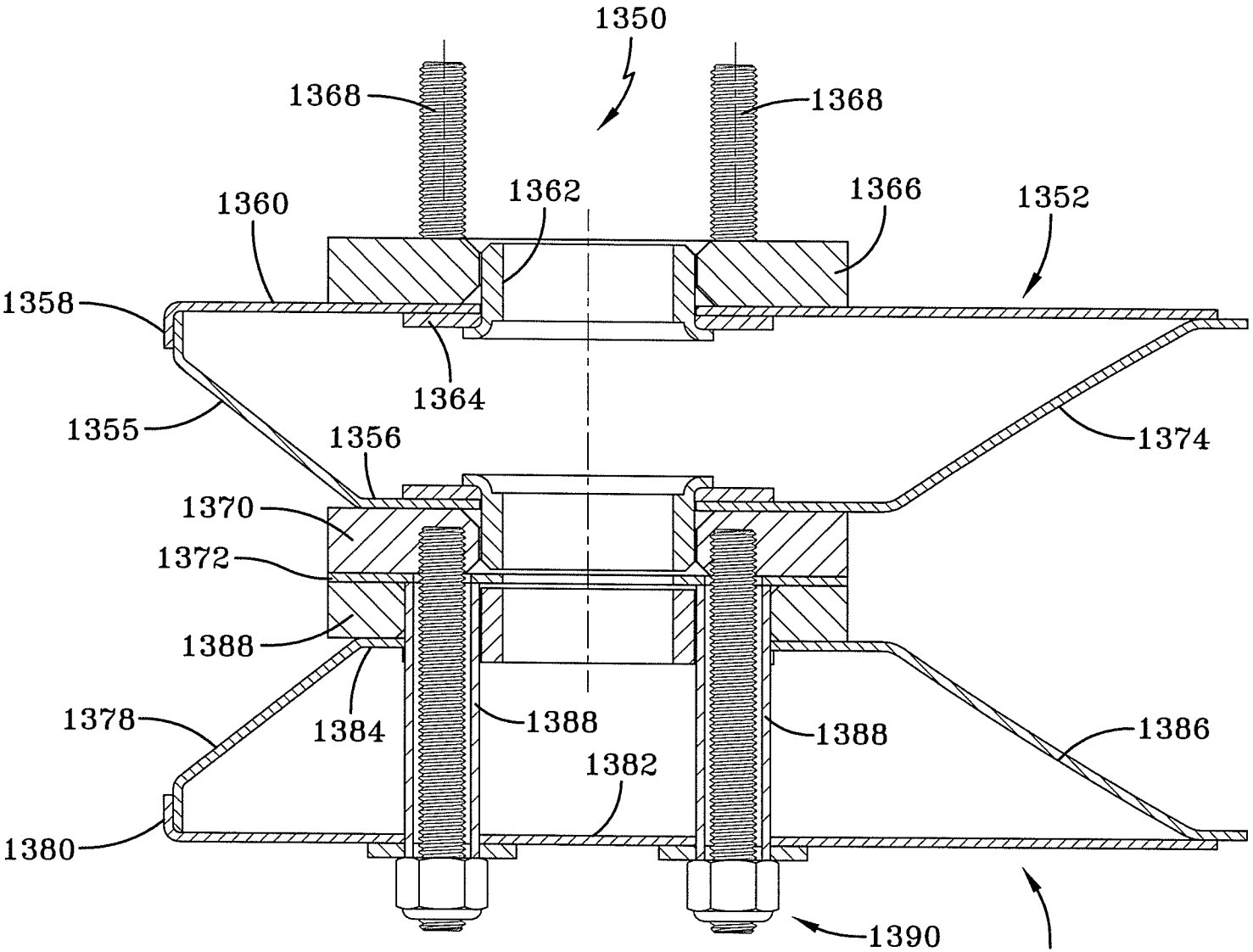

A cross section of a header for a double-stacked keel cooler 1350 is shown in FIG. 29. Double-stacked keel cooler 1350 includes an upper keel cooler 1352 and a lower keel cooler 1354. Upper keel cooler 1352 has an upper, basically beveled wall 1355, beveled commencing at an upper base wall 1356. An upper, small, forward wall 1358 is located at the upper end of beveled wall 1354 which meets an upper, top header wall 1360. A connector 1362 has flanged lower ends around an upper spacer plate 1364. A copper-nickel flange 1366 contributes to holding connector 1362 in place. Upwardly extending studs 1368 are provided for being attached to a flange extending from the hull of a marine vessel. An upper, inclined wall 1374 is provided having ports for providing access of the inner coolant flow tubes as discussed earlier, the inner walls of the outer coolant flow tubes having orifices for the flow of coolant between the latter tubes and the chamber of upper header 1352.

Lower header 1354 has a lower, basically beveled wall 1378 which is convergent with upper, basically beveled wall 1355. A lower, small forward wall 1380 is located between wall 1378 and a lower, base wall 1382. A lower, top wall 1384 extends between lower, basically beveled wall 1378 and a lower, inclined wall 1386. Stiffeners tubes 1388 extend from lower, base wall 1382 into a lower spacer 1388 and into an upper spacer 1370. A rubber gasket 1372 is provided between an upper spacer 1370 and lower spacer 1388. Fastener assemblies 1390 extend through stiffener tubes 1388 and are attached to threaded bores in upper spacer 1370.

Keel cooler 1350 is of modular construction, and can be installed with relative ease on a marine vessel. Initially, studs 1368 can be installed to a flange attached to the hull of a marine vessel, to attach upper header 1352 to the hull. Thereafter, fastener assemblies 1390 attach lower keel cooler 1354 to upper keel cooler 1352 and to the hull of the marine vessel.

The foregoing procedure can be used to assemble multiple-stacked keel coolers with relative ease. Different sizes of keel coolers, keel coolers of different models, and even keel coolers coming from different manufacturers could be assembled in this multiple-stacked fashion by module assembly.

The invention has been described in detail above, with particular emphasis on the preferred embodiments, but variations and modifications may occur to those skilled in the art to which the invention pertains.

What is claimed is:

1. A multiple-stacked marine heat exchanger for being attached to a hull of a marine vessel for cooling at least one heat source in the marine vessel as the marine vessel travels through ambient water, said multiple-stacked marine heat exchanger including an ambient water passageway, said multiple-stacked marine heat exchanger comprising:

an upper marine heat exchanger having a forward end, a rearward end, an upper side and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to a second position rearward of said first position to define an upper part of an entrance of the ambient water passageway, the ambient water passageway having the entrance disposed rearwardly from said first position; and a set of upper coolant flow tubes extending rearwardly from said upper, forward header of said upper marine heat exchanger, said set of upper coolant flow tubes having lower surfaces collectively defining an upper part of the ambient water passageway;

a lower marine heat exchanger having a forward end, a rearward end, an upper side and a lower side, said lower heat exchanger being located in a mirror relationship with said upper, forward header, said lower marine heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position rearward of said third position, the ambient water passageway having the entrance disposed rearwardly from said third position to define a lower part of the entrance of the ambient water passageway; and a set of lower coolant flow tubes extending rearwardly from said lower, forward header of said lower marine heat exchanger, said set of lower coolant flow tubes having upper surfaces collectively defining a lower part of the ambient water passageway;

said upper, forward, beveled wall and said lower, forward, beveled wall cooperating to form a stagnant pressure region forward of said entrance to the ambient water passageway as the marine vessel with said multiple-stacked marine heat exchanger moves forwardly through a body of ambient water to create an increase in a pressure of the ambient water between the stagnant pressure region and said entrance to the ambient water passageway, the increase in the pressure of the ambient water increasing a velocity of the ambient water to create jets of turbulent ambient water flowing through said entrance and along the ambient water passageway between said upper and lower marine heat exchangers.

2. A multiple-stacked marine heat exchanger according to claim 1 wherein:

said set of upper coolant flow tubes includes a pair of spaced-apart upper, outer coolant flow tubes and upper, inner coolant flow tubes located between said respective pair of spaced-apart upper, outer flow tubes, wherein said upper, inner flow tubes have rectangular cross sections with opposing long side walls, and top and bottom opposing short end walls connecting the respective top and bottom ends of said respective opposing long side walls, said respective pair of spaced-apart upper, outer coolant flow tubes have inner wall portions facing said upper header with at least one orifice into said upper header for transferring coolant between said upper header and said respective outer coolant flow tubes; and said set of lower coolant flow tubes includes a pair of spaced-apart lower, outer coolant flow tubes and lower, inner coolant flow tubes located between said respective pair of spaced-apart lower, outer flow tubes, wherein said lower, inner flow tubes have rectangular cross sections with opposing long side walls, and top and bottom opposing short end walls connecting the respective top and bottom ends of said respective opposing long side walls, said respective pair of spaced-apart lower, outer flow tubes have inner wall portions facing said lower respective header with at least one orifice into said lower header for transferring coolant between said lower header and said respective outer coolant flow tubes.

3. A marine heat exchanger according to claim 2 wherein said short end walls connecting the respective bottom ends of the respective long side walls of said upper coolant flow tubes lie in a common plane defining the upper part of the ambient water passageway; and wherein said short end walls of said respective top ends of said respective opposing long side walls of said lower coolant flow tubes lie in a common plane defining the lower part of the ambient water passageway, and said respective bottom ends of said respective opposing long side walls define lower exterior walls of said lower coolant flow tubes.

4. A marine heat exchanger according to claim 3 wherein said upper part of the ambient water passageway and the lower part of the ambient water passageway are in an opposing, parallel relationship.

5. A multiple-stacked marine heat exchanger according to claim 2 and further including connecting members for connecting said upper marine heat exchanger to said lower heat exchanger together to maintain a position and size of the ambient water passageway in said multiple-stacked marine heat exchanger.

6. A multiple-stacked marine heat exchanger according to claim 5 wherein said connecting members are brackets for connecting said upper marine heat exchanger and said lower marine heat exchanger together, and wherein said brackets are operatively connectable to the hull of the marine vessel.

7. A multiple-stacked marine heat exchanger according to claim 1 wherein said upper, forward header and said lower, forward header are identical in size and shape.

8. A multiple-stacked marine heat exchanger according to claim 1 wherein said set of upper coolant flow tubes and said set of lower coolant low tubes are identical in size and in number.

9. A multiple-stacked marine heat exchanger according to claim 1 and further including connecting members for connecting said upper marine heat exchanger and said lower marine heat exchanger together to define and maintain said ambient water passageway.

10. A multiple-stacked marine heat exchanger according to claim 9 wherein said connecting members are brackets for connecting said upper marine heat exchanger and said lower marine heat exchanger together, and wherein said brackets are operatively connectable to the hull of the marine vessel.

11. A multiple-stacked marine heat exchanger according to claim 10 wherein said connecting members are fastener assemblies extending at least partly through said lower marine heat exchanger and said upper marine heat exchanger for connection to the hull of the marine vessel.

12. A multiple-stacked marine heat exchanger according to claim 1 wherein:

said upper marine heat exchanger further includes:

a rearward upper header at the rearward end of said upper marine heat exchanger; and wherein said set of upper coolant flow tubes are operatively connected to said forward upper header and to said rearward upper header; and said lower marine heat exchanger further includes:

a rearward lower header at the rearward end of said lower marine heat exchanger; and wherein said set of lower coolant flow tubes are operatively connected to said forward lower header and to said rearward lower header.

13. A multiple-stacked marine heat exchanger according to claim 12 wherein said upper part of the ambient water passageway and said lower part of the ambient water passageway are separated by a uniform distance to form part of the ambient water passageway between said upper and lower heat exchangers.

14. A multiple-stacked marine heat exchanger according to claim 13 wherein said uniform distance is in the range of 0.25 inch and 3.00 inches.

15. A multiple-stacked marine heat exchanger according to claim 13 wherein said upper part of the ambient water passageway is flat and lies in a common upper imaginary plane and said lower part of ambient water passageway is flat and lies in a common lower imaginary plane, and said upper imaginary plane and said lower imaginary plane are parallel.

16. A multiple-stacked marine heat exchanger according to claim 1 wherein said upper, forward beveled wall of said upper marine heat exchanger and said lower, forward beveled wall of said lower marine heat exchanger are flat and respectively beveled by equal angular amounts.

17. A multiple-stacked marine heat exchanger according to claim 1 wherein said upper, forward beveled wall of said upper marine heat exchanger and said lower, forward beveled wall of said lower marine heat exchanger are respectively concave to form a stagnant pressure region located forward relative to the stagnant pressure region occurring when said upper, forward beveled wall of said upper marine heat exchanger and said forward, lower beveled wall of said lower marine heat exchanger are respectively flat.

18. A multiple-stacked marine heat exchanger according to claim 1 wherein said upper, forward beveled wall of said upper marine heat exchanger and said lower, forward beveled wall of said lower marine heat exchanger are respectively convex to form a stagnant pressure region located rearward relative to the stagnant pressure region when said upper, forward beveled wall of said upper marine heat exchanger and said lower, forward beveled wall of said lower marine heat exchanger are respectively flat.

19. A multiple-stacked marine heat exchanger for being attached to a hull of a marine vessel for cooling at least one heat source in the marine vessel as ambient water flows relative to said multiple-stacked heat exchanger, said multiple-stacked marine heat exchanger including an ambient water passageway extending through said marine heat exchanger, said multiple-stacked marine heat exchanger comprising:

an upper marine heat exchanger having a forward end, a rearward end, an upper side, and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to a second position rearward of said first position to define an upper part of an entrance of the ambient water passageway, said entrance being disposed rearwardly from said first position; and a set of upper coolant flow tubes extending rearwardly from said upper, forward header, each coolant flow tube of said set of upper coolant flow tubes having a rectangular cross section with opposing long side walls, and upper and lower opposing short end walls connecting the respective ends of said opposing long side walls, said lower, opposing, short end walls collectively defining an upper part of the ambient water passageway;

a lower marine heat exchanger having a forward end, a rearward end, an upper side and a lower side, said lower heat exchanger being located in a mirror relationship to said upper, forward header, said lower marine heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position to define the lower part of an entrance of the ambient water passageway, said upper, forward, beveled wall and said lower, forward beveled wall having a converging relationship;

a set of lower coolant flow tubes extending rearwardly from said lower, forward header of said lower marine heat exchanger, each coolant flow tube of said set of lower coolant flow tubes having a rectangular cross section with opposing long side walls and upper and lower short end walls connecting the respective ends of said opposing long side walls, said lower, short walls collectively defining a lower, external part of said lower coolant flow tubes;

wherein a stagnant ambient water region occurs at said lower, external part of said lower coolant flow tubes, the stagnant region having a stagnant ambient water region depth from said lower external part and a free stream of ambient water flows outside of the stagnant ambient water region; and at least one beyond stagnant water depth diverter extending below said lower, external part of said lower, coolant flow tubes and exceeding the stagnant ambient water region to divert the ambient water from the free stream to flow across said lower coolant flow tubes to effect heat transfer from said lower coolant flow tubes to the diverted ambient water.

20. A multiple-stacked marine heat exchanger according to claim 19 wherein said upper part of the ambient water passageway and said lower part of the ambient water passageway are separated by a uniform distance to form said ambient water passageway between said upper and lower heat exchangers, and said multiple-stacked marine heat exchanger further comprises at least one ambient water passageway diverter in said ambient water passageway for diverting ambient water from said ambient water passageway across at least some of said coolant flow tubes.

21. A multiple-stacked marine heat exchanger for being attached to a hull of a marine vessel for cooling at least one heat source during flow of ambient water past said multiple-stacked marine heat exchanger, said multiple-stacked marine heat exchanger including an ambient water passageway, said multiple-stacked marine heat exchanger comprising:

an upper marine heat exchanger having a forward end, a rearward end, an upper side, and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to a second position rearward of said first position to define an upper part of an entrance of the ambient water passageway, the ambient water passageway having the entrance disposed rearwardly from said first position; and a set of upper coolant flow tubes extending rearwardly from said upper, forward header of said upper marine heat exchanger, said set of upper coolant flow tubes having lower surfaces collectively defining an upper part of the ambient water passageway;

a lower marine heat exchanger having a forward end, a rearward end, an upper side and a lower side, said lower heat exchanger being located in a mirror relationship with said upper, heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position rearward of said third position to define a lower part of the entrance of the ambient water passageway; and a set of lower coolant flow tubes extending rearwardly from said lower, forward header of said lower marine heat exchanger collectively defining a lower part of the ambient water passageway; and at least one spacer interposed between said upper, marine heat exchanger and lower marine heat exchanger, said at least one spacer enhancing the turbulence of the ambient water flowing through said multiple-stacked marine heat exchanger.

22. A multiple-stacked marine heat exchanger according to claim 21 wherein said at least one spacer is a pair of spacers at the forward end of said upper and lower marine heat exchangers.

23. A multiple-stacked marine heat exchanger according to claim 22 wherein said at least one spacer is a pair of spacers at the rearward end of said upper and lower marine heat exchangers.

24. A multiple-stacked marine heat exchanger according to claim 21 wherein said at least one spacer effects the creation of Von Kármán vortices as ambient water flows past said at least one spacer to create turbulence in the ambient water as the ambient water flows through and between said upper and lower marine heat exchangers.

25. A multiple-stacked marine heat exchanger according to claim 21 wherein said at least one spacer has a cross section taken from at least one of the groups of shapes consisting of circles, ovals, squares, triangles or a combination thereof.

26. A multiple-stacked marine heat exchanger according to claim 21 wherein said at least one spacer is disposed between said upper, forward header and said lower, forward header.

27. A multiple-stacked marine heat exchanger for being attached to a hull of a marine vessel for cooling at least one heat source in the marine vessel as the marine vessel travels through ambient water, said multiple-stacked marine heat exchanger including an ambient water passageway, said multiple-stacked marine heat exchanger comprising:

an upper marine heat exchanger having a forward end, a rearward end, an upper side, and a lower side, said upper marine heat exchanger comprising:

an upper, forward header at the forward end of said upper marine heat exchanger, said upper, forward header including an upper, forward wall to define an upper part of an entrance of the ambient water passageway; and a set of upper coolant flow tubes extending rearwardly from said upper, forward header of said upper marine heat exchanger;

a lower marine heat exchanger having a forward end, a rearward end, an upper side, and a lower side, said lower heat exchanger being located in a mirror relationship with said upper, marine heat exchanger, said lower marine heat exchanger comprising:

a lower, forward header at the forward end of said lower marine heat exchanger, said lower, forward header including a lower, forward wall to define a lower part of the entrance of the ambient water passageway; and a set of lower coolant flow tubes extending rearwardly from said lower, forward header of said lower marine heat exchanger; and at least one spacer interposed between said upper, marine heat exchanger and lower marine heat exchanger, said at least one spacer enhancing the turbulence of the ambient water flowing through said multiple-stacked marine heat exchanger.

28. A multiple-stacked marine heat exchanger according to claim 27 wherein said at least one spacer is a pair of spacers at the forward end of said upper and lower marine heat exchangers.

29. A multiple-stacked marine heat exchanger according to claim 28 wherein said at least one spacer is a pair of spacers at the rearward end of said upper and lower marine heat exchangers.

30. A multiple-stacked marine heat exchanger according to claim 27 wherein said at least one spacer effects the creation of Von Kármán vortices as ambient water flows past said at least one spacer to create turbulence in the ambient water as the ambient water flows through and between said upper and lower marine heat exchangers.

31. A multiple-stacked marine heat exchanger according to claim 27 wherein said at least one spacer has a cross section taken from at least one of the groups of shapes consisting of circles, ovals, squares, triangles or a combination thereof.

32. A multiple-stacked marine heat exchanger according to claim 27 wherein said at least one spacer is disposed between said upper, forward header and said rearward, forward header.

33. A marine heat exchanger for being attached to a hull of a marine vessel for cooling at least one heat source in the marine vessel as the marine vessel travels through ambient water, said marine heat exchanger having a forward end, a rearward end, and upper side, a lower side, said marine heat exchanger comprising:

a header for receiving coolant, said header having external header surfaces engaging ambient water and from which external header surfaces a stagnant ambient water region is created having a stagnant ambient water depth from said external header surfaces as the marine water vessel travels through the ambient water with a free stream of ambient water existing beyond the stagnant ambient water depth;

a set of upper coolant flow tubes extending from said header of said marine heat exchanger for carrying coolant to and/or from said header, said coolant flow tubes having external coolant tube surfaces engaging ambient water and from which external coolant tube surfaces a stagnant ambient water region is created having a stagnant ambient water region depth from said external coolant tube surfaces as the marine vessel travels through the ambient water, with a free stream of ambient water existing beyond the stagnant ambient water region;

at least one diverter at a depth from said external coolant tube surfaces exceeding the stagnant ambient water depth from said external coolant tube surfaces to divert free stream ambient water to flow across said coolant flow tubes to enhance heat transfer from said coolant flow tubes to the ambient water.

34. A marine heat exchanger according to claim 33 and further including at least one diverter plate, said at least one diverter plate being attached to said set of coolant flow tubes, said at least one diverter plate including said at least one diverter, said at least one diverter being disposed at a depth from said external coolant tube surfaces exceeding the stagnant ambient water depth from said external coolant tube surfaces.

35. A multiple-stacked marine heat exchanger for being attached to a hull of a marine vessel for cooling at least one heat source in the marine vessel as the marine vessel travels through ambient water, said multiple-stacked marine heat exchanger including an ambient water passageway, said multiple-stacked marine heat exchanger comprising:

an upper marine heat exchanger having a forward end, a rearward end, an upper side and a lower side, said upper marine heat exchanger comprising:

an upper, forward header at the forward end of said upper marine heat exchanger, said upper, forward header having surfaces defining an upper part of an entrance of the ambient water passageway; and a set of upper coolant flow tubes extending rearwardly from said upper, forward header of said upper marine heat exchanger, said set of upper coolant flow tubes including lower external surfaces collectively defining an upper part of the ambient water passageway, ambient water contacting said lower external surfaces of said set of upper coolant flow tubes and creating a stagnant ambient water region having a stagnant ambient water depth from said lower external surfaces of said set of upper coolant flow tubes as the marine vessel travels through the ambient water, a free stream of ambient water existing beyond the stagnant ambient water region; and a lower marine heat exchanger having a forward end, a rearward end, an upper side and a lower side, said lower heat exchanger being located in a mirror relationship with said upper, forward header and comprising:

a lower, forward header at the forward end of said lower marine heat exchanger, said lower, forward header having upper surfaces defining a lower part of the entrance of the ambient water passageway; and a set of lower coolant flow tubes extending rearwardly from said lower, forward header of said lower marine heat exchanger, said set of lower coolant flow tubes including both upper external surfaces collectively defining a lower part of the ambient water passageway and lower external surfaces collectively defining a lower external surface of said lower coolant flow tubes, wherein ambient water contacts said lower external surfaces of said lower coolant flow tubes creating a stagnant ambient water region having a stagnant ambient water depth from said lower coolant flow tubes as the marine vessel travels through the ambient water with a free stream of ambient water existing beyond the stagnant ambient water region; and at least one lower beyond-stagnant-water depth diverter located beyond the stagnant ambient water depth in the freestream to divert water from the free stream into said set of lower coolant flow tubes.

36. A multiple-stacked marine heat exchanger for being attached to a hull of a marine vessel for cooling at least one heat source in the marine vessel as the marine vessel travels through ambient water, said multiple-stacked marine heat exchanger including an ambient water passageway, said multiple-stacked marine heat exchanger comprising:

an upper marine heat exchanger having a forward end, a rearward end, an upper side and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to a second position rearward from said first position to define an upper part of an entrance of the ambient water passageway, the ambient water passageway having an entrance disposed rearwardly from said first position; and a set of upper coolant flow tubes extending rearwardly from said upper, forward header of said upper marine heat exchanger collectively defining an upper part of the ambient water passageway;

a lower marine heat exchanger having a forward end, a rearward end, an upper side and a lower side, said lower heat exchanger being located in a mirror relationship with said upper, forward header, said lower heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position rearwardly of said third position to define a lower part of the entrance of the ambient water passageway; and a set of lower coolant flow tubes extending rearwardly from said lower, forward header of said lower marine heat exchanger collectively defining a lower part of the ambient water passageway;

a vessel-to-upper marine heat exchanger connecting structure for initially connecting said upper marine heat exchanger to the marine vessel; and a lower marine heat exchanger-upper marine heat exchanger connecting structure for connecting said lower marine heat exchanger to said upper marine heat exchanger after said upper marine heat exchanger has been connected to said marine vessel by said vessel-to-upper marine heat exchanger connecting structure.

37. A multiple-stacked marine heat exchanger assembly according to claim 36 wherein said vessel-to-upper marine heat exchanger connecting structure is a first set of fastener assemblies for extending from said upper marine heat exchanger for connecting said upper marine heat exchanger to the marine vessel, and said lower marine heat exchanger-to-upper marine heat exchanger connector has a second set of fastener assemblies connecting said lower marine heat exchanger to said upper marine heat exchanger after said upper marine heat exchanger being connected to the marine vessel, to sequentially assemble said multiple-stacked marine heat exchanger to the marine vessel to facilitate such assembly over the assembly without the sequential assembly procedure.

38. A multiple-stacked marine heat exchanger according to claim 36 wherein said vessel-to-upper marine heat exchanger connector is at least one upper fastener extending through at least part of said upper marine heat exchanger and into the marine vessel.

39. A multiple-stacked marine heat exchanger according to claim 38 wherein said lower marine heat exchanger-to-upper marine heat exchanger is at least one lower fastener for extending from said lower marine heat exchanger and into said upper marine heat exchanger.

40. A multiple-stacked marine heat exchanger assembly having an ambient water passageway and comprising:

an upper marine heat exchanger having a forward end, a rearward end, an upper side and a lower side, said upper marine heat exchanger comprising:

an upper, forward header at the forward end of said upper marine heat exchanger, said forward upper header including an upper, forward, beveled wall beveled rearwardly from a first position proximal the upper side of said upper marine heat exchanger to a second position rearward of said first position to define an upper part of an entrance of the ambient water passageway, the ambient water passageway having the entrance disposed rearwardly from said first position; and a set of upper coolant flow tubes extending rearwardly from said forward, upper header of said upper marine heat exchanger;

a lower marine heat exchanger having a forward end, a rearward end, an upper side and a lower side, the upper side of said lower marine heat exchanger being attachable to the lower side of said upper marine heat exchanger, said lower marine heat exchanger being separate from said upper marine heat exchanger prior to assembly of said upper marine heat exchanger to a marine vessel, said lower heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position rearwardly of said third position to define a lower part of the entrance of the ambient water passageway; and a set of lower coolant flow tubes extending rearwardly from said forward header of said lower marine heat exchanger;

said forward beveled wall of said upper marine heat exchanger at said upper entrance position and said forward beveled wall of said lower marine heat exchanger at said lower entrance position cooperating to form the entrance to the ambient water passageway between said upper and lower marine heat exchangers upon the assembly of said upper marine heat exchanger and said lower marine heat exchanger;

a vessel-to-upper marine heat exchanger connecting structure for initially connecting said upper marine heat exchanger to the marine vessel; and a lower marine heat exchanger connecting structure for connecting said lower marine heat exchanger to said upper marine heat exchanger heat exchanger subsequent to said upper marine heat exchanger being connected to the marine vessel.

41. A multiple-stacked marine heat exchanger for being attached to a hull of a marine vessel for cooling at least two heat sources in the marine vessel as the marine vessel travels through ambient water, said multiple-stacked marine heat exchanger including an ambient water passageway, said multiple-stacked marine heat exchanger comprising:

an upper marine heat exchanger in operative relationship with one of said at least two heat sources for cooling the one of at least two heat sources, said upper marine heat exchanger having a forward end, a rearward end, an upper side and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to define an upper part of an entrance of the ambient water passageway, the ambient water passageway having the entrance disposed rearwardly from said first position; and a set of upper coolant flow tubes extending rearwardly from said upper, forward header of said upper marine heat exchanger collectively defining an upper part of the ambient water passageway;

a lower marine heat exchanger in operative relationship with a second of the at least two heat sources, said lower marine heat exchanger having a forward end, a rearward end, an upper side and a lower side, said lower heat exchanger being located in a mirror relationship with said upper, forward header, said lower marine heat exchanger comprising:

a lower, forward header at the forward end of said lower marine heat exchanger, said lower, forward header including a lower, forward, beveled wall beveled rearwardly from a second position proximal the lower side of said lower marine heat exchanger to define a lower part of the entrance of the ambient water passageway; and a set of lower coolant flow tubes extending rearwardly from said lower, forward header of said lower marine heat exchanger, said set of lower coolant flow tubes collectively defining both a lower part of the ambient water passageway and lower external surfaces of said set of lower coolant flow tubes, wherein ambient water contacts said lower external surfaces and creates a stagnant ambient water region having a stagnant ambient water depth wherein a free stream of ambient water flows outside the stagnant ambient water region; and at least one diverter located beyond the stagnant ambient water depth and in the free stream for diverting water from the free stream into and across said set of lower coolant flow tubes.

42. A multiple-stacked marine heat exchanger for being attached to a hull of a marine vessel for cooling at least two heat sources in the marine vessel as the marine vessel travels through ambient water, said multiple-stacked marine heat exchanger including an ambient water passageway, said multiple-stacked marine heat exchanger comprising:

an upper marine heat exchanger in operative relationship with one of said at least two heat sources for cooling one of the at least two heat sources, said upper heat exchanger having a forward end, a rearward end, an upper side and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to define an upper part of an entrance of the ambient water passageway, the ambient water passageway having the entrance disposed rearwardly from said first position; and a set of upper coolant flow tubes extending rearwardly from said upper, forward header of said upper marine heat exchanger collectively defining an upper part of the ambient water passageway;

a lower marine heat exchanger in operative relationship with a second of the at least two heat sources, said lower marine heat exchanger having a forward end, a rearward end, an upper side and a lower side, said lower heat exchanger being located in a mirror relation with said upper, forward header, said lower marine heat exchanger comprising:

a lower, forward header at the forward end of said lower marine heat exchanger, said lower, forward header including a lower, forward, beveled wall beveled rearwardly from a second position proximal the lower side of said lower marine heat exchanger to define the lower part of the entrance of the ambient water passageway; and a set of lower coolant flow tubes extending rearwardly from said lower, forward header of said lower marine heat exchanger collectively defining a lower part of the ambient water passageway;

said upper, forward, beveled wall and said lower, forward, beveled wall cooperating to form a stagnant pressure region forward of said entrance to the ambient water passageway as said multiple-stacked marine heat exchanger moves forwardly through ambient water to create an increase in a pressure of the ambient water, the increase in the pressure of the ambient water increasing a velocity of ambient water flowing through said entrance and along the ambient water passageway between said upper and lower marine heat exchangers.

43. A multiple-stacked marine heat exchanger for being attached to a hull of a marine vessel for cooling at least two heat sources in the marine vessel as the marine vessel travels through ambient water wherein one of the at least two heat sources emits a higher amount of heat than another heat source of the at least two heat sources, said multiple-stacked marine heat exchanger including an ambient water passageway, said multiple-stacked marine heat exchanger comprising:

an upper marine heat exchanger in operative relationship with the one of the at least two heat sources emitting a higher amount of heat, said upper marine heat exchanger being of a cooling capacity commensurate with the one of the at least two heat sources, said upper marine heat exchanger having a forward end, a rearward end, an upper side and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to define an upper part of an entrance of the ambient water passageway, the ambient water passageway having the entrance disposed rearwardly from said first position; and a set of upper coolant flow tubes extending rearwardly from said upper, forward header of said upper marine heat exchanger, said set of upper coolant flow tubes collectively defining an upper part of the ambient water passageway;

a lower marine heat exchanger in operative relationship with said other of the at least two heat sources emitting a lesser amount of heat than the one of the two heat sources, said lower marine heat exchanger being of relatively lesser cooling capacity than said upper marine heat exchanger commensurate with the second of the two heat sources, said lower marine heat exchanger having a forward end, a rearward end, an upper side and a lower side, said lower heat exchanger being located in a mirror relationship with said upper, forward header, said lower marine heat exchanger comprising:

a lower, forward header at the forward end of said lower marine heat exchanger, said lower, forward header including a lower, forward, beveled wall beveled rearwardly from a second position proximal the lower side of said lower marine heat exchanger to define a lower part of the entrance of the ambient water passageway; and a set of lower coolant flow tubes extending rearwardly from said lower, forward header of said lower marine heat exchanger collectively defining a lower part of the ambient water passageway.

44. A multiple-stacked marine heat exchanger for being attached to a hull of a marine vessel for cooling at least one heat source in the marine vessel as ambient water flows relative to said multiple-stacked heat exchanger, said multiple-stacked marine heat exchanger including an ambient water passageway extending through said marine heat exchanger, said multiple-stacked marine heat exchanger comprising:

an upper marine heat exchanger having a forward end, a rearward end, an upper side and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to a second position to define an upper part of an entrance of the ambient water passageway, the entrance being disposed rearwardly from said first position; and a set of upper coolant flow tubes extending rearwardly from said upper, forward header, each coolant flow tube of said set of upper coolant flow tubes having a rectangular cross section with opposing long side walls, and upper and lower opposing short end walls connecting the ends of said long side walls, said lower, opposing, short end walls collectively defining an upper part of the ambient water passageway;

a lower marine heat exchanger having a forward end, a rearward end, an upper side and a lower side, said lower heat exchanger being located in a mirror relationship to said upper, forward header, said lower marine heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position to define a lower part of the entrance of the ambient water passageway, said upper, forward, beveled wall and said lower, forward beveled wall having a converging relationship;

a set of lower coolant flow tubes extending rearwardly from said lower, forward header of said lower marine heat exchanger, each coolant flow tube of said set of lower coolant flow tubes having a rectangular cross section with opposing long side walls and upper and lower short end walls connecting the respective ends of said opposing long side walls;

said lower, short walls collectively defining a lower, external part of said lower coolant flow tubes, wherein a stagnant ambient water region occurs at said lower, external part and a free stream of ambient water flows outside of the stagnant ambient water region; and at least one diverter extending below said lower, external part of said lower, coolant flow tubes and exceeding the stagnant ambient water region to divert the ambient water from the free stream of ambient water to flow across said lower coolant flow tubes to effect heat transfer from said lower coolant flow tubes to the diverted ambient water; and wherein said upper, forward, beveled wall and said lower, forward, beveled wall cooperate to form a stagnant pressure region forward of said entrance to the ambient water passageway as said multiple-stacked marine heat exchanger moves forwardly through a body of water to create an increase in a pressure of the ambient water, the increase in the pressure of the ambient water increasing a resultant velocity of the ambient water to create jets of ambient water flowing through said entrance and along the ambient water passageway between said upper and lower marine heat exchangers.

45. A multiple-stacked marine heat exchanger for being attached to a hull of a marine vessel for cooling at least one heat source in the marine vessel as the marine vessel travels through ambient water, said multiple-stacked marine heat exchanger including an ambient water passageway, said multiple-stacked marine heat exchanger comprising:

an upper marine heat exchanger having a forward end, a rearward end, an upper side and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to a second position rearward of said first position to define an upper part of an entrance of the ambient water passageway, the ambient water passageway having the entrance disposed rearwardly from said first position; and a set of upper coolant flow tubes extending rearwardly from said upper, forward header of said upper marine heat exchanger, said set of upper coolant flow tubes having lower surfaces collectively defining an upper part of the ambient water passageway;

a lower marine heat exchanger having a forward end, a rearward end, an upper side and a lower side, said lower heat exchanger being located in a mirror relationship with said upper, forward header, said lower marine heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position rearward of said third position, the ambient water passageway having the entrance disposed rearwardly from said second position to define a lower part of the entrance of the ambient water passageway; and a set of lower coolant flow tubes extending rearwardly from said lower, forward header of said lower marine heat exchanger collectively, said set of lower coolant flow tubes having upper surfaces defining a lower part of the ambient water passageway;

said upper, forward, beveled wall and said lower, forward, beveled wall cooperating to form a stagnant pressure region forward of said entrance to the ambient water passageway as the marine vessel with said multiple-stacked marine heat exchanger moves forwardly through a body of water to create an increase in a pressure of the ambient water between the stagnant pressure region and said entrance to the ambient water passageway, the increase in the pressure of the ambient water increasing a resultant velocity of the ambient water to create jets of turbulent ambient water flowing through said entrance and along the ambient water passageway between said upper and lower marine heat exchangers; and wherein a stagnant ambient water region occurs at said lower, external part of said lower coolant flow tubes, the stagnant region having a stagnant ambient water region depth from said lower external part and a free stream of ambient water flows outside of the stagnant ambient water region; and at least one diverter extending below said lower, external part of said lower, coolant flow tubes and exceeding the stagnant ambient water region to divert the ambient water from the free stream to flow across said lower coolant flow tubes to effect heat transfer from said lower coolant flow tubes to the diverted ambient water.

46. A multiple-stacked marine heat exchanger according to claim 45 wherein:

said set of upper coolant flow tubes includes a set of inner coolant flow tubes located between a pair of upper, outer coolant flow tubes, wherein said upper, inner coolant flow tubes have rectangular cross sections with opposing long side walls, and top and bottom opposing short end walls connecting the respective top and bottom ends of said respective opposing long side walls, said respective pair of upper, outer coolant flow tubes each having inner wall portions facing said upper header with at least one orifice into said upper header for transferring coolant between said upper header and said respective outer coolant flow tubes; and said set of lower coolant flow tubes includes a set of inner coolant flow tubes located between a pair of lower, outer coolant flow tubes, wherein said lower, inner coolant flow tubes have rectangular cross sections with opposing long side walls, and top and bottom opposing short end walls connecting the respective top and bottom ends of said respective opposing long side walls, said respective pair of lower, outer coolant flow tubes each have inner wall portions facing said lower respective header with at least one orifice into said lower header for transferring coolant between said lower header and said respective outer coolant flow tubes.

47. A multiple-stacked marine heat exchanger for being attached to a hull of a marine vessel for cooling at least one heat source in the marine vessel as the marine vessel travels through ambient water, said multiple-stacked marine heat exchanger including an ambient water passageway, said multiple-stacked marine heat exchanger comprising:

an upper marine heat exchanger having a forward end, a rearward end, an upper side and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to a second position rearward of said first position to define an upper part of an entrance of the ambient water passageway, the ambient water passageway having the entrance disposed rearwardly from said first position; and a set of upper coolant flow tubes extending rearwardly from said upper, forward header of said upper marine heat exchanger, said set of upper coolant flow tubes having lower surfaces collectively defining an upper part of the ambient water passageway;

a lower marine heat exchanger having a forward end, a rearward end, an upper side and a lower side, said lower heat exchanger being located in a mirror relationship with said upper, forward header, said lower marine heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position rearward of said third position, the ambient water passageway having the entrance disposed rearwardly from said second position to define a lower part of the entrance of the ambient water passageway; and a set of lower coolant flow tubes extending rearwardly from said lower, forward header of said lower marine heat exchanger collectively, said set of lower coolant flow tubes having upper surfaces defining a lower part of the ambient water passageway;

said upper, forward, beveled wall and said lower, forward, beveled wall cooperating to form a stagnant pressure region forward of said entrance to the ambient water passageway as the marine vessel with said multiple-stacked marine heat exchanger moves forwardly through a body of water to create an increase in a pressure of the ambient water between the stagnant pressure region and said entrance to the ambient water passageway, the increase in the pressure of the ambient water increasing a resultant velocity of the ambient water to create jets of turbulent ambient water flowing through said entrance and along the ambient water passageway between said upper and lower marine heat exchangers; and at least one spacer interposed between said upper, marine heat exchanger and lower marine heat exchanger, said at least one spacer enhancing the turbulence of the ambient water flowing through said multiple-stacked marine heat exchanger.

48. A multiple-stacked marine heat exchanger according to claim 47 wherein:

said set of upper coolant flow tubes includes a pair of spaced-apart upper, outer coolant flow tubes and upper, inner coolant flow tubes located between said respective pair of spaced-apart upper, outer flow tubes, wherein said upper, inner flow tubes have rectangular cross sections with opposing long side walls, and top and bottom opposing short end walls connecting the respective top and bottom ends of said respective opposing long side walls, said respective pair of spaced-apart upper, outer coolant flow tubes have inner wall portions facing said upper header with at least one orifice into said upper header for transferring coolant between said upper header and said respective outer coolant flow tubes; and said set of lower coolant flow tubes includes a pair of spaced-apart lower, outer coolant flow tubes and lower, inner coolant flow tubes located between said respective pair of spaced-apart lower, outer flow tubes, wherein said lower, inner flow tubes have rectangular cross sections with opposing long side walls, and top and bottom opposing short end walls connecting the respective top and bottom ends of said respective opposing long side walls, said respective pair of spaced-apart lower, outer flow tubes have inner wall portions facing said lower respective header with at least one orifice into said lower header for transferring coolant between said lower header and said respective outer coolant flow tubes.

49. A multiple-stacked marine heat exchanger for being attached to a hull of a marine vessel for cooling at least one heat source in the marine vessel as the marine vessel travels through ambient water, said multiple-stacked marine heat exchanger including an ambient water passageway, said multiple-stacked marine heat exchanger comprising:

an upper marine heat exchanger having a forward end, a rearward end, an upper side, and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to a second position rearward of said first position to define an upper part of an entrance of the ambient water passageway, the entrance of the ambient water passageway being disposed rearwardly from said first position; and a set of upper coolant flow tubes extending rearwardly from said upper, forward header of said upper marine heat exchanger, said set of upper coolant flow tubes having lower surfaces collectively defining an upper part of the ambient water passageway;

a lower marine heat exchanger having a forward end, a rearward end, an upper side, and a lower side, said lower heat exchanger being located in a mirror relationship with said upper, forward header, said lower marine heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position rearward of said third position, the ambient water passageway having the entrance disposed rearwardly from said second position to define a lower part of the entrance of the ambient water passageway; and a set of lower coolant flow tubes extending rearwardly from said lower, forward header of said lower marine heat exchanger collectively defining a lower part of the ambient water passageway, said set of lower coolant flow tubes having upper surfaces defining a lower part of the ambient water passageway;

said upper, forward, beveled wall and said lower, forward, beveled wall cooperating to form a stagnant pressure region forward of said entrance to the ambient water passageway as the marine vessel with said multiple-stacked marine heat exchanger moves forwardly through a body of water to create an increase in a pressure of the ambient water between the stagnant pressure region and said entrance to the ambient water passageway, the increase in the pressure of the ambient water increasing a velocity of the ambient water to create jets of turbulent ambient water flowing through said entrance and along the ambient water passageway between said upper and lower marine heat exchangers; and a vessel-to-upper marine heat exchanger connecting structure for initially connecting said upper marine heat exchanger to the marine vessel; and a lower marine heat exchanger—upper marine heat exchanger connecting structure for connecting said lower marine heat exchanger to said upper marine heat exchanger after said upper marine heat exchanger has been connected to the marine vessel by said vessel-to-upper marine heat exchanger connecting structure.

50. A multiple-stacked marine heat exchanger according to claim 49 wherein:

said set of upper coolant flow tubes includes a pair of spaced-apart upper, outer coolant flow tubes and upper, inner coolant flow tubes located between said pair of spaced-apart upper, outer flow tubes, wherein said upper, inner flow tubes have rectangular cross sections with opposing long side walls, and top and bottom opposing short end walls connecting the respective top and bottom ends of said respective opposing long side walls, said respective pair of spaced-apart upper, outer coolant flow tubes have inner wall portions facing said upper header with at least one orifice into said upper header for transferring coolant between said upper header and said respective outer coolant flow tubes; and said set of lower coolant flow tubes includes a pair of spaced-apart lower, outer coolant flow tubes and lower, inner coolant flow tubes located between said respective pair of spaced-apart lower, outer flow tubes, wherein said lower, inner flow tubes have rectangular cross sections with opposing long side walls, and top and bottom opposing short end walls connecting the respective top and bottom ends of said respective opposing long side walls, said respective pair of spaced-apart lower, outer flow tubes have inner wall portions facing said lower respective header with at least one orifice into said lower header for transferring coolant between said lower header and said respective outer coolant flow tubes.

51. A multiple-stacked marine heat exchanger for being attached to a hull of a marine vessel for cooling two heat sources in the marine vessel as the marine vessel travels through ambient water wherein one of the two heat sources emits a higher amount of heat than a second of the two heat sources, said multiple-stacked marine heat exchanger including an ambient water passageway, said multiple-stacked marine heat exchanger comprising:

an upper marine heat exchanger in operative relationship with the one of the two heat sources emitting a higher amount of heat, said upper marine heat exchanger being of a cooling capacity commensurate with the one of the two heat sources, said upper marine heat exchanger having a forward end, a rearward end, an upper side, and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to define an upper part of an entrance of the ambient water passageway, the ambient water passageway having the entrance disposed rearwardly from said first position; and a set of upper coolant flow tubes extending rearwardly from said upper, forward header of said upper marine heat exchanger collectively defining an upper part of the ambient water passageway;

a lower marine heat exchanger in operative relationship with the second of the two heat sources emitting a lesser amount of heat than the one of the two heat sources, said lower marine heat exchanger being of lesser cooling capacity than said upper marine heat exchanger commensurate with the second of the two heat sources, said lower marine heat exchanger having a forward end, a rearward end, an upper side and a lower side, said lower heat exchanger being located in a mirror relationship with said upper, forward header, said lower marine heat exchanger comprising:

a lower, forward header at the forward end of said lower marine heat exchanger, said lower, forward header including a lower, forward, beveled wall beveled rearwardly from a second position proximal the lower side of said lower marine heat exchanger to define a lower part of the entrance of the ambient water passageway; and a set of lower coolant flow tubes extending rearwardly from said lower, forward header of said lower marine heat exchanger collectively defining a lower part of the ambient water passageway; and a vessel-to-upper marine heat exchanger connecting structure for initially connecting said upper marine heat exchanger to the marine vessel; and a lower marine heat exchanger connecting structure for connecting said lower marine heat exchanger to said upper marine heat exchanger heat exchanger subsequent to said upper marine heat exchanger being connected to the marine vessel.

52. A multiple-stacked marine heat exchanger for being attached to a hull of a marine vessel for cooling at least one heat source in the marine vessel as the marine vessel travels through ambient water, said multiple-stacked marine heat exchanger including an ambient water passageway, said multiple-stacked marine heat exchanger comprising:

an upper marine heat exchanger having a forward end, a rearward end, an upper side and a lower side, said upper marine heat exchanger comprising:

an upper, forward header at the forward end of said upper marine heat exchanger, said upper, forward header including an upper, forward beveled wall beveled rearwardly from a first position proximal the upper side of said upper marine heat exchanger to a second position rearward of said first position to define an upper part of an entrance of the ambient water passageway, the ambient water passageway having the entrance disposed rearwardly from said first position; and a set of upper coolant flow tubes extending rearwardly from said upper, forward header of said upper marine heat exchanger, said set of upper coolant flow tubes having lower surfaces collectively defining an upper part of the ambient water passageway;

a lower marine heat exchanger having a forward end, a rearward end, an upper side and a lower side, said lower heat exchanger being located in a mirror relationship with said upper, forward header, said lower marine heat exchanger comprising:

a lower, forward header at the forward end of said lower marine heat exchanger, said lower, forward header including a lower, forward, beveled wall beveled rearwardly from a third position proximal the lower side of said lower marine heat exchanger to a fourth position rearward of said third position, the ambient water passageway having the entrance disposed rearwardly from said second position to define a lower part of the entrance of the ambient water passageway; and a set of lower coolant flow tubes extending rearwardly from said lower, forward header of said lower marine heat exchanger collectively, said set of lower coolant flow tubes having upper surfaces defining a lower part of the ambient water passageway;

said upper, forward, beveled wall and said lower, forward, beveled wall cooperating to form a stagnant pressure region forward of said entrance to the ambient water passageway as the marine vessel with said multiple-stacked marine heat exchanger moves forwardly through a body of water to create an increase in a pressure of the ambient water between the stagnant pressure region and said entrance to the ambient water passageway, the increase in the pressure of the ambient water increasing a resultant velocity of the ambient water to create jets of turbulent ambient water flowing through said entrance and along the ambient water passageway between said upper and lower marine heat exchangers;

at least one spacer interposed between said upper, marine heat exchanger and lower marine heat exchanger, said at least one spacer enhancing the turbulence of the ambient water flowing through said multiple-stacked marine heat exchanger;

a vessel-to-upper marine heat exchanger connecting structure for initially connecting said upper marine heat exchanger to the marine vessel; and a lower marine heat exchanger—upper marine heat exchanger connecting structure for connecting said lower marine heat exchanger to said upper marine heat exchanger after said upper marine heat exchanger has been connected to the marine vessel by said vessel-to-upper marine heat exchanger connecting structure;

wherein a stagnant ambient water region occurs at said lower, external part of said lower coolant flow tubes, the stagnant region having a stagnant ambient water region depth from said lower external part and a free stream of ambient water flows outside of the stagnant ambient water region; and at least one diverter extending below said lower, external part of said lower, coolant flow tubes and exceeding the stagnant ambient water region to divert the ambient water from the free stream to flow across said lower coolant flow tubes to effect heat transfer from said lower coolant flow tubes to the diverted ambient water.

53. A multiple-stacked marine heat exchanger for being attached to a hull of a marine vessel for cooling at least one heat source in the marine vessel as the marine vessel travels through ambient water, said multiple-stacked marine heat exchanger including an ambient water passageway, said multiple-stacked marine heat exchanger comprising:

an upper marine heat exchanger having a forward end, a rearward end, an upper side and a lower side, said upper marine heat exchanger comprising:

an upper, forward header at the forward end of said upper marine heat exchanger, said upper, forward header including an upper, forward wall defining the upper part of an entrance of the ambient water passageway, the ambient water passageway having the entrance disposed rearwardly from said first position; and a set of upper coolant flow tubes extending rearwardly from said upper, forward header of said upper marine heat exchanger collectively defining an upper part of the ambient water passageway;

a lower marine heat exchanger having a forward end, a rearward end, an upper side and a lower side, said lower heat exchanger being located in a mirror relationship with said upper, forward header, said lower heat exchanger comprising:

a lower, forward header at the forward end of said lower marine heat exchanger, said lower, forward header including a lower, forward wall defining the lower part of the entrance of the ambient water passageway; and a set of lower coolant flow tubes extending rearwardly from said lower, forward header of said lower marine heat exchanger collectively defining a lower part of the ambient water passageway;

a vessel-to-upper marine heat exchanger connecting structure for initially connecting said upper marine heat exchanger to the marine vessel; and a lower marine heat exchanger—upper marine heat exchanger connecting structure for connecting said lower marine heat exchanger to said upper marine heat exchanger after said upper marine heat exchanger has been connected to the marine vessel by said vessel-to-upper marine heat exchanger connecting structure.

54. A multiple-stacked marine heat exchanger according to claim 53 wherein:

said upper forward wall is a beveled wall beveled bevelled rearwardly from a first position to a second position; and said lower forward heat exchanger is a bevelled wall bevelled rearwardly from a first position to a second position.

55. A multiple-stacked marine heat exchanger according to claim 53 wherein:

said upper forward wall is a beveled wall beveled rearwardly from a selected one of first position proximal one of the upper side of said upper marine heat exchanger and a first position proximal the lower side of said upper marine heat exchanger; and said lower forward wall is a beveled wall beveled rearwardly from a selected one of a first position proximal a selected one of the lower side of said lower heat exchanger and a first position proximal the upper side of said lower heat exchanger.

* * * * *